US005191536A

United States Patent [19]

Komuro et al.

[11] Patent Number: 5,191,536

[45] Date of Patent: Mar. 2, 1993

[54] EMBROIDERY DATA PREPARING APPARATUS

[75] Inventors: Kyoji Komuro; Masaaki Yokoe, both of Nagoya; Narihiro Matsushita, Kasugai; Kiyokazu Sekine, Mie; Atsuya Hayakawa, Nagoya; Fumiaki Asano, Nagoya; Hideaki Shimizu, Nagoya, all of Japan

[73] Assignee: Brother Kogyo Kabushiki Kaisha, Nagoya, Japan

[21] Appl. No.: 601,469

[22] Filed: Oct. 23, 1990

[30] Foreign Application Priority Data

Oct. 26, 1989 [JP] Japan ..... 1-279381

[51] Int. Cl.[5] ..... G06F 15/46; D05B 21/00

[52] U.S. Cl. ..... 364/470; 112/121.12; 112/454

[58] Field of Search ..... 364/470, 188, 189, 191-193, 112/121.11, 121.12, 121.13, 266.1, 453-458, 103

[56] References Cited

U.S. PATENT DOCUMENTS 4,413,574 11/1983 Hirota et al. ..... 112/121.12
4,674,420 6/1987 Mizuno et al. ..... 364/400 X
4,943,906 7/1990 Tajima et al. ..... 364/188

*Primary Examiner*—Joseph Ruggiero
*Attorney, Agent, or Firm*—Oliff & Berridge

[57] ABSTRACT

An apparatus for preparing stitch position-related data utilized by an embroidery sewing machine for embroidering a predetermined area by forming stitches at respective stitch positions and filling the area with the formed stitches, including a dividing device for dividing the area into a plurality of sub-areas based on outline data representative of an outline of the area, the outline data including sets of position data each of which is representative of a corresponding one of a plurality of specific positions specified on the outline, and a data producing device for producing sets of sub-area data each of which is representative of an outline of a corresponding one of the sub-areas and determining, based on the sets of sub-area data, an order of embroidering of the sub-areas such that, when the embroidery sewing machine forms stitches with a continuous thread and fills each of the sub-areas by the formed stitches, by utilizing the sets of sub-area data and the order of embroidery of the sub-areas, the continuous thread does not pass over the stitches filling the each sub-area, the data producing device using the sets of sub-area data and the order of embroidering of the sub-areas for producing the stitch position-related data.

20 Claims, 41 Drawing Sheets

FIG. 3

| RAM | 76 |
|---|---|
| AID LINE DATA AREA | 76a |
| BIT IMAGE DATA AREA | 76b |
| OUTLINE DATA AREA | 76c |
| DIVIDED OUTLINE DATA AREA | 76d |
| BLOCK DATA AREA | 76e |
| DIVISION DATA AREA | 76f |
| EMBROIDER ORDER DATA AREA | 76g |
| STITCH POSITION DATA AREA | 76h |
| END BLOCK FLAG | 76i |
| JUNCTION BLOCK FLAG | 76j |
| EMBROIDER ORDER FLAG | 76k |
| BLOCK CHECK FLAG | 76ℓ |
| JUNCTION BLOCK DATA AREA | 76m |
| BRANCH BLOCK DATA AREA | 76n |
| COUNTER | 76o |
| STITCH PATH FLAG | 76p |
| HOLD-OVER FLAG | 76q |
| MAXIMUM AND MINIMUM DATA AREA | 76r |
| BEFORE-DIVISION STACK | 76s |
| AFTER-DIVISION STACK | 76t |
| VERTICES STACK | 76u |
| END BLOCK DATA AREA | 76v |

FIG. 15

OUTLINE DATA FOR AREA E

| NUMBERS | X COORDINATE VALUES | Y COORDINATE VALUES |
|---|---|---|
| 1 | X1 | Y1 |
| 2 | X2 | Y2 |
| 3 | X3 | Y3 |
| ⋮ | ⋮ | ⋮ |
| n | Xn | Yn |
| ⋮ | ⋮ | ⋮ |
| 32 | X32 | Y32 |

FIG. 30

| NUMBERS OF FIRST AID LINE | VERTICES | CANDIDATES |
|---|---|---|
| 0 | $P_{MIN}$ | $P_{MIN}$ |
| 1 | $P_1$ | $D_1$ |
| ⋮ | ⋮ | ⋮ |
| n-1 | $P_{n-1}$ | $D_{n-1}$ |
| n | $P_n$ | $D_n$ |
| n+1 | $P_{n+1}$ | $D_{n+1}$ |
| ⋮ | ⋮ | ⋮ |
| N | $P_{MAX}$ | $P_{MAX}$ |

⊙ : CENTRAL POSITION
⊡ : END POSITION OF STITCH PATH
--→-- : EMBROIDERING DIRECTION
—→— : STITCH PATH

⊙ : CENTRAL POSITION

⊡ : END POSITION OF STITCH PATH

—·→ : EMBROIDERING DIRECTION

--→- : STITCH PATH

EMBROIDERY DATA PREPARING APPARATUS

BACKGROUND OF THE INVENTION

1. Field Of The Invention

The present invention generally relates to an apparatus for preparing stitch position-related data utilized by an embroidery sewing machine, and particularly to the art of automating the operation of preparing stitch position-related data utilized by an embroidery sewing machine for embroidering a predetermined area by forming stitches at stitch positions and filling the area with the formed stitches.

2. Related Art Statement

One of the Applicants has filed a U.S. patent application Ser. No. 07/592,983, filed Oct. 4, 1990, in which he proposes an apparatus for automatically preparing stitch position-related data utilized by an embroidery sewing machine. The proposed apparatus includes (a) dividing means for dividing an area to be embroidered, into a plurality of sub-areas based on outline data representative of an outline of the area, the outline data including sets of position data each of which is representative of a corresponding one of specific positions specified on the outline, and (b) data producing means for producing the stitch position-related data based on the sub-areas. An area to be embroidered may be a polygon or a closed line approximated by a polygon, and the specific positions specified on the outline of the polygon as the area may be the vertices of the polygon. In the case where the outline of an area to be embroidered is approximated by a function such as a spline function, the outline data therefor may consist of sets of position data representative of points defined by the function. An area E shown in FIGS. 8, 19, and 32 is a polygon, and the specific positions specified on the outline of the polygon E are the vertices of the polygon, numbered one through thirty two.

A first example of the dividing means divides an area into divided areas as the sub-areas so that the outline of each of the divided areas has no outward deflection position thereon in an X-Y coordinate system provided for the outline. The deflection position on the outline in the X-Y coordinate system is defined as being a specific position at which the two specific positions adjacent to the specific position in question, respectively located on both sides thereof, are both located on one side of a straight line which passes the specific position in question and is perpendicular to a pre-selected one of the X and Y axes of the X-Y coordinate system. In the case where the specific positions are checked on the outline in a clockwise direction, the outward deflection position is defined as being a deflection position the following specific position of which is located on a left-hand side of the deflection position in question. On the other hand, in the case where the specific positions are checked in a counterclockwise direction, the outward deflection position is defined as being a deflection position the following specific position of which is located on a right-hand side of the deflection position in question. FIG. 18 shows an example of the division of an area into divided areas by the first example of the dividing means.

A second example of the dividing means includes determining means for determining the most distant, or approximately the most distant, two positions of the specific positions specified on the outline line of an area, and checking means for judging whether or not all straight segments obtained by connecting between each of the distant two positions and each of the remainder specific positions on the outline, are contained in the area. This dividing means divides the area into divided areas as the sub-areas so that the checking means provides an affirmative judgment for each of the divided areas. FIG. 19 shows an example of the division of an area into divided areas by the second example of the dividing means.

The division of a predetermined area into divided areas by the first or second example of the dividing means, is effected for the purpose of reducing the direction of a straight line approximating each of the divided areas (hereinafter, referred to as the longitudinal direction for the reason indicated later), to being generally parallel to the direction of a curved line or polygonal line approximating the same divided area which direction is taken at any position or portion on the line (hereinafter, referred to as the central-line direction). The second example of the dividing means may be operated for a divided area produced by the first example of the dividing means.

A third example of the dividing means includes first determining means for determining the most distant, or approximately the most distant, two positions of the specific positions specified on the outline line of an area, as a minimum and a maximum position of the area, second determining means for determining the direction of a straight line passing the minimum and maximum positions as a longitudinal direction of the area, the outline consisting of a pair of portions which are opposed to each other with respect to the minimum and maximum positions, third determining means for comparing the number of specific positions of one of the opposed portions of the outline, with that of the other portion thereof, and determining as a first portion of the outline one of the opposed portions which includes the smaller number of specific positions, defining means for defining a plurality of straight first aid lines which are perpendicular to the longitudinal direction and each of which passes a corresponding one of the specific positions of the first portion and intersects the second portion other than the first portion, the first aid lines dividing the area and the outline into blocks and segments, respectively, each of the blocks being enveloped by corresponding two of the first aid lines which are opposed to each other and corresponding two of the segments which are opposed to each other, and modifying means for modifying the each block by selecting, as a division base position, one of the specific positions of the second portion which one position cooperates with the specific position associated with each of the opposed two first aid lines of the each block to define, in place of the each first aid line, a corresponding one of division lines which passes the associated specific position belonging to the first portion and the division base position belonging to the second portion, the modified blocks serving as the sub-areas and including two triangle-like blocks each of which is approximated by a triangle defined by three specific positions and to which the minimum and maximum positions belong, respectively. The blocks except for the two triangle-like blocks are quadrangle-like blocks each approximated by a quadrangle defined by four specific positions. The blocks are produced from the area so as to provide an array extending generally in the longitudinal direction of the area. The third example of the dividing means may be operated for a divided area produced by the first and/or second example of the dividing means. FIG. 32 shows an example of the division of an area into blocks by the third example of the dividing means.

Three of the Applicants have also filed a Japanese Patent Application No. 1(1989)-167875 on Jul. 19, 1989, which has not been published. In the Application, they proposes an apparatus for automatically preparing stitch position-related data utilized by an embroidery sewing machine. The proposed apparatus includes data producing means for producing sets of sub-area data each of which is representative of an outline of a corresponding one of sub-areas of an area to be embroidered and, based on the sets of sub-area data, determining an order of embroidering of the sub-areas such that, when an embroidery sewing machine forms stitches with a continuous thread and fills each of the sub-areas by the formed stitches, by utilizing the sets of sub-area data and the order of embroidering of the sub-areas, the continuous thread does not pass over the stitches filling the each sub-area. In order to embroider an area with a continuous thread, first, a start and an end position at which embroidering or stitching starts and ends, respectively, are specified, and then stitches are formed from the start position to the end position for filling the area with the formed stitches. In the case where an area to be embroidered has no junction or branch like a character, C, and simultaneously the start and end positions for embroidering the area are specified in different positions belonging to two sub-areas of the area, respectively, which are located at end portions of the area (i.e., end sub-areas of the area), the data producing means may determine the order of embroidering of the sub-areas such that the embroidering begins with the sub-area to which the start position belongs, proceeds in the order of location or position of the sub-areas in the area, and ends with the sub-area to which the end position belongs.

However, an area may have a junction or a branch as the area E shown in FIG. 36. The block numbered eight of the area E is a junction block from which four branches extend outward. There will be described the case where the production of position-related data for embroidering the area E of FIG. 36, for example, by reference to FIG. 37.

Specifically, first, the data producing means determines the block numbered thirteen to which the start position indicated at Ps in FIG. 37, i.e., position numbered twenty five belongs, as the first block to be embroidered, and the blocks numbered fourteen and fifteen as the second and third blocks to be embroidered. The block numbered fifteen is one of the four adjacent blocks of the junction block, numbered eight. The junction block, however, is not determined as the fourth block to be embroidered. One of the three adjacent blocks of the junction block different from the block numbered fifteen, is selected, and a block which is the end block of a branch to which the selected block belongs, is determined as the fourth block to be embroidered. If the end block, numbered four, is determined as the fourth block, the blocks numbered three, two, and one are determined as the fifth, sixth, and seventh blocks to be embroidered. If, in this case, the blocks numbered one, two, three, and four are determined as the fourth, fifth, sixth, and seventh block to be embroidered, the continuous thread passes over the stitches formed in the blocks numbered four, three, two, and one when the thread is returned from the end block to the junction block. This leads to deteriorating the quality of embroidery of the area E.

It is desired that the production of stitch position-related data or stitch position data be automated to as high an extent as possible. That is, it is required that the load applied to the operator for the data production be reduced to as low an extent as possible and the time needed for the data production be minimized. However, none of the above identified apparatus are sufficiently satisfactory since those apparatus do not provide a sufficient degree of automation of the data production.

SUMMARY OF THE INVENTION

It is therefore an object of the present invention to provide an apparatus for automatically producing stitch position-related data utilized by an embroidery sewing machine for embroidering a predetermined area.

The above object has been achieved by the present invention, which provides an apparatus for preparing stitch position-related data utilized by an embroidery sewing machine for embroidering a predetermined area by forming stitches at respective stitch positions and filling the area with the formed stitches, comprising (a) dividing means for dividing the area into a plurality of sub-areas based on outline data representative of an outline of the area, the outline data including sets of position data each of which is representative of a corresponding one of a plurality of specific positions specified on the outline, and (b) data producing means for producing sets of sub-area data each of which is representative of an outline of a corresponding one of the sub-areas and determining, based on the sets of sub-area data, an order of embroidering of the sub-areas such that, when the embroidery sewing machine forms stitches with a continuous thread and fills each of the sub-areas by the formed stitches, by utilizing the sets of sub-area data and the order of embroidering of the sub-areas, the continuous thread does not pass over the stitches filling the each sub-area, the data producing means using the sets of sub-area data and the order of embroidering of the sub-areas for producing the stitch position-related data.

In the stitch position-related data preparing apparatus constructed as described above, an area to be embroidered is automatically divided into sub-areas, sets of sub-area data representative of the outlines of the sub-areas are automatically determined, and an order of embroidering of the sub-areas are automatically determined based on the sets of sub-area data. Thus, the automation of production of the stitch position-related data or stitch position data is improved to a satisfactory degree. Therefore, the load on the operation for the data production is minimized, and the time needed is extremely reduced. The data producing means may comprise means for determining a connect path for connecting between two of the sub-areas which are not adjacent to each other, namely, are spaced from each other by at least one interposed sub-area, so that the continuous thread does not pass over the stitches filling the sub-areas or area.

According to a preferred feature of the present invention, the data producing means determines a connect path for connecting with the continuous thread between a first position belonging to a first one of the sub-areas and a second position belonging to a second one of the sub-areas, at least a portion of the connect path being covered by the stitches filling at least one of the second sub-area and one or more sub-areas subsequent to the second sub-area in the order of embroidering of the sub-areas. The connect path may be determined such that a portion thereof passes outside the area. The thread running along the outside portion of the connect path may be removed or cut after the embroidering of the area. The data producing means may determine the connect path such that the connect path is covered in entirety by the stitches filling the each area, and produce connect path data representative of the connect path as a portion of the stitch position-related data. In this case, the thread running along the connect path does not pass over the stitches filling the area, or pass outside the area. The data producing means may further comprise means for judging, based on said sets of sub-area data, whether or not it is necessary to determine the connect path such that the connect path is covered in entirety by the stitches filling the each area.

According to another feature of the present invention, the apparatus further comprising means for specifying in the area a start and an end position where the embroidering of the area starts and ends, the data producing means determining the order of embroidering of the sub-areas based on the start and end positions.

According to yet another feature of the present invention, the dividing means specifies a plurality of base positions on the outline of the area based on the outline data, and defines a plurality of straight division lines each of which passes corresponding two of the base positions and which do not intersect each other inside the outline, the division lines dividing the area into the sub-areas, the base positions including the specific positions. The dividing means may divide a polygon as the area into a plurality of sub-polygons as the sub-areas, the specific positions consisting of vertices of the polygon, the base positions including the vertices.

In a preferred embodiment according to the above indicated feature of the invention, the dividing means comprises determining means for determining the most distant, or approximately the most distant, two positions of the specific positions of the outline of the area, as a minimum and a maximum position of the area, and determining a direction of a straight line passing the minimum and maximum positions as a longitudinal direction of the area, deflection position finding means for rotating the outline in an X-Y coordinate system so that the longitudinal direction becomes parallel to one of an X and a Y axis of the X-Y coordinate system, and successively checking the specific positions in an order of location thereof on the outline, for a deflection position, by judging whether or not a sign of a value obtained by subtracting a value with respect to the one axis of a currently checked specific position from that of a following specific position which is checked next, is same as that of a value obtained by subtracting a value with respect to the one axis of a preceding specific position which has just been checked from that of the currently checked specific position, the deflection position finding means determining, if a negative judgment is provided, the currently checked position as said deflection position, and deflection direction judging means for judging whether or not the deflection position is an outward deflection position, the deflection direction judging means judging, in the case where the deflection position finding means checks the specific positions on the outline in a clockwise direction, the deflection position as being the outward deflection position if the following specific position of the deflection position is located on a left-hand side thereof as viewed in a direction of a vector starting at the preceding specific position of the deflection position and ending at the deflection position, and, in the case where the deflection position finding means checks the specific positions on the outline in a counterclockwise direction, the deflection position as being the outward deflection position if the following specific position of the deflection position is located on a right-hand side thereof as viewed in the direction of the vector, the dividing means dividing the area into divided areas as the sub-areas by the division lines so that each of the divided areas has no outward deflection position.

In another embodiment according to the same feature of the invention, the dividing means comprises determining means for determining the most distant, or approximately the most distant, two positions of the specific positions of the outline of the area, as a minimum and a maximum position of the area, and judging means for judging whether or not all straight segments obtained by connecting between each of the distant two positions and each of the other specific positions of the outline are contained inside the outline, the dividing means dividing the area into divided areas the sub-areas by the division lines so that the judging means provides an affirmative judgment for each of the divided areas. The area divided by this dividing means may be a divided area produced by the dividing means of the above indicated embodiment.

In yet another embodiment according to the same feature of the invention, the dividing means comprises determining means for determining the most distant, or approximately the most distant, two positions of the specific positions of the outline of the area, as a minimum and a maximum position of the area, and determining a direction of a straight line passing the minimum and maximum positions as a longitudinal direction of the area, the outline consisting of a pair of portions which are opposed to each other with respect to the minimum and maximum positions, defining means for comparing a number of the specific positions of one of the opposed portions of the outline, with that of the other of the opposed portions, determining as a first portion of the outline one of the opposed portions which has a smaller number of the specific positions, and defining a plurality of straight first aid lines which are perpendicular to the longitudinal direction and each of which passes a corresponding one of the specific positions of the first portion and intersects the other of the opposed portions as a second portion of the outline, the first aid lines dividing the area and the outline into a plurality of first blocks and a plurality of first segments, respectively, each of the first blocks being enveloped by corresponding two of the first aid lines which are opposed to each other and corresponding two of the first segments which are opposed to each other, and first modifying means for modifying the each first block by selecting, as a division base position, one of the specific positions of the second portion of the outline which one specific position cooperates with the specific position associated with each of the opposed two first aid lines of the each first block to define, in place of the each first aid line, a corresponding one of the division lines which passes the associated specific position belonging to the first portion of the outline and the division base position belonging to the second portion of the outline, the sub-areas consisting of the modified first blocks resulting from the first blocks, the modified first blocks including two triangle-like blocks to which the minimum and maximum positions belong, respectively, each of the triangle-like blocks being approximated by a triangle defined by three of the specific positions. The area divided by this dividing means may be a divided area produced by the dividing means of either one, or both, of the above indicated two embodiments. The dividing means may comprise second modifying means for modifying the each triangle-like block to a quadrangle-like block which is approximated by a quadrangle defined by four of the specific positions.

In a preferred form of the above indicated third embodiment, the dividing means comprises means for defining a plurality of straight second aid lines which are perpendicular to the longitudinal direction and each of which passes a corresponding one of the specific positions of the second portion of the outline, the second aid lines cooperating with the first aid lines to divide the area and the outline into a plurality of second blocks and a plurality of second segments, respectively, each of the second blocks being enveloped by corresponding two of the first and second aid lines which are opposed to each other and corresponding two of the second segments which are opposed to each other, means for determining a first vector starting at one of opposite ends of one of the opposed two second segments of each of the second blocks and ending at the other end of the one second segment, a second vector starting at one of opposite ends of the other of the opposed two second segments which end is opposed to the one end of the one second segment and ending at the other end of the other second segment which end is opposed to the other end of the one second segment, and a third vector which starts at a position on one of the opposed two aid lines of the each second block, extends in a direction of a vector produced by addition of the first and second vectors, and ends at a position on the other of the opposed two aid lines, the end position on each of the first and second aid lines at which the third vector for one of the two second blocks on both sides of the each aid line ends serving simultaneously as the start position on the each aid line at which the third vector for the other second block starts, the minimum position serving as either the start or end ends for both the first and second vectors for the second block to which the minimum position belongs and simultaneously as either the start or end position for the second block to which the minimum position belongs and, while the maximum position serving as either the end or start ends for both the first and second vectors for the second block to which the minimum position belongs and simultaneously as either the end or start position for the second block to which the maximum position belongs, means for determining for each of the first aid lines a fourth vector by addition of the third vectors for the two blocks on both sides of the each first aid line, and means for defining a straight reference line which passes the specific position associated with the each first aid line and is perpendicular to the fourth vector.

It is preferred that the dividing means comprise means for determining an intersection of the each first aid line and the second portion of the outline, and determining two of the specific positions of the second portion which two positions are adjacent to the intersection on both sides thereof, respectively, as a preceding and a following specific position for the specific position associated with the each first aid line, and means for comparing a first angle contained by the reference line and a first straight line passing the preceding specific position and the associated specific position, with a second angle contained by the reference line and a second straight line passing the following specific position and the associated specific position, the dividing means determining as the division base position one of the preceding and following specific positions which provides a smaller one of the first and second angles, the each modified first block being defined by the outline and the division lines determined for the opposed two aid lines of the each first block.

It is further preferred that the dividing means comprise first judging means for judging whether or not the preceding specific position is located between the intersection, and an intersection of the second portion of the outline and the first aid line associated with one of the two specific positions of the first portion which two positions are adjacent to the specific position associated with the each first aid line, on both sides of the associated specific position, respectively, second judging means for judging whether or not the following specific position is located between the intersection, and an intersection of the second portion and the first aid line associated with the other of the two specific positions, the dividing means determining as the division base position a middle point of a straight segment connecting between the preceding and following specific positions if both the first and second judging means provide negative judgments, the dividing means determining as the division base position the preceding specific position if both the first and second judging means provide an affirmative judgment and the negative judgment, respectively, the dividing means determining as the division base position the following specific position if both the first and second judging means provide the negative judgment and an affirmative judgment, respectively, the dividing means determining the division base position by utilizing the comparison result of the means for comparing the first and second angles, if both the first and second judging means provide the affirmative judgments.

It is recommended that the dividing means comprise means for specifying one or more positions on the second portion of the outline for which positions the division base position or positions have not been determined, and determining for the one or more specific positions the division base position or portions on the first portion of the outline, the dividing means dividing the area into quadrangle-like blocks as the modified first blocks except for the two triangle-like blocks to which the minimum and maximum positions belong, respectively, the modified first blocks constituting an array in the area.

According to another feature of the present invention, the producing means comprises first memory means for storing, as the sets of sub-area data, sets of block data representative of an outline of a corresponding one of the modified first blocks, second memory means for storing the sets of block data in the order of embroidering of the modified first blocks, means for specifying on the outline of the area a start and an end position where the embroidering of the area starts and ends, checking means for checking the sets of block data stored in the first memory means, for a start and a terminal block which are two of the modified first blocks to which the start and end positions belong, respectively, an end block which shares only one of the division lines with only one of the modified first blocks which one block is adjacent thereto, and a junction block which shares three or more of the division lines with three or more of the modified first blocks which blocks are adjacent thereto, and order determining means for, if the modified first blocks includes the junction block, storing in the second memory means the set or sets of block data for the start block and, if any, the block or blocks between the start block and the junction block, exclusive, in a first order of location of the block or blocks from the start block toward the junction block, the order determining means checking the sets of block data for the junction block, any one of the adjacent blocks of the junction block other than the adjacent block whose block data has been stored in the second memory means, and, if any, the block or blocks belonging to a branch extending from the one adjacent block, for finding the end block located at an end portion of the branch, in a second order of location of the block or blocks from the junction block toward the end block, determining, if the end block is not the terminal block, the connect path such that the connect path passes in the second order a position belonging to each of the junction block and the block or blocks belonging to the branch, and storing a set of connect path data representative of the connect path in the second memory means, the order determining means storing, subsequent to the set of connect path data in the second memory means, the set or sets of block data for the end block and, if any, the block or blocks between the end block and the junction block, exclusive, in a third order of location of the block or blocks from the end block toward the junction block, the order determining means determining, if the end block is the terminal block, storing in the second memory means the sets of block data for the junction block, the terminal block, and, if any, the block or blocks between the junction block and the terminal block, exclusive, in a fourth order of location of the blocks from the junction block to the terminal block.

According to yet another feature of the present invention, the data producing means producing, based on the sets of block data and set of connect path data stored in the second memory means, stitch position data representative of stitch positions which the embroidery sewing machine connects with the continuous thread to form the stitches for filling the each of the sub-areas with the formed stitches and form one or more stitches along the connect path for connecting two of the modified first blocks, the stitch position data serving as the stitch position-related data.

According to a further feature of the present invention, the apparatus comprises image read means for reading an image of the area, and outline data producing means for producing the outline data from the read image of the area. In this case, the outline data is automatically produced, and therefore the degree of automation of the stitch position-related data production is further improved.

In a preferred embodiment according to the above indicated feature of the invention, the apparatus further comprises display means for displaying an outline of the image read by the image read means, and manually operable specifying means for specifying as the specific positions a plurality of positions on the outline of the read image, the outline data producing means producing the outline data such that the outline data consists of the specified positions.

In another embodiment according to the same feature of the invention, the apparatus further comprises specifying means for specifying as candidates for the specific positions a plurality of positions at regular distances on the outline of the read image, and connecting with a straight segment between each pair of adjacent two of the candidates, and judging means for judging whether or not a smaller one of the two angles defined by each pair of adjacent two of the straight segments, is smaller than a reference value, the outline data producing means adopting, if an affirmative judgment is provided by the judging means, the candidate at which the each pair of adjacent two segments are connected to each other, as one of the specific positions.

BRIEF DESCRIPTION OF THE DRAWINGS

The above and other objects, features and advantages of the present invention will be better understood by reading the following detailed description of the presently preferred embodiment of the invention when considered in conjunction with the accompanying drawings, in which:

FIG. 3 is an illustrative view of a random access memory (RAM) of a computer which constitutes an essential part of the control device;

FIGS. 4, 4A, 4B, and 4C show a flow chart illustrating the stitch position data prepare routine stored in a read only memory (ROM) of the computer;

FIGS. 5, 6, 6A, 6B, 7, 8, 8A, 8B, 9, 9A, 9B, 9C, 10, 10A, 10B, 10C, 10D, 10E, 10F, 10G, 10H, 10I, 10J, and 10K show flow charts illustrating the routines stored in the ROM which routines are associated with the data prepare routine;

FIGS. 11 through 15 are views for explaining the routine of FIG. 4;

FIGS. 23 through 32 are views for explaining the routine of FIG. 9;

DETAILED DESCRIPTION OF THE PREFERRED EMBODIMENT

Figure 1:
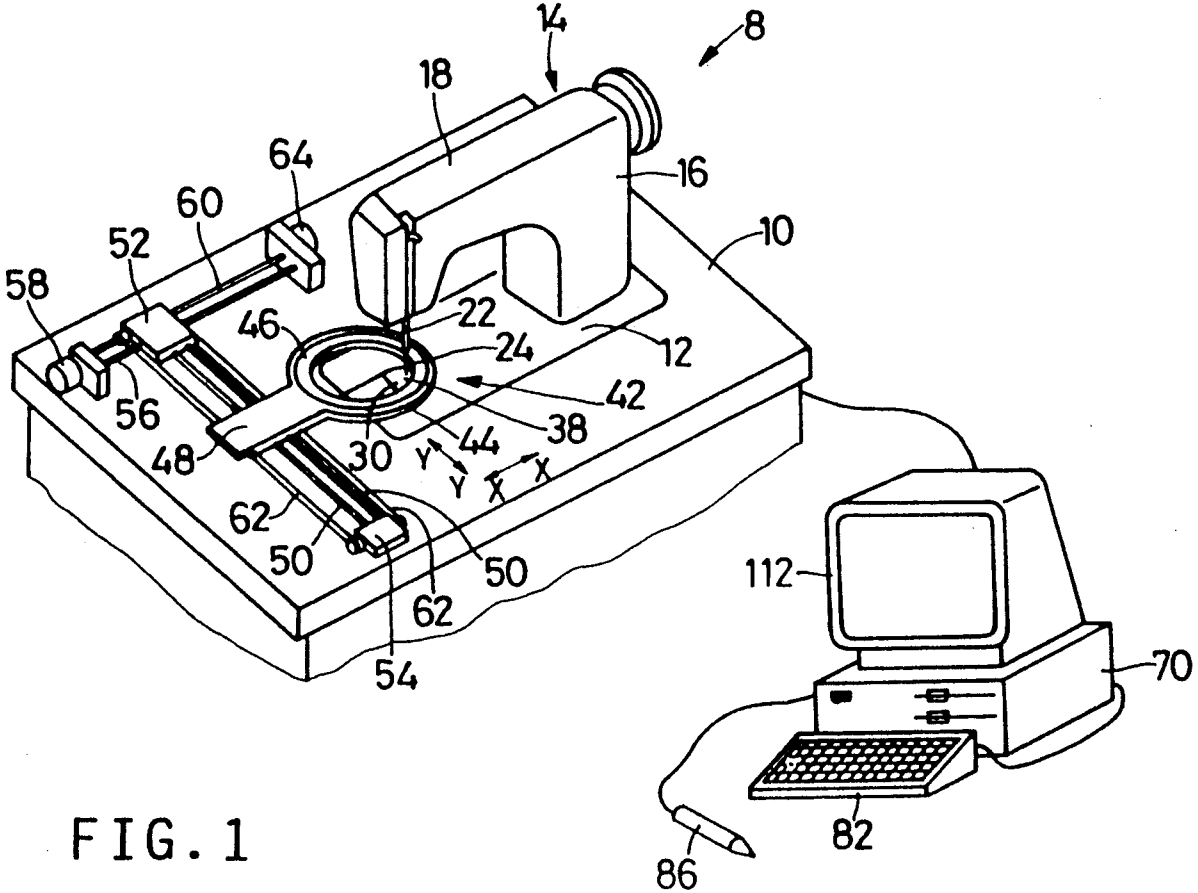
FIG. 1 is a perspective view of an embroidery sewing machine system which includes a data producing apparatus embodying the present invention.

Referring first to FIG. 1, there is shown an embroidery sewing machine system embodying the present invention. The system includes an embroidery sewing machine 8.

In FIG. 1, reference numeral 10 designates a table of the sewing machine 8 on which a bed 12 and a main frame 14 are provided. The main frame 14 includes a column 16 extending vertically from the bed 12, and an arm 18 extending horizontally from an upper portion of the column 16 like a cantilever. A needle bar 22 is connected to the main frame 14 via a needle bar frame (not shown), such that the needle bar 22 is vertically movable. A needle 24 is secured to a lower end of the needle bar 22. The needle bar 22 is coupled to a main motor 26 (FIG. 2) via a needle bar connecting bracket (not shown). The needle bar 22 or needle 24 is reciprocated vertically when the main motor is driven. The bed 12 has an opening formed in an upper face thereof. A throat plate 30 having a needle aperture 38, closes the opening of the bed 12.

An embroidery frame 42 is mounted on the table 10 such that the embroidery frame 42 is movable along an X and a Y axis defined for the sewing machine 8 as indicated at arrows X and Y, respectively. The X and Y axes are perpendicular to each other. The embroidery frame 42 includes an outer frame 44 having a ring portion, and an inner frame 46 which fits in the ring portion of the outer frame 44. The outer and inner frames 44, 46 cooperate with each other to support a work fabric (not shown) inserted therebetween. The outer frame 44 has a slide portion 48 extending from the ring portion thereof along the X axis away from the column 16 along the X axis. The slide portion 48 is slidably engaged with a pair of guide bars 50, 50 extending along the Y axis. Two pairs of corresponding opposite ends of the guide bars 50, 50 are connected by a first and a second connecting members 52, 54, respectively. The first connecting member 52 rests on a feed screw 56 and a rotation transmitting bar 60 each extending along the X axis, so that the first connecting member 52 is moved along the X axis when the feed screw 56 is driven or rotated by an X drive motor 58. In the meantime, the second connecting member 54 rests on the bed 10 via a ball member (not shown) rotatably supported by the second connecting member 54, so that the ball member is moved together with the second connecting member 54 as a unit. A pair of endless wires 62, 62 each engages the slide portion of the embroidery frame 42, and the first and second connecting members 52, 54. When the rotation transmitting bar 60 is rotated by a Y drive motor 64, the wires 62, 62 are displaced, so that the slide portion 48 is moved along the Y axis. By combination of the movement of the first connecting member 52 along the X axis and the movement of the slide portion 48 along the Y axis, the embroidery frame 42 is moved relative to the bed 10 to any position in a horizontal plane or an X-Y orthogonal coordinate system defined by the X and Y axes. The embroidery frame movement cooperate with the needle reciprocation movement to ensure that the sewing machine 8 embroiders a predetermined area on the work fabric supported by the embroidery frame 42.

Figure 2:
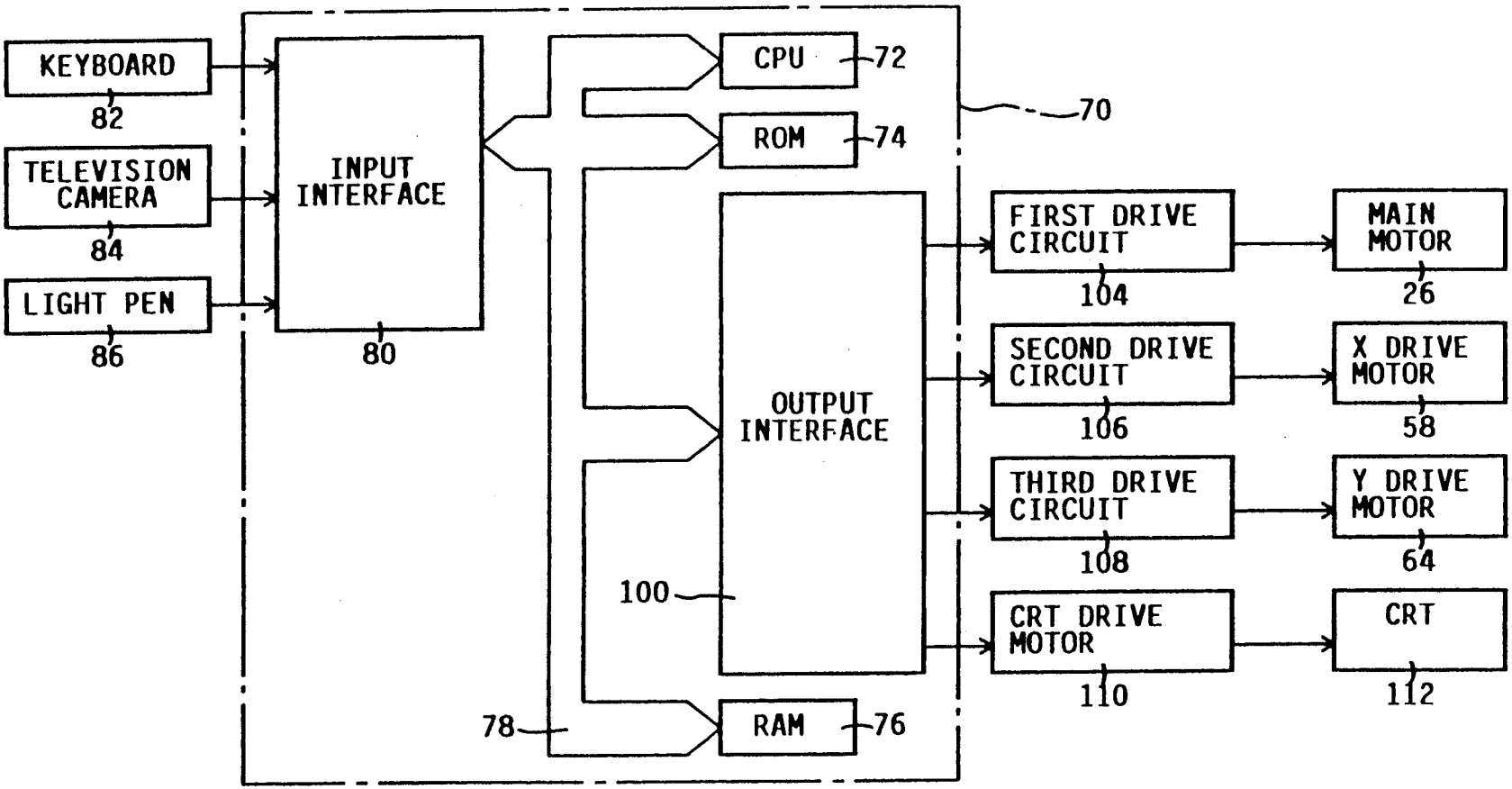
FIG. 2 is a diagrammatical view of a control device for controlling the operation of the system of FIG. 1.

The operation of the present sewing machine 8 is controlled by a control device 70. As illustrated in FIG. 2, the control device 70 essentially is constituted by a computer which includes a central processing unit (CPU) 72, a read only memory (ROM) 74, a random access memory (RAM) 76, and a bus 78. The control device 70 includes an input interface 80 through which a key board 82, a television camera 84, and a light pen 86.

The control device 70 further includes an output interface 100 through which a first, a second, and a third drive circuit 104, 106, 108 are connected to the control device 70. The first, second, and third drive circuits 104, 106, 108 serve for driving the main motor 26, X drive motor 58, and Y drive motor 64, respectively. In addition, a cathode ray tube (CRT) 112 is connected to the control device through a CRT drive circuit 110 and the output interface 100.

Further, as shown in FIG. 3, the RAM 76 includes a working area, and various data memory areas 76*a*–76*h*, 76*m*, 76*n*, 76*r*, 76*v*. The aid line data area 76*a* stores sets of aid line data, and the bit image data area 76*b* stores sets of bit image data. The outline data area 76*c* stores sets of outline data, while the divided outline data area 76*d* stores sets of divided outline data. The block data area 76*e* stores sets of block data, while the division data area 76*f* stores sets of division data. The embroider order data area 76*g* stores sets of embroider order data, while the stitch position data area 76*h* stores sets of stitch position data. The junction block data area 76*m* stores sets of block data for junction blocks, while the branch block data area 76*n* stores sets of block data for branch blocks. The maximum and minimum positions data area 76*r* stores sets of maximum and minimum positions data, while the end block data area 76*v* stores sets of block data for end blocks. The RAM 76 further includes various flags; end block flags 76*i*, junction block flags 76*j*, embroider order flags 76*k*, block check flags 76*l*, stitch path flag 76*p*, and hold-over flags 76*q*. The RAM 76 also includes a counter 76*o*, and three stacks 76*s*, 76*t*, 76*u*. The before-division stack 76*s* stores sets of index data for designating sets of outline data or sets of divided outline data before being subjected to a division routine (described below), and the after-division stack 76*t* stores sets of index data for designating sets of outline data or sets of divided outline data after being subjected to a division routine. The vertices stack 76*u* stores sets of index data designating vertices. The function of each of the above indicated data memory areas, flags, counter and stacks of the RAM 76 is described in detail later. In this connection, it is noted that the stacks 76*s*, 76*t*, 76*u* each are a pushdown stack.

The ROM 74 stores the stitch position data prepare program represented by the flow charts of FIGS. 4, 5, 6, 7, 8, 9, 10.

Figure 11:
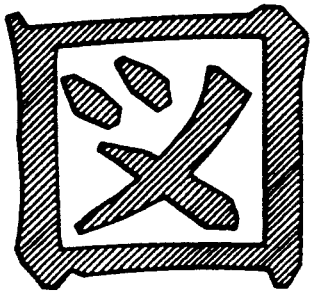

There will be described the operation of the present system effected for preparing a set of stitch position data for embroidering on a work fabric a Chinese character "⊠" shown in FIG. 11, for example.

Figure 4A:
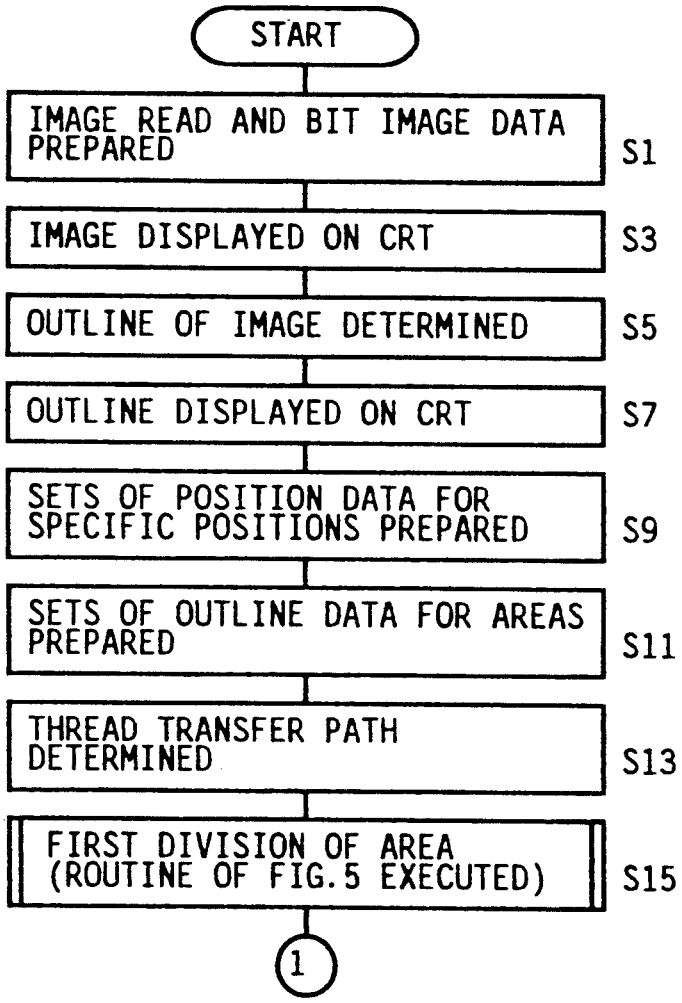
Figure 4B:
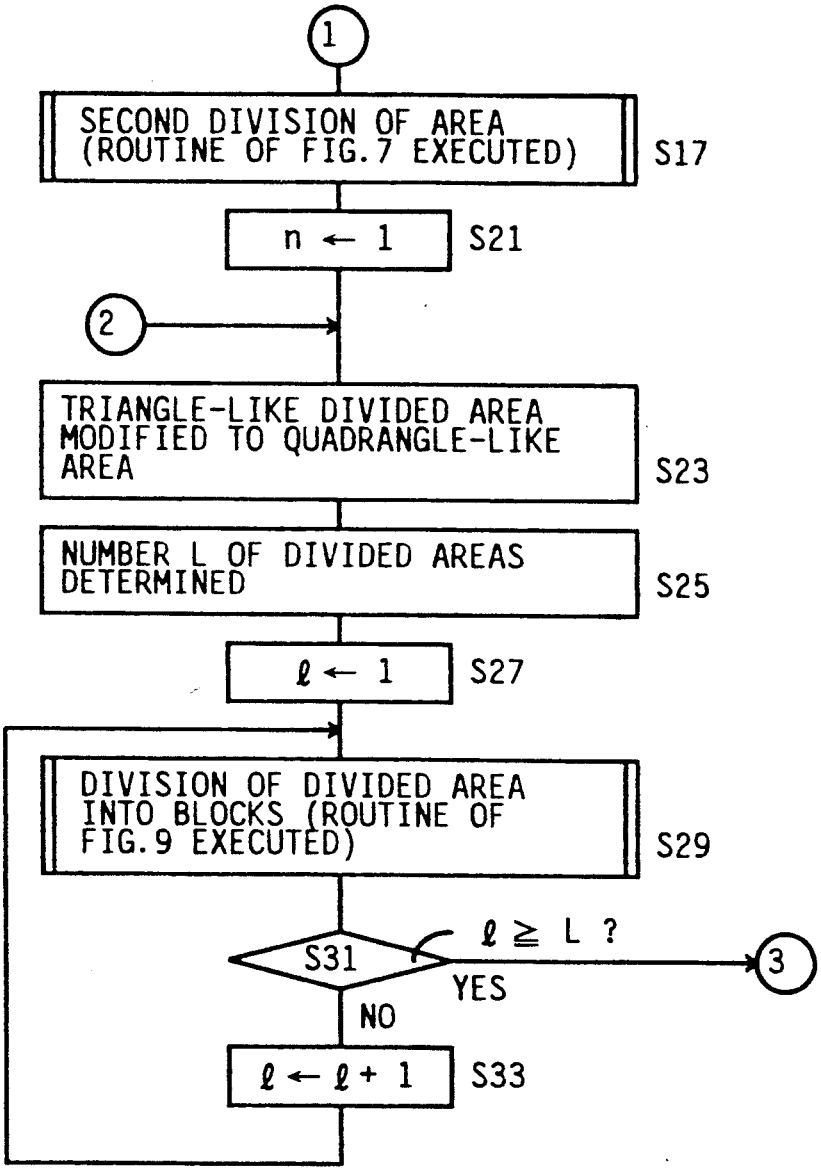
Figure 4C:
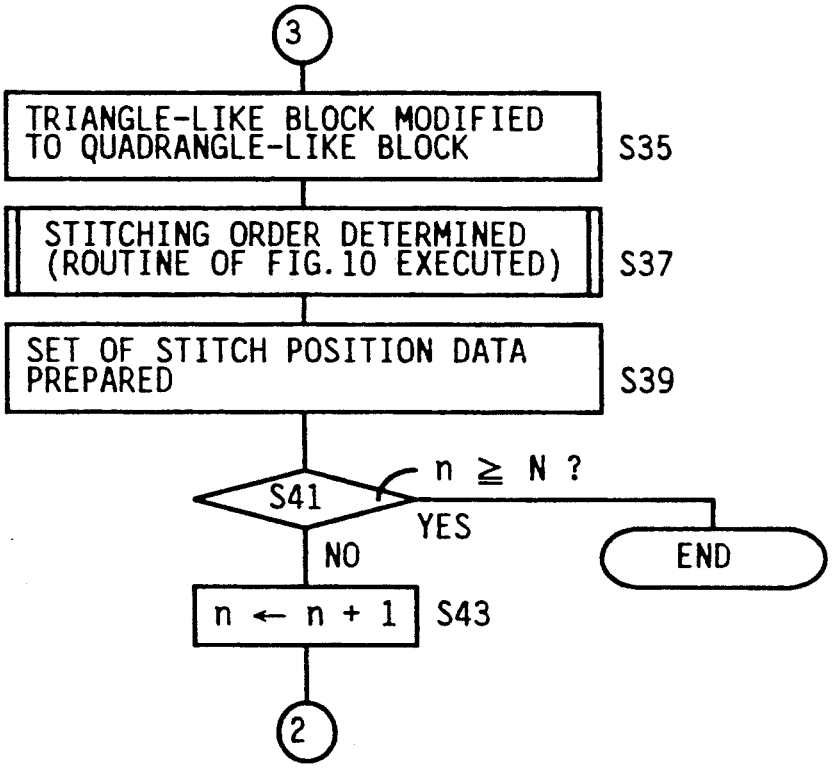
Figure 12:
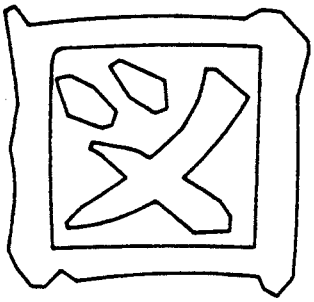

When the operator keys in a stitch position data prepare command through the keyboard 82 after applying electric power to the present system, the control of the CPU 72 begins with Step S1 of FIG. 4 (4A, 4B, 4C) to read an image of the character "⊠" recorded on a white sheet (not shown) by using the television camera 84, and prepare a set of bit image data representative of the image. The set of bit image data is stored in the bit image data area 76*b*. Step S1 is followed by Step S3 to display the image on the CRT 112 based on the set of bit image data. Subsequently, in Step S5, edge or border lines between the image and the background thereof are determined as an outline of the image. Step S5 is followed by Step S7 to display the outline on the CRT 112 as indicated in FIG. 12.

Subsequently, the operator specifies a plurality of specific positions on the outline by using the light pen 86. For this operation, there is provided a rule that, in the case where an outline to be processed includes an independent or separate portion defined by a pair of parallel closed lines, such as the portion "□" of the character "⊠" shown in FIG. 12, the operator should specify specific positions so that the portion is divided into a plurality of divided portions (hereinafter referred to as the areas) each of which is defined by a single closed line as an outline of the each area). The portion "□" is divided into four areas indicated at A, B, C, D in FIG. 13.

Eventually, the character "⊠" is divided into seven areas A through G. The specific positions specified on the outline of each of the areas cooperate with each other to define a polygon approximating a corresponding one of the areas.

Figure 14:
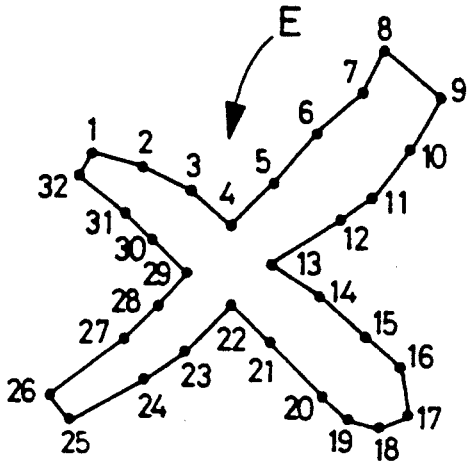

In Step S9, for each area A-G, a plurality of sets of position data each of which is representative of a corresponding one of the specific positions specified therefor, are prepared. Specifically, each position data consists of the X and Y coordinate values of the corresponding specific position in the X-Y orthogonal coordinate system provided for the sewing machine 8. Step S9 is followed by Step S11 to prepare, for each area A-G of FIG. 13, a set of outline data representative of the outline of the each area, based on the corresponding sets of position data prepared in Step S9. The thus prepared set of outline data are stored in the outline data area 76c in the order of determination of the individual areas. For easier understanding, it is assumed that the sets of outline data for the areas A, B, C, D, E, F, G are stored in the outline data area 76c in the order of description. In addition, it is assumed that, for the area E, specific positions numbered one through thirty two are specified as shown in FIG. 14. The specific positions cooperate with each other to define a polygon approximating the area E, and serve as the vertices of the polygon. Hence, hereafter, those specific positions are referred to as the vertices. The set of outline data for the area E consists of the sets of position data representative of the vertices numbered one through thirty two, as indicated in FIG. 15.

Figure 13:
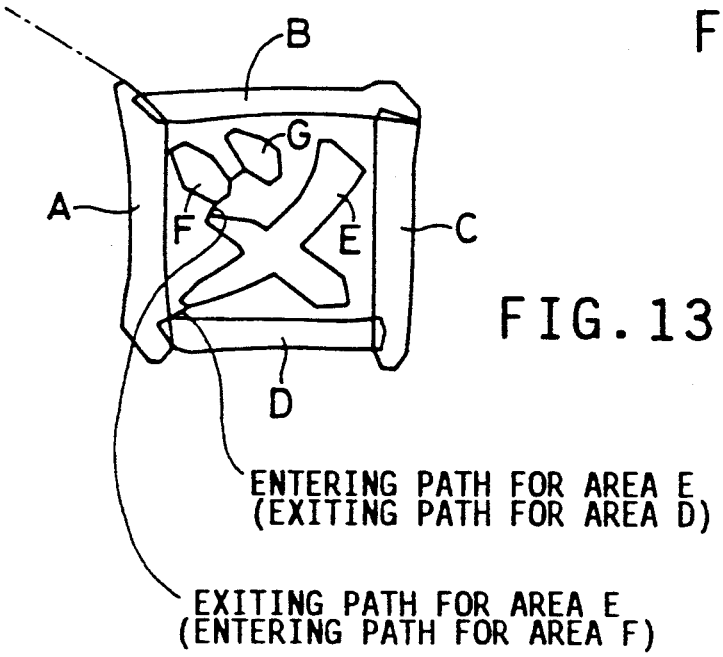
Figure 37:
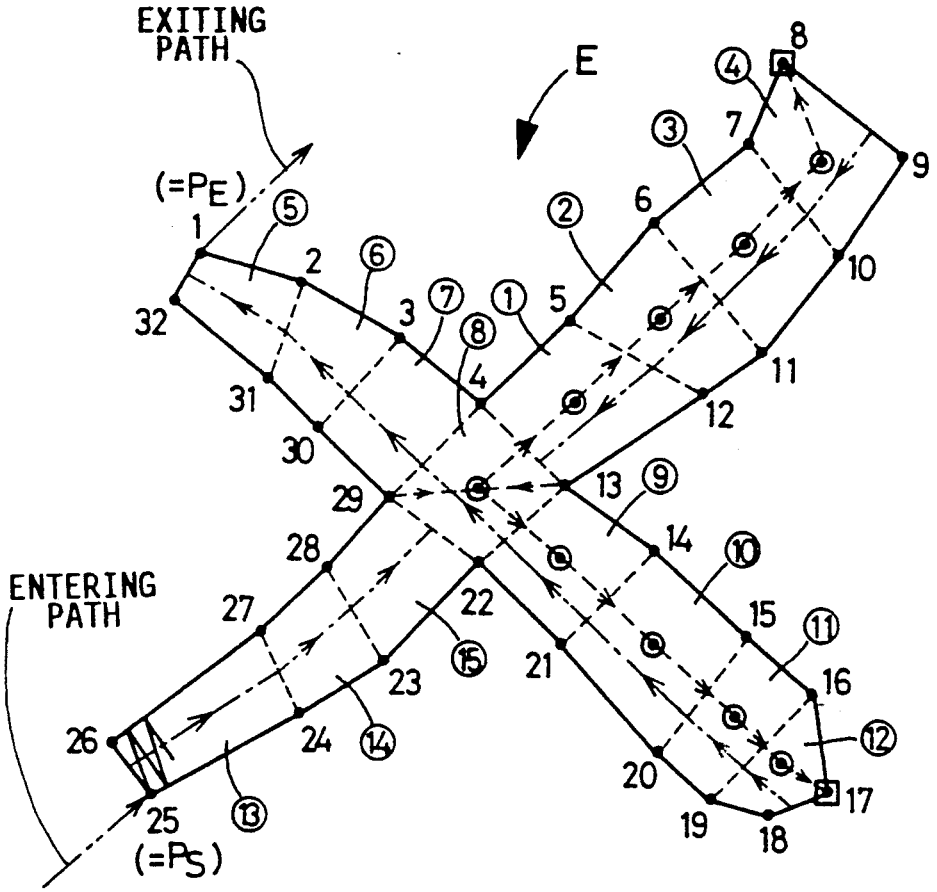
FIGS. 37 and 38 are views for explaining the routine of FIG. 10.

Step S11 is followed by Step S13 to determine a transfer path along which the sewing machine 8 transfers a continuous thread from each of the areas to the following area of the each area so that the areas A-G of the character "⊠" are embroidered with the continuous thread in the order of storage of the sets of outline data therefor in the outline data area 76c. For transferring a thread from each area to the following area, a start and an end position are specified at positions belonging to the associated two areas, respectively. With respect to the area E, the end position of the entering transfer path therefor is specified at a vertex numbered twenty five as shown in FIG. 37, while the start position of the exiting transfer path is specified at a vertex numbered one. The entering transfer path for the area E simultaneously is the exiting transfer path for the area D, while the exiting transfer path for the area E is the entering transfer path for the area F, as shown in FIG. 13. For each transfer path connecting a pair of successive areas in the embroider order of the areas A-G, the nearest, or sufficiently near, two vertices of all the vertices belonging to the two successive areas, one of which belongs to one of the two areas and the other vertex of which belongs to the other area, are determined as the start and end positions of the each transfer path.

Step S13 is followed by Step S15. Step S15 is the first divide routine illustrated in FIG. 5, in which an area, or a polygon approximating the area, is divided into a plurality of divided areas or divided polygons so that each divided area, or a divided polygon approximating the each divided area, has no outward deflection vertex (described later).

Figure 5:
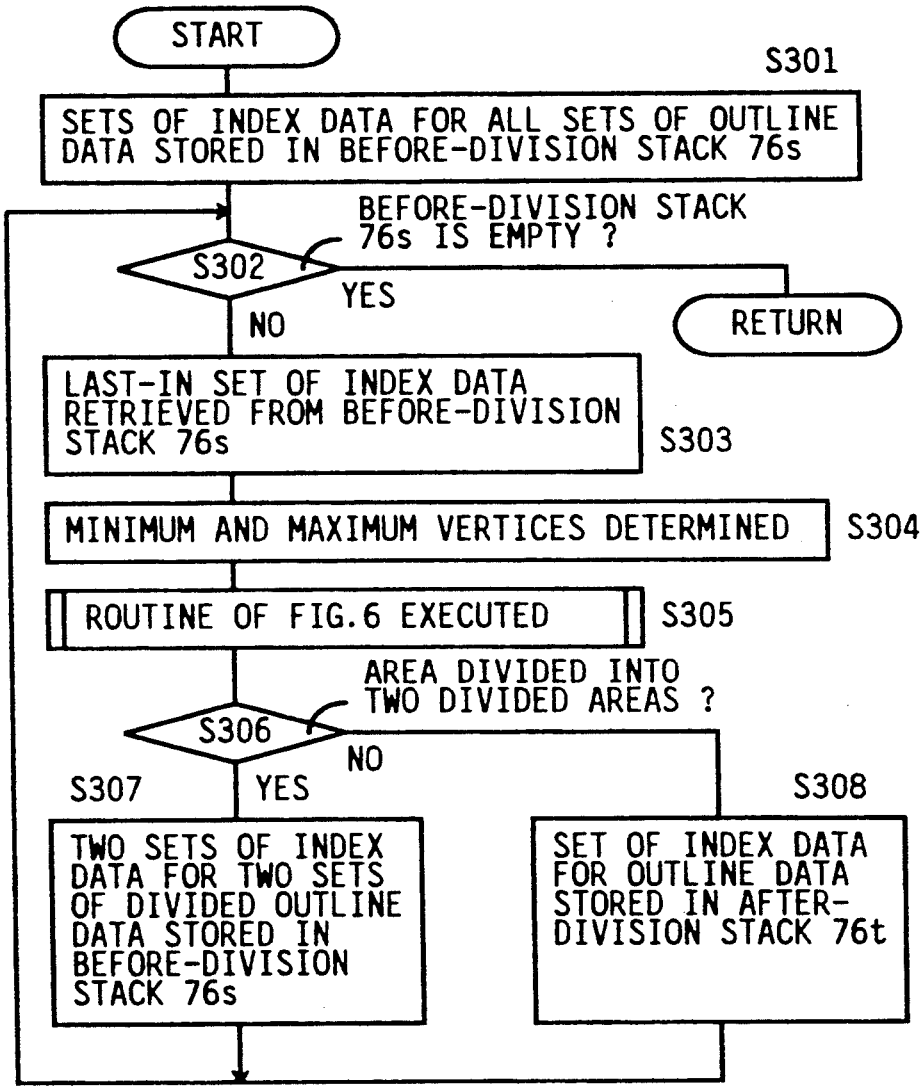
Figure 16:
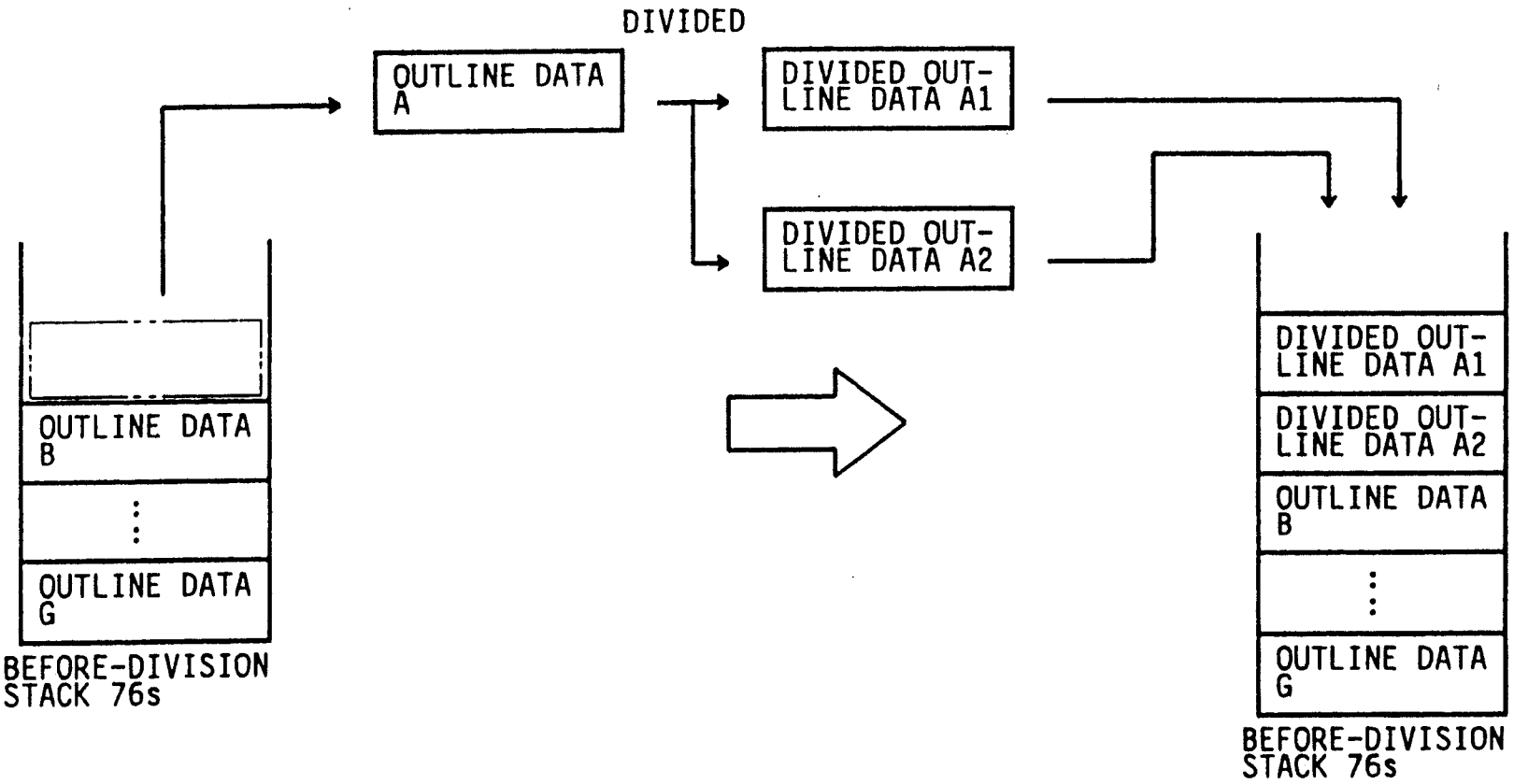
FIGS. 16 through 18 are views for explaining the routine of FIGS. 5 and 6.

Initially, in Step S301 of FIG. 5, a plurality of sets of index data designating the sets of outline data for the areas A-G stored in the outline data area 76c, are prepared and stored in the before-division stack 76s as shown in FIG. 16 in a manner which causes the stored sets of index data to be retrieved in the same order as the embroider order of the areas A-G. Step S301 is followed by Step S302 to judge whether or not the before-division stack 76s is empty, namely, has no index data. Since the situation is immediately after the beginning of the data preparation operation, a negative judgment is provided in Step S302. Therefore, the control goes to Step S303 to retrieve a last-in set of index data from the before-division stack 76s as shown in FIG. 16. A set of outline data designated by the retrieved set of index data is specified for being checked in the following steps (hereinafter, abbreviated to the current outline data).

Step S303 is followed by Step S304 to read the current outline data from the outline data area 76c, and select, based on the outline data, the most distant two vertices of all the vertices of the polygon approximating the area represented by the current outline data (hereinafter, referred to as the current polygon). The most distant two vertices are defined as a minimum and a maximum position of the current polygon. Specifically, one of the most distant two vertices which has the smaller X coordinate value, is defined as the minimum position (hereinafter, referred to as the minimum vertex), while the other vertex that has the greater X coordinate value is defined as the maximum position (hereinafter, referred to as the maximum vertex). The minimum and maximum vertices are indicated at $P_{MIN}$ and $P_{MAX}$ in the figures, respectively. A set of minimum and maximum positions data representative of the minimum and maximum vertices, is prepared and stored in the minimum and maximum positions data area 76r such that the stored set of data is in association with the current polygon, or the current outline data. Step S304 is followed by Step S305. Step S305 is the routine illustrated in FIG. 6 (6A, 6B).

Figure 6A:
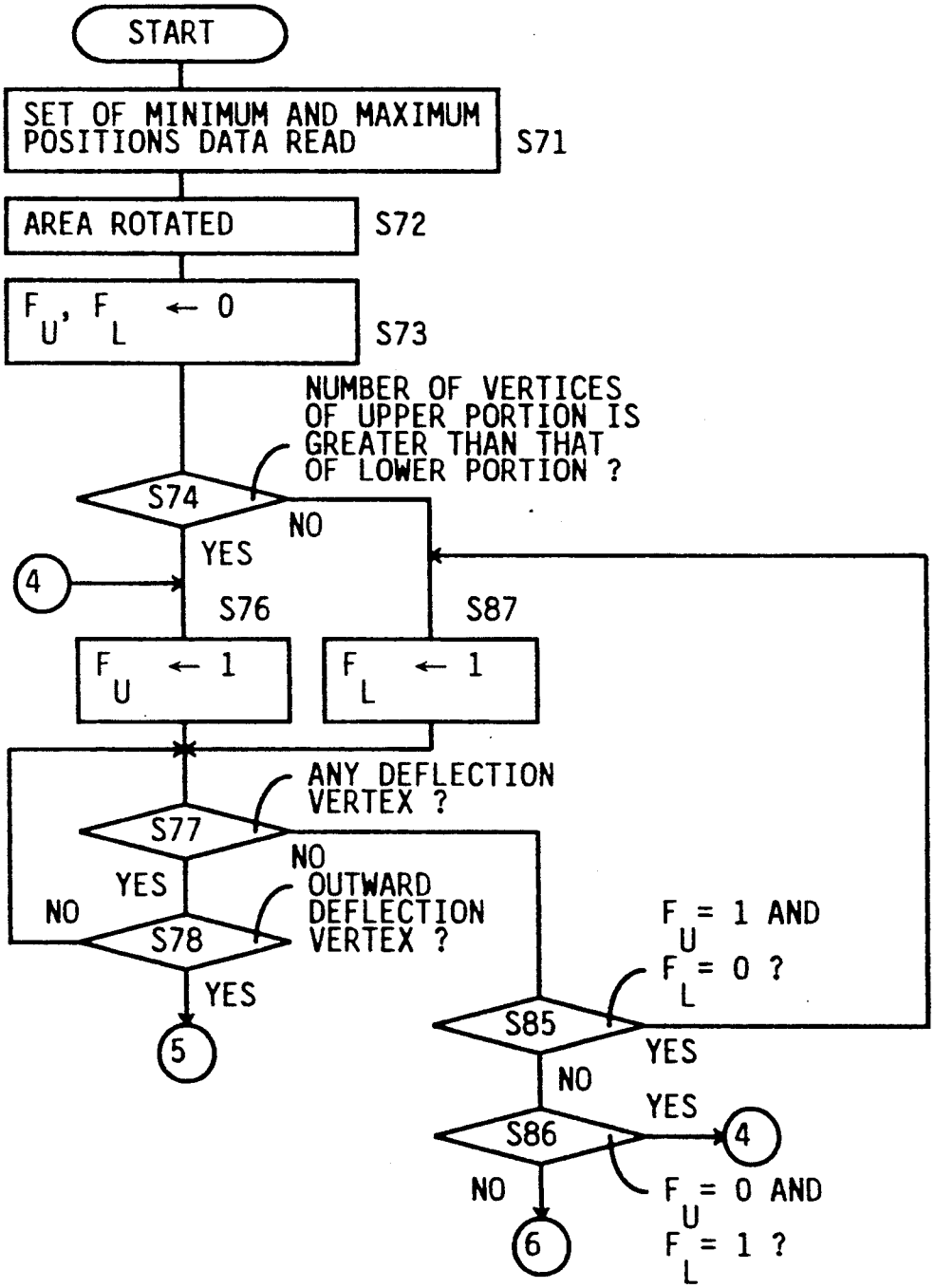
Figure 6B:
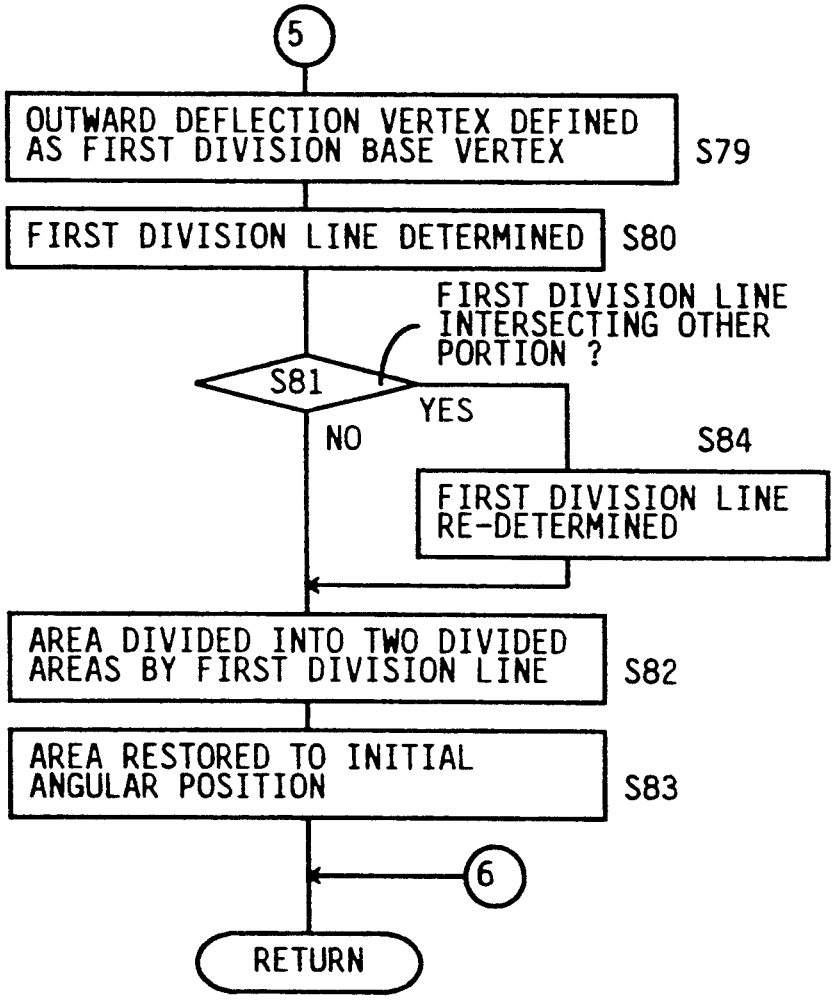

First, in Step S71 of FIG. 6, the set of minimum and maximum positions data associated with the current polygon is read from the minimum and maximum positions data area 76r. Step S71 is followed by Step S72 to define the direction of a straight line passing the minimum and maximum vertices, as a longitudinal direction of the current polygon. In addition, the current outline data is read from the outline data area 76c, and is modified so as to rotate the current polygon in the X-Y coordinate system, so that the longitudinal direction thereof becomes parallel to the X axis of the coordinate system. Furthermore, in Step S72, the outline of the current polygon is divided into two portions at the minimum and maximum vertices and, for each of the two portions, a vertex which has the minimum Y coordinate value of all the vertices belonging to the each portion (except for the minimum and maximum vertices), is determined. One of the two portions of the outline of the polygon the minimum Y coordinate value of which is greater than that of the other, is defined as an upper portion, while the other portion that has the smaller minimum Y coordinate value is defined as a lower portion.

Subsequently, in Step S73, a first flag, $F_U$, for the upper portion of the current polygon and a second flag, $F_L$, for the lower portion thereof, each are reset to zero. When the first flag is in the state of one, it means that the upper portion is being checked for an outward deflection vertex. Similarly, when the second flag is in the state of one, it means that the lower portion is being checked for the same purpose. Step S73 is followed by Step S74 to judge whether or not the number of the vertices of the upper portion is greater than that of the lower portion. If an affirmative judgment is provided in Step S74, the control goes to Step S76 to set the first flag to one, namely, $F_U=1$. On the other hand, if a negative judgment is provided in Step S74, the control goes to Step S87 to set the second flag to one, namely, $F_L=1$.

It is assumed that an affirmative judgment is provided in Step S74 and the control proceeds with Step S77. In Step S77, all the vertices of the upper portion except for the minimum and maximum vertices are checked for a deflection vertex with respect to the X axis, i.e., the longitudinal direction of the current polygon, in the order of location or position of the vertices beginning with a vertex following the minimum vertex and ending with a vertex preceding the maximum vertex. More specifically, it is checked whether or not a sign of a value obtained by subtracting an X coordinate value of a currently checked vertex from that of the following vertex thereof that subsequently is checked, is different from a sign of a value obtained by subtracting an X coordinate value of the preceding vertex of the current vertex that has just been checked from that of the current vertex. If the checking result is affirmative, the current vertex is determined as a deflection vertex. On the other hand, if the checking result is negative, it means that the current vertex is not a deflection vertex.

If the current vertex is determined as a deflection vertex in Step S77, namely, if an affirmative judgment is provided in Step S77, the control goes to Step S78 to judge whether or not the deflection vertex is an outward deflection vertex. More specifically, in the case where the deflection vertex belongs to the upper portion, it is judged whether or not the following vertex of the deflection vertex is located on the left-hand side of the deflection vertex as viewed in the direction of a vector starting at the preceding vertex of the current vertex and ending at the deflection vertex. On the other hand, in the case where the deflection vertex belongs to the lower portion, it is judged whether or not the following vertex of the deflection vertex is located on the right-hand side of the deflection vertex as viewed in the direction of a vector starting at the preceding vertex of the current vertex and ending at the deflection vertex. In either case, if an affirmative judgment is provided, the deflection vertex is determined as an outward deflection vertex. On the other hand, if a negative judgment is provided, it means that the deflection vertex is an inward deflection vertex.

If an outward deflection vertex is found in the checking of the upper portion, namely, if an affirmative judgment is provided in Step S78, the control goes to Step S79 to define the outward deflection vertex as a first division base position (vertex). Step S79 is followed by Step S80 to determine a cooperative vertex which cooperates with the first division base vertex to provide a first division line. More specifically, first, the X-Y coordinate system is parallel translated so that the origin of the coordinate system coincides with the first division base vertex, and then are found all the vertices that are located in one of the four quadrants of the translated coordinate system which one quadrant contains a first half straight line starting at the origin (i.e., first division base vertex) and extending in the direction of the vector starting at the preceding vertex of the first division base vertex (i.e., origin) and ending at the origin, or one of the four quadrants which contains a second half straight line starting at the origin and extending in the direction of a vector starting at the following vertex of the first division base vertex (i.e., origin) and ending at the origin, and simultaneously which vertices belong to the upper portion. In the case where a single vertex is found, the single vertex is defined as the cooperative vertex. In the case where a plurality of vertices are found, the nearest vertex to the origin is defined as the cooperative vertex. In the meantime, in the case where the first and second half straight lines are contained in a single quadrant and no appropriate vertex is found in the common quadrant, the same operation as described above is effected for a quadrant which is opposite to the common quadrant with respect to the X axis of the translated coordinate system.

A straight segment connecting the first division base vertex and the cooperative vertex serves as the first division line. Step S80 is followed by Step S81 to judge whether or not the first division line determined in Step S80 intersects the lower portion. If the first division line does not intersect the lower portion, a negative judgment is provided in Step S81, and the control goes to Step S82 to divide the current polygon into two divided polygons which shares the first division line with each other. Consequently, the area approximated by the current polygon is divided into two divided areas each of which is approximated by a corresponding one of the two divided polygons. In addition, in Step S82, two sets of divided outline data each representative of a corresponding one of the two divided areas are prepared based on the current outline data and the first division line. Furthermore, a third flag, i.e., first division flag is set to one. Step S82 is followed by Step S83 to modify the two sets of divided outline data so that the two divided polygons are rotated in the X-Y coordinate system and is restored to the initial angular position of the current polygon relative to the X axis. In addition, in Step S83, the two sets of divided outline data are stored in the divided outline data area 76*d*, and a set of first division data indicative of a correspondence between the current outline data and the two sets of divided outline data, is prepared and stored in the division data area 76*f*. Thus, one cycle of the routine of FIG. 6 is ended.

On the other hand, in the case where the first division line determined in Step S80 intersects the lower portion, an affirmative judgment is provided in Step S81. Therefore, the control goes to Step S84 to determine all the intersections of the first division line and the lower portion, select a side to which the nearest intersection to the origin belongs, and define one of the two vertices located at opposite ends of the selected side which one vertex is the nearer to the origin, as a new cooperative vertex which cooperates with the origin (i.e., first division base vertex) to define a new first division line.

Heretofore, the case where the deflection vertex found in Step S77 for the first time is an outward deflection vertex, has been described. However, if the deflection vertex is an inward deflection vertex, that is, if a negative judgment is provided in Step S78, the control goes back to Step S77 to check the upper portion for another deflection vertex. This checking is effected for the remainder vertices of the upper portion which follow the inward deflection vertex. Steps S77 and S78 are repeated for each of those vertices of the upper portion for any outward deflection vertex.

If the upper portion has no outward deflection vertex and a negative judgment is provided in Step S77, the control goes to Step S85 to judge whether or not the first flag $F_u=1$ and simultaneously the second flag $F_L=0$. That is, it is identified whether or not the upper portion has been checked and simultaneously the lower portion has not been checked. Since, in this situation, an affirmative judgment is provided in Step S85, and the control goes to Step S87 and the following steps for effecting the same operation as described above, for checking the lower portion.

Specifically, in Step S87, the second flag $F_U$ is set to one, and then the control goes to Step S77 to check the lower portion for an deflection vertex. If an affirmative judgment is provided in Step S77, the control goes to Step S78 and the following steps as described above. On the other hand, if the lower portion has no outward deflection vertex and a negative judgment is provided in Step S77, the control goes to Step S85 to judge whether or not the first flag $F_U=1$ and simultaneously the second flag $F_L=0$. Since, in this situation, the second flag $F_L$ is in the state of $F_L=1$, a negative judgment is provided in Step S85. Therefore, the control goes to Step S86 to judge whether or not the first flag $F_U=0$ and simultaneously the second flag $F_L=1$. That is, it is identified whether or not the upper portion has not been checked and simultaneously the lower polygon portion has been checked. Since, in this situation, the first and second flags $F_U$, $F_L$ are in the state of $F_U=1$ and $F_L=1$, respectively, a negative judgment is provided in Step S86. Thus, one cycle of the routine of FIG. 6 is ended.

In the meantime, in the case where the number of the vertices of the upper portion is not greater than that of the lower portion, a negative judgment is provided in Step S74, and therefore the control goes directly to Step S87 and the following steps. If a negative judgment is provided in Step S77, a negative judgment is provided in Step S85 and an affirmative judgment is provided in Step S86. Hence, the control goes to Step S76 and the following steps, for checking the upper portion for any outward deflection vertex. Thus, one cycle of the routine of FIG. 6 is ended.

Figure 17:
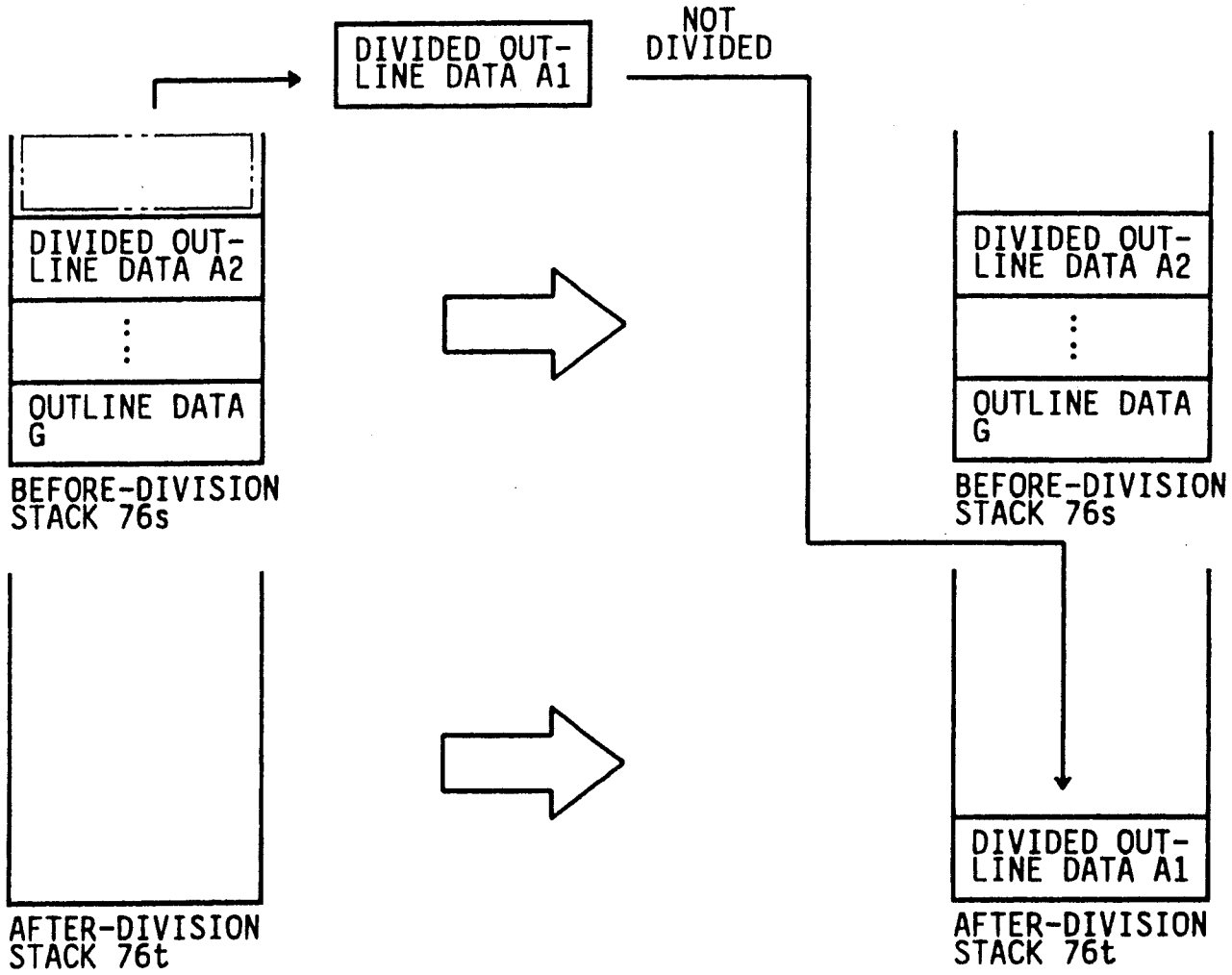

The routine of FIG. 6, that is, Step S305 of FIG. 5 is followed by Step S306 to judge whether or not the area approximated by the current polygon has been divided into two divided areas which are approximated by the corresponding two divided polygons. If the current polygon is divided into two divided polygons in Step S82 of FIG. 6, the third flag or first division flag is set to one as previously described. Therefore, the judgment in Step S306 is made by judging whether or not the third flag is in the state of one. If an affirmative judgment is provided in Step S306, the control goes to Step S307 to prepare and store two sets of index data designating the two sets of divided outline data prepared in Step S82 of FIG. 6, in the before-division stack **76*s*, as shown in FIG. 16. On the other hand, if a negative judgment is provided in Step S306, the control goes to Step S308 to store the set of index data designating the current outline data, in the after-division stack 76*t*, as shown in FIG. 17. Steps S302 through S308 are repeated until the before-division stack 76*s* becomes empty, namely, has no index data and an affirmative judgment is provided in Step S302**.

A divided area resulting from an execution of the routine of FIG. 6 may further be divided by subsequent one or more executions of the routine. It should therefore be understood that an area (or set of outline data therefor) to be processed by the routine of FIG. 6 may be a divided area (or set of divided outline data therefor) prepared by an execution of the routine. This applies to the routine of FIG. 8 (described later).

Figure 18:
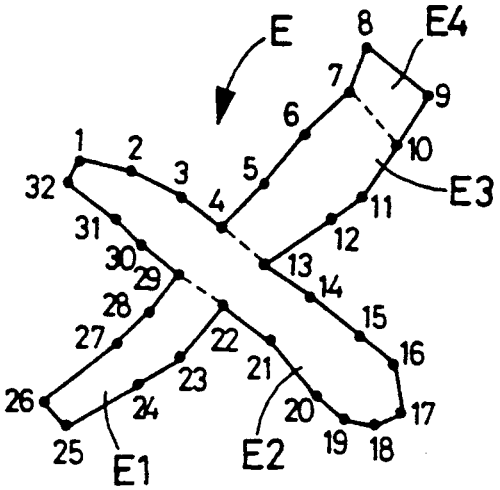

If the routine of FIG. 6 is executed for the set of outline data for the area E, the area is divided into four divided areas, $E_1$, $E_2$, $E_3$, $E_4$, as shown in FIG. 18.

Figure 7:
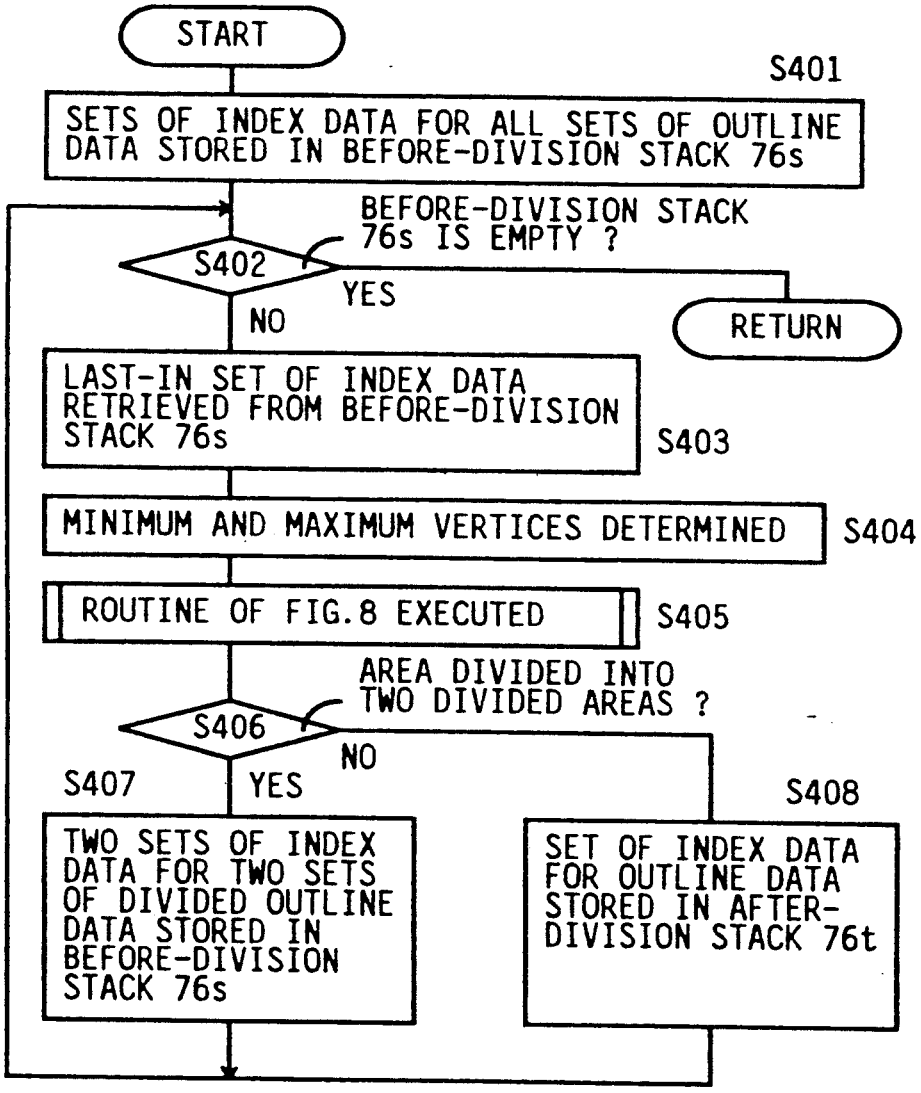

Subsequently, the control goes to Step S17 of FIG. 4. Step S17 is the routine for the second division of an area, or a divided area produced by execution of the routine FIG. 5 (hereinafter, both referred to as the area). The routine is illustrated in FIG. 7. The second division is to divide an area into divided areas so that all straight segments obtained by connecting between each of the minimum and maximum vertices of each of the divided areas, and each of the remainder vertices of the each divided area, are contained in the area, namely inside the outline of the area. Since the second division routine is generally the same as the first division routine of FIG. 5, description of the steps common to the two routines is omitted from the following description.

Initially, in Step S401 of FIG. 7, all sets of index data stored in the after-division stack **76*t* are transferred to, and stored in, the before-division stack 76*s*. Steps S402 through S408** are executed for each of the sets of outline data and/or divided outline data designated by the stored sets of index data (hereinafter, both referred to as the outline data).

Figure 8A:
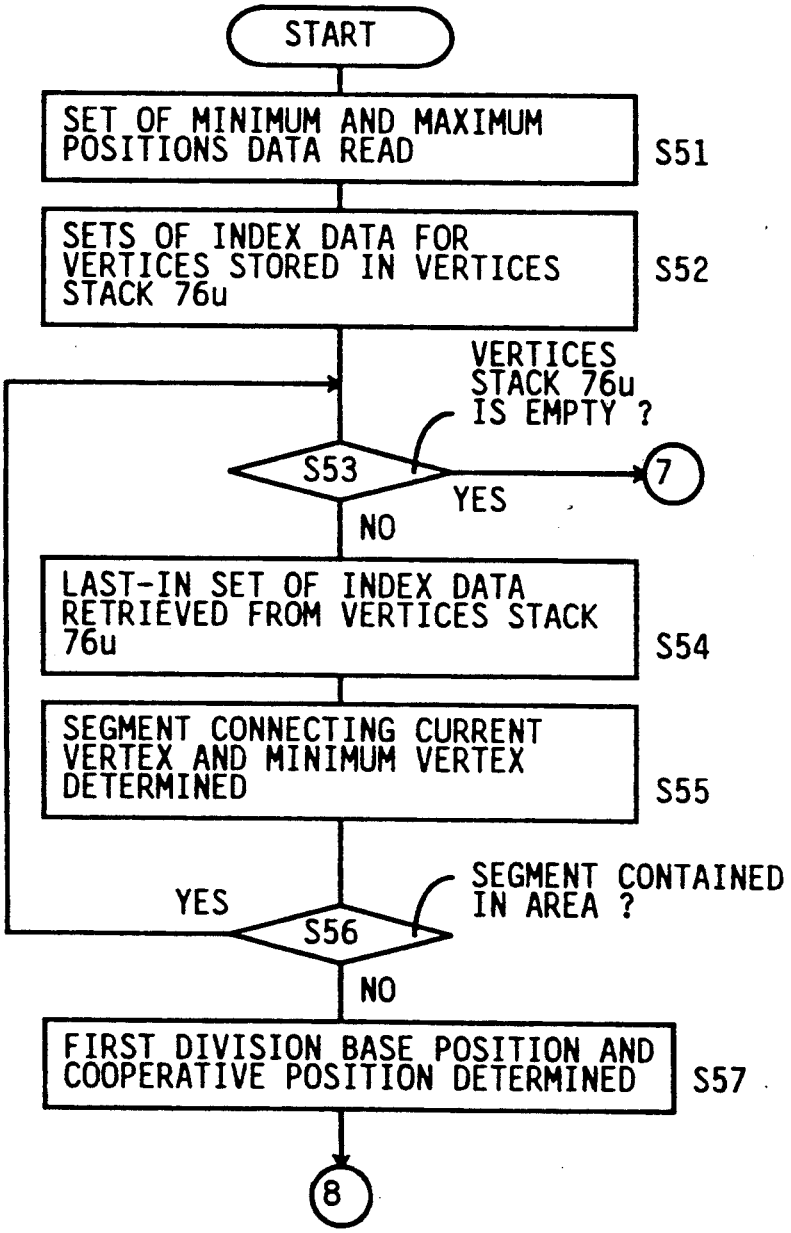
Figure 8B:
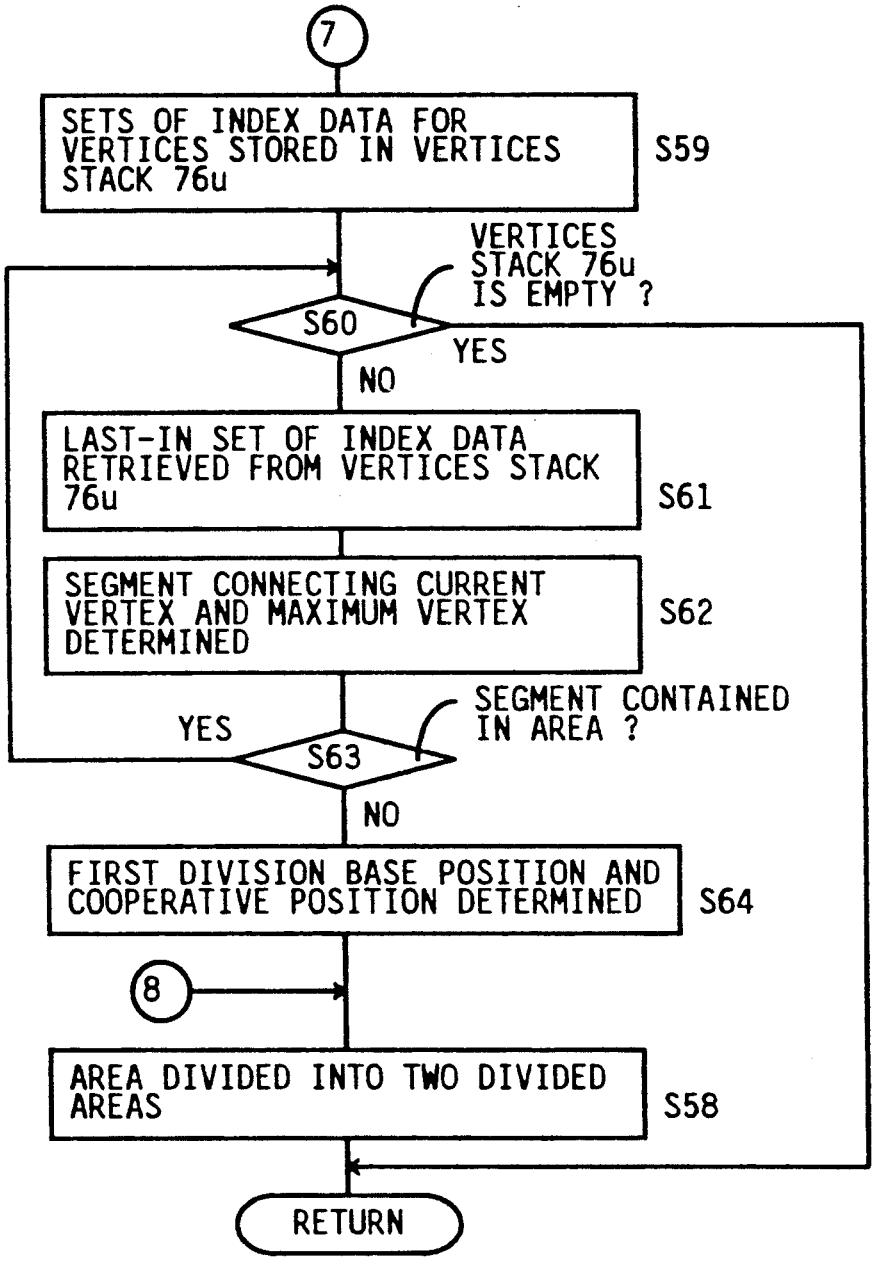

Step S405 is the routine illustrated in FIG. 8 (8A, 8B). First, in Step S51, a set of minimum and maximum positions data for a polygon approximating an area represented by a set of outline data designated by a last-in set of index data stored in the before-division stack **76*s* (hereinafter, referred to as the current polygon), is read from the maximum and minimum positions data area 76*r*. In addition, the direction of a straight line passing the minimum and maximum positions (vertices) represented by the read set of data, is defined as a longitudinal direction of the current polygon. Further, the set of outline data designated by the last-in set of index data (hereinafter, referred to as the current outline data), is read from the outline data area 76*c* or divided outline data area 76*d*, and is modified so as to rotate the current polygon so that the longitudinal direction of the polygon becomes parallel to the X axis of the X-Y coordinate system defined for the sewing machine 8. Furthermore, in Step S51, the upper and lower portions of the current polygon are identified in the same manner as used in Step S72 of FIG. 6**.

Subsequently, in Step S52, sets of index data designating all the vertices of the upper and lower portions, except for the minimum and maximum vertices, are prepared and stored in the vertices stack **76*u*, such that when the stored sets of index data are retrieved in succession in the last-in first-out manner, first the sets of index data for the vertices of the upper portion except for the minimum and maximum vertices are retrieved beginning with the set of index data for a vertex spaced by two vertices from the minimum vertex and ending with the set of index data for the maximum vertex, and then the sets of index data for the vertices of the lower portion except for the minimum and maximum vertices are retrieved beginning with the set of index data for a vertex spaced by two vertices from the minimum vertex and ending with the set of index data for the maximum vertex. Step S52 is followed by Step S53 to judge whether or not the vertices stack 76*u* is empty. In this situation, a negative judgment is provided in Step S53, and the control goes to Step S54 to retrieve the last-in set of index data from the vertices stack 76*u***. The vertex designated by the retrieved set of index data (hereinafter, referred to as the current vertex) is checked in the following steps.

In Step S55, a straight segment connecting the current vertex and the minimum vertex is defined. Step S55 is followed by Step S56 to judge whether or not the segment is contained inside the current polygon. More specifically, in the case where the current vertex is a vertex belonging to the upper portion, it is judged whether or not the preceding vertex of the current vertex, located on the minimum-vertex side thereof, is positioned above the segment, in the X-Y coordinate system. On the other hand, in the case where the current vertex is a vertex belonging to the lower portion, it is judged whether or not the preceding vertex of the current vertex is positioned below the segment. If an affirmative judgment is provided in Step S56, the control goes back to Step S53 to check the following vertex of the current vertex located on the maximum-vertex side thereof.

On the other hand, if a negative judgment is provided in Step S56, the control goes to Step S57 to define the preceding vertex of the current vertex as a first division base position (vertex), and determine a cooperative position (vertex) which cooperates with the first division base vertex to define a first division line for dividing the current polygon, or area approximated by the polygon, into two divided polygons, or two divided areas approximated by the corresponding divided polygons. More specifically, all the vertices of the current polygon, except for the first division base vertex and the preceding and following vertices of the base vertex, that cooperates with the first division base vertex to define straight segments contained in the current polygon, are determined, and the nearest vertex to the first division base vertex of the vertices determined is defined as the cooperative vertex of the base vertex.

Subsequently, in Step S58, the area approximated by the current polygon is divided by the first division line determined in Step S57 into two divided areas, and two sets of divided outline data each of which is representative of the outline of a corresponding one of the two divided areas, are prepared based on the current outline data and the first division line. The two sets of divided outline data are modified so as to be free from the effect of the rotation of the area before being divided, and are stored in the divided outline data area 76*c*. In addition, in Step S58, a set of second division data indicative of a correspondence between the current outline data and the two sets of divided outline data, is prepared and stored in the division data area 76*f*. Further, a fourth flag, i.e., second division flag is set to one. Thus, one cycle of the routine of FIG. 8 is ended.

Heretofore, the case where at least one of the segments defined in Step S55 is not contained in the current polygon, has been described. However, in the case where all the segments are contained in the polygon, an affirmative judgment is provided in Step S53. Therefore, the control goes to Step S59 to clear the vertices stack 76*u* and store sets of index data for the vertices of the current polygon once more in the vertices stack 76*u*. In contrast to Step S52, however, the sets of index data are stored such that when the stored sets of index data are retrieved in succession in the last-in first-out manner, first the sets of index data for the vertices of the upper portion except for the minimum and maximum vertices are retrieved beginning with the set of index data for a vertex spaced by two vertices from the maximum vertex and ending with the set of index data for the minimum vertex, and then the sets of index data for the vertices of the lower portion except for the minimum and maximum vertices are retrieved beginning with the set of index data for a vertex spaced by two vertices from the maximum vertex and ending with the set of index data for the minimum vertex.

Subsequently, in Step S60, it is judged whether or not the vertices stack 76u is empty. In this situation, a negative judgment is provided in Step S60, and the control goes to Step S61 to retrieve a last-in set of index data from the vertices stack 76u. The vertex designated by the retrieved set of index data is checked as the current vertex in the following steps.

Step S61 is followed by Step S62 to define a straight segment connecting the current vertex and the maximum vertex. Step S62 is followed by Step S63 to judge whether or not the segment is contained inside the current polygon. More specifically, in the case where the current vertex is a vertex belonging to the upper portion, it is judged whether or not the preceding vertex of the current vertex, located on the maximum-vertex side thereof, is positioned above the segment. On the other hand, in the case where the current vertex is a vertex belonging to the lower portion, it is judged whether or not the preceding vertex of the current vertex is positioned below the segment. If an affirmative judgment is provided in Step S63, the control goes back to Step S60 to check the following vertex of the current vertex located on the minimum-vertex side thereof.

However, if a negative judgment is provided in Step S63, the control goes to Step S64 to define the preceding vertex of the current vertex as a first division base position (vertex), and determine a cooperative position (vertex) which cooperates with the first division base vertex to define a first division line for dividing the current polygon, or area approximated by the polygon, into two divided polygons or two divided areas approximated by the corresponding divided polygons, as in Step S57. Subsequently, in Step S58, the area approximated by the current polygon is divided by the first division line into two divided areas.

In the case where all the segments defined in Steps S55 and S62 are contained in the current polygon, namely, no segment is located outside the polygon, an affirmative judgment is provided in both Steps S56 and S63. This means that the are approximated by the current polygon no longer needs division. Thus, one cycle of the routine of FIG. 8 is ended.

The routine of FIG. 8, i.e., Step S405 of FIG. 7 is followed by Step S406 to judge whether or not the area approximated by the current polygon has been divided into two divided areas which are approximated by the corresponding two divided polygons. If the current polygon is divided into two divided polygons in Step S58 of FIG. 8, the fourth flag or second division flag is set to one as previously described. Therefore, the judgment in Step S406 is made by judging whether or not the fourth flag is in the state of one. If an affirmative judgment is provided in Step S406, the control goes to Step S407 to prepare and store two sets of index data designating the two sets of divided outline data prepared in Step S58 of FIG. 8, in the before-division stack 76*s*, as shown in FIG. 16. On the other hand, if a negative judgment is provided in Step S406, the control goes to Step S408 to store the set of index data designating the current outline data, in the after-division stack 76*t*, as shown in FIG. 17. Steps S402 through S408 are repeated until the before-division stack 76*s* becomes empty, namely, has no index data and an affirmative judgment is provided in Step S402. In this way, one cycle of the routine of FIG. 7 is ended.

Figure 20:
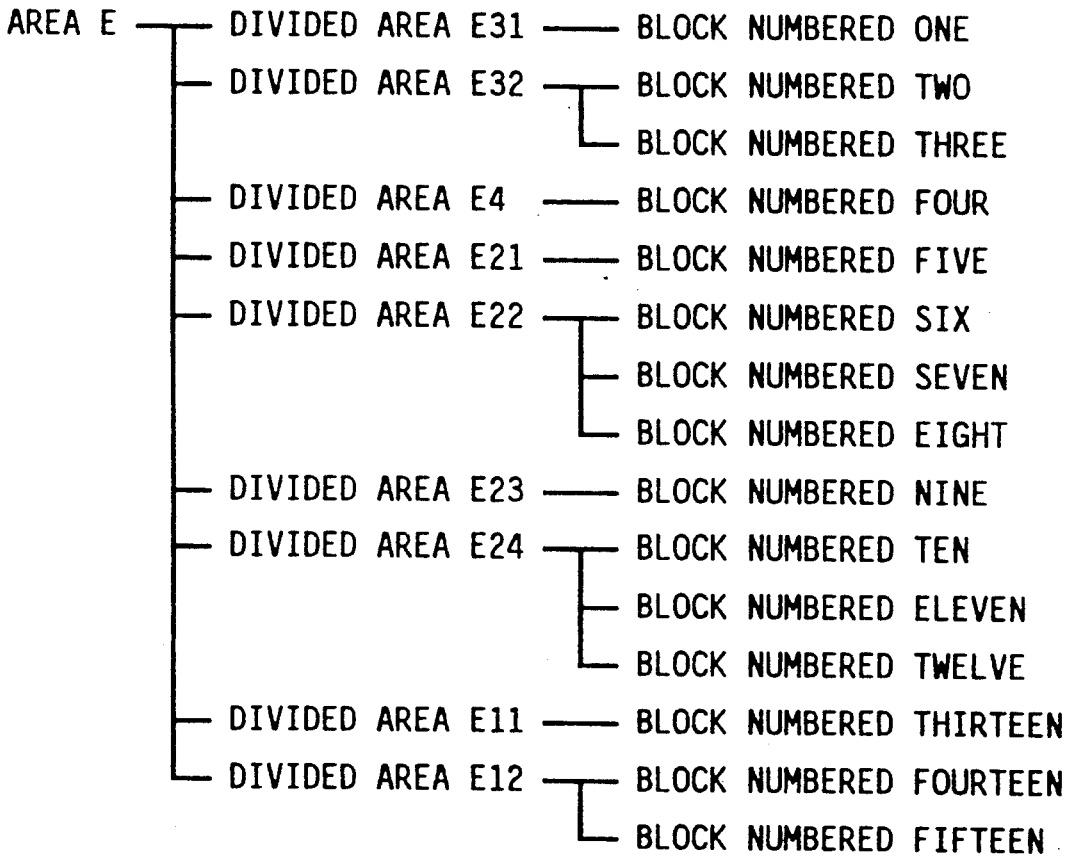

If the routine of FIG. 7 is executed for each of the four divided areas $E_1$ through $E_4$ of the area E of FIG. 18, the divided area $E_1$ is divided into two divided areas $E_{11}$ and $E_{12}$, the divided area $E_2$ is divided into four divided areas $E_{21}$, $E_{22}$, $E_{23}$, and $E_{24}$, and the divided area $E_3$ is divided into two divided areas $E_{31}$ and $E_{32}$. However, the divided area $E_4$ no longer is divided. The set of first division data and sets of second division data for the area E indicative of a correspondence between the area E and the divided areas $E_{11}$, $E_{12}$, $E_{21}$, $E_{22}$, $E_{23}$, $E_{24}$, $E_{31}$, $E_{32}$, $E_4$, is indicated in FIG. 20.

Figure 21:
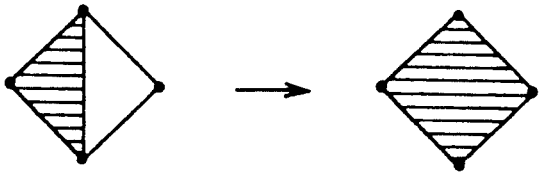
FIGS. 21 and 22 are views for explaining the routine of FIG. 4.
Figure 22:
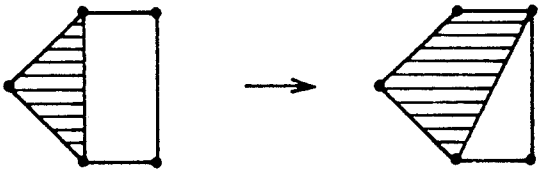
Figure 23:
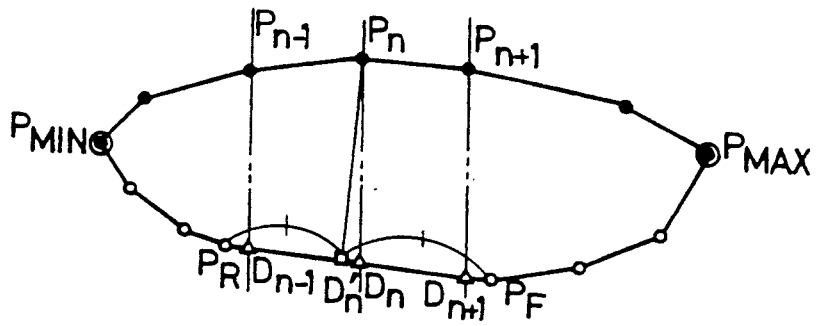
Figure 24:
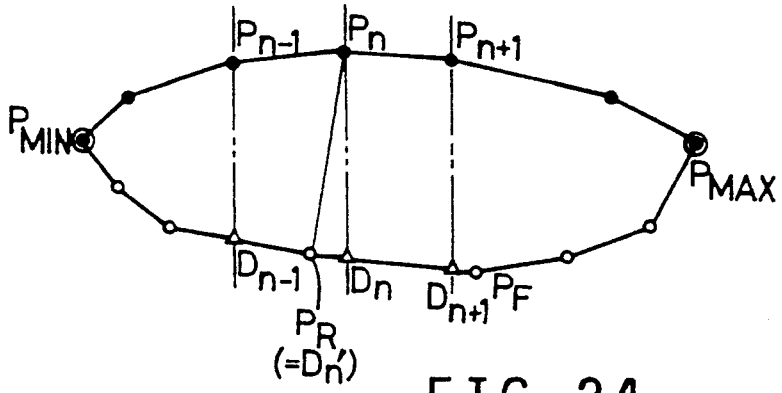
Figure 25:
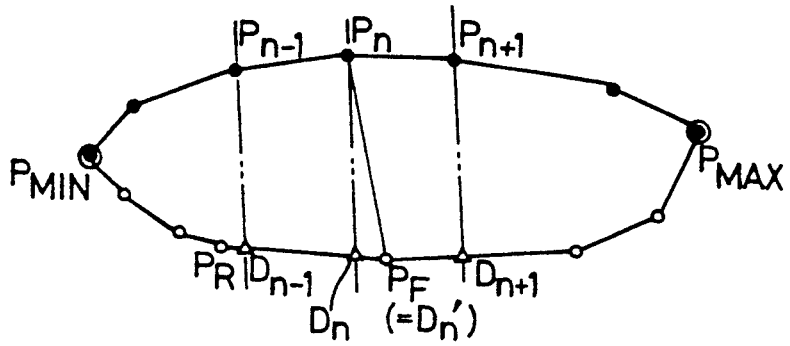
Figure 26:
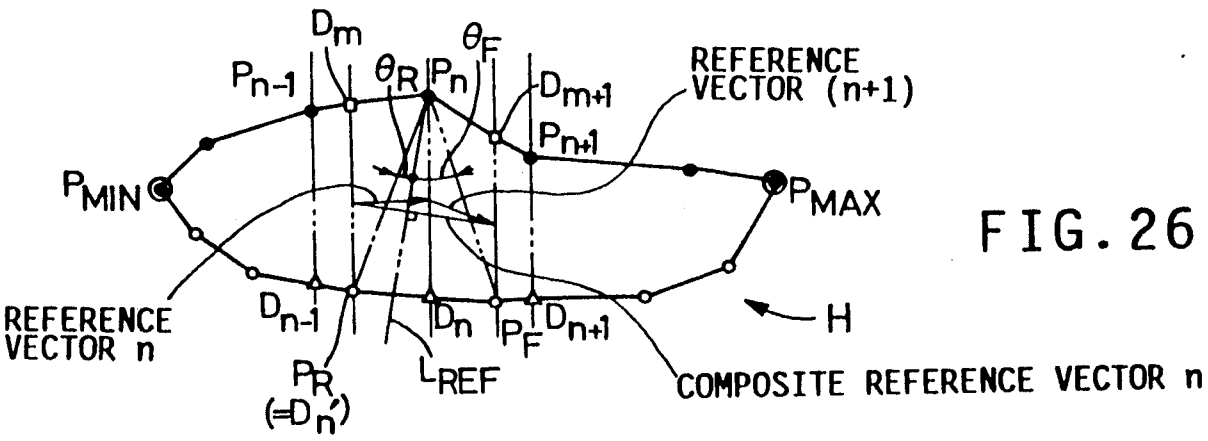
Figure 27:
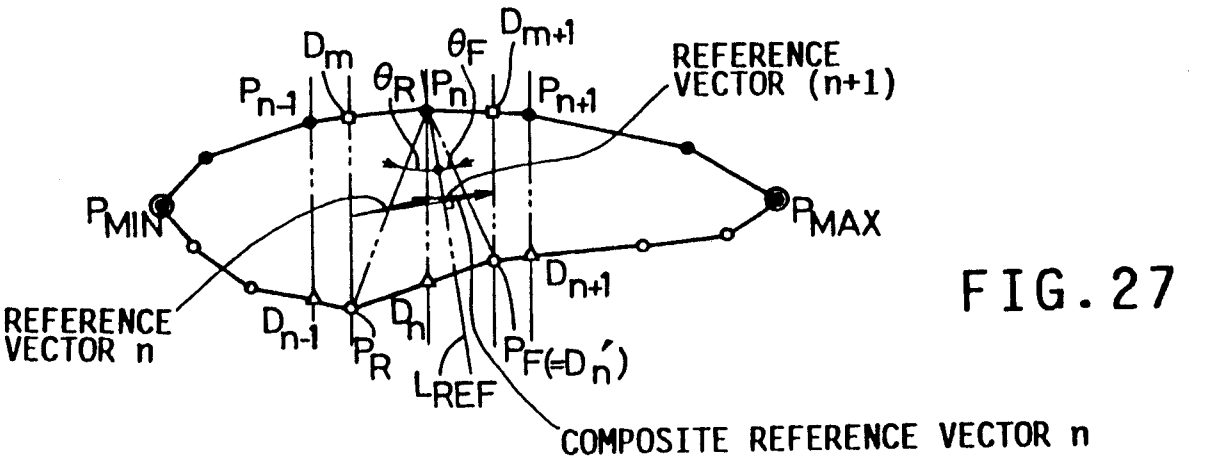
Figure 28:
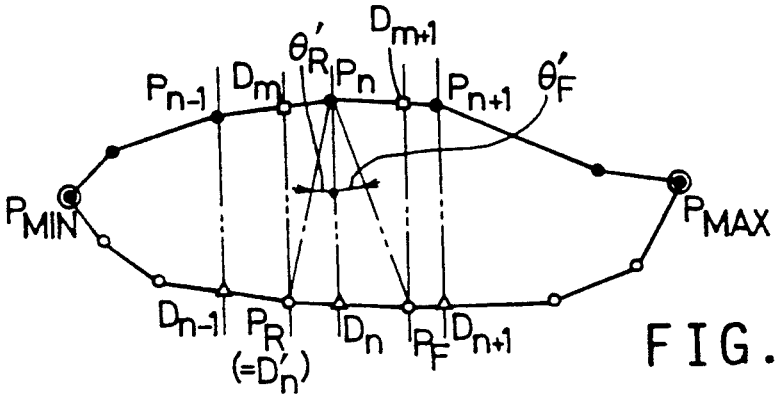
Figure 29:
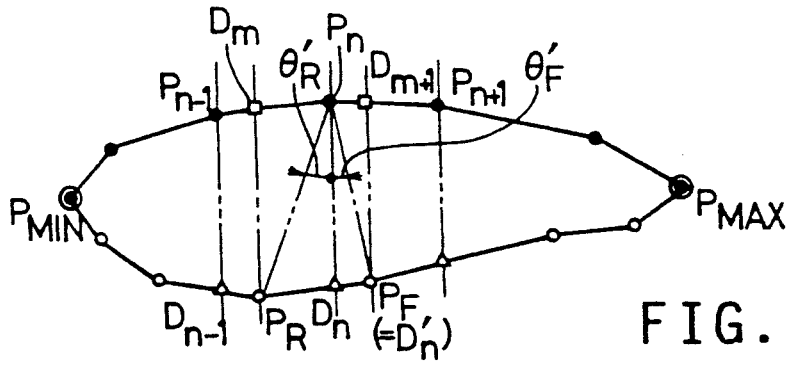

The routine of FIG. 8, i.e., Step S17 of FIG. 4 is followed by Step S21 to set the content or count, n, of a first counter indicative of the numbers assigned to the areas, to one. Regarding the areas A–G, numbers are assigned in the alphabetic order, namely, in the embroider order of the areas A–G. Step S21 is followed by Step S23. In the case where the divided areas of an area numbered one include one or more triangle-like divided areas each approximated by a triangle as one of the divided polygons of a polygon approximating the area, each of the one or more triangle-like divided areas is modified to a quadrangle-like area approximated by a quadrangle. For example, if the area includes another triangle-like divided area adjacent to the triangle-like divided area in question, the first division line separating the two triangle-like divided areas from each other is eliminated, so that the triangle-like divided area in question is modified to a quadrangle-like area, as shown in FIG. 21. In addition, if the area includes a non-triangle-like divided area approximated by a polygon other than a triangle, such as a quadrangle, as an adjacent divided area of the triangle-like divided area, the triangle-like divided area is modified to a quadrangle-like area by replacing the first division line separating the triangle-like divided area and the non-triangle-like divided area from each other, by a new first division line, as shown in FIG. 22. In the latter case, there may be produced a triangle-like area as a result of the modification of the triangle-like divided area. In such a case, the new triangle-like area is modified to a quadrangle-like area by changing the first division line separating the new triangle-like area and an adjacent divided area thereof different from the modified quadrangle-like area from each other, to a new first division line.

Figure 19:
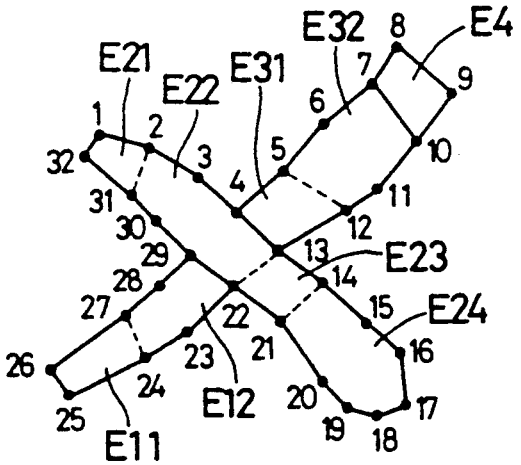
FIGS. 19 and 20 are views for explaining the routine of FIGS. 7 and 8.

Since the area E of FIG. 19 has no triangle-like divided areas, the outline of each of the divided areas of the area E is not changed by the execution of Step S23.

Step S23 is followed by Step S25 to store the number, L, of the divided areas belonging to an area numbered n, in an appropriate memory area of the RAM 76. Subsequently, in Step S27, the content or count, l, of a second counter indicative of the numbers assigned to the divided areas, is set to one. Step S27 is followed by Step S29. Step S29 is the routine illustrated in FIG. 9 (9A, 9B, 9C). This routine is to divide a divided area numbered l into blocks.

Initially, in Step S501 of FIG. 9, a set of minimum and maximum positions data representative of the minimum and maximum vertices of the divided polygon approximating the divided area numbered (hereinafter, referred to as the current polygon), is read from the minimum and maximum positions data area 76*r*. Step S501 is followed by Step S502 to define the direction of a straight line passing the minimum and maximum vertices, as a longitudinal direction of the current polygon. Subsequently, in Step S503, a set of divided outline data representative of the divided area numbered l (hereinafter, referred to as the current outline data) is read from the divided outline data area 76*d*, and is modified so as to rotate the current polygon so that the longitudinal direction thereof becomes parallel to the X axis of the X-Y coordinate system.

Step S503 is followed by Step S504 to compare the number of vertices of the upper portion of the current polygon with that of the lower portion thereof, and select one of the two portions which has the smaller number of vertices than the other portion. In the case where the number of vertices of the upper portion are equal to that of the lower portion, the upper portion is selected. In addition, in Step S504, are defined straight first aid lines which are perpendicular to the longitudinal direction of the current polygon, namely, parallel to the Y axis of the X-Y coordinate system and each of which passes a corresponding one of the vertices of the selected one portion of the polygon An intersection of each of the first aid lines, and one of the upper and lower portions which one portion is opposed to the other portion to which the vertex associated with the each first aid line belongs, is defined as a candidate for a second division base position (vertex) which cooperates with the associated vertex to define a second division line. Sets of aid line data each representative of a corresponding one of the vertices of the selected portion of the current polygon, and a second division base vertex candidate (hereinafter, abbreviated to the candidate) associated with the corresponding one vertex, are stored in the aid line data area 76*a* in association with the first aid line passing the corresponding one vertex and the candidate therefor. In this connection, it is assumed that a first aid line numbered zero passes the minimum vertex and a first aid line number N passes the maximum vertex, as indicated in FIG. 30, which shows an example of aid line data. The minimum vertex serves as the vertex and candidate associated with the first aid line numbered zero, while the maximum vertex serves as the vertex and candidate associated with the first aid line numbered N.

FIGS. 23 through 29 show examples each of which has an upper portion the number of vertices of which is smaller than that of a lower portion thereof. In the figures, symbol $P_n$ denotes a vertex numbered n associated with a first aid line numbered n, and symbol $D_n$ denotes a candidate numbered n for the vertex $P_n$.

Step S504 is followed by Step S505 to store the number, N, obtained by subtracting one from the number of first aid lines defined for the current polygon, in an appropriate memory area of the RAM 76. Subsequently, in Step S506, the count, n of a third counter indicative of the numbers assigned to the first aid lines, is set to one. Step S506 is followed by Step S507 to judge whether or not the number n is not less than the number N. In this situation, a negative judgment is provided in Step S507, and the control goes to Step S508 to determine, for the vertex $P_n$, a vertex whose X coordinate value is the greatest of the X coordinate values of the vertices of one of the upper and lower portions of the current polygon which one portion is different from the other portion to which the vertex $P_n$ belongs, and simultaneously which X coordinate values are smaller than the X coordinate value of the candidate $D_n$ associated with the vertex $P_n$. The vertex determined is defined as a rear-side adjacent vertex for the vertex $P_n$. The rear-side adjacent vertex is indicated at $P_R$ in the figures. The determination of the rear-side adjacent vertex $P_R$ is effected based on the current outline data. Step S508 is followed by Step S509 to determine, for the vertex $P_n$, a vertex whose X coordinate value is the smallest of the X coordinate values of the vertices of the above indicated one portion, and simultaneously which X coordinate values are greater than the X coordinate value of the candidate $D_n$. The vertex determined is defined as a front-side adjacent vertex for the vertex $P_n$, indicated at $P_F$ in the figures. The determination of the front-side adjacent vertex $P_F$ similarly is effected based on the current outline data. The rear-side adjacent vertex $P_R$ is the nearest to the candidate $D_n$ of the vertices located on the minimum-vertex side of the candidate Dn, while the front-side adjacent vertex $P_F$ is the nearest to the candidate $D_n$ of the vertices located on the maximum-vertex side of the candidate $D_n$.

Subsequently, in Step S510, it is judged whether or not the X coordinate value of the rear-side adjacent vertex is not greater than that of the candidate (n−1) and simultaneously the X coordinate value of the front-side adjacent vertex is not smaller than that of the candidate (n +1). That is, it is identified whether or not the rear-side adjacent vertex is not located between the candidates n and (n−1) and simultaneously the front-side adjacent vertex is not located between the candidates n and (n+1). Regarding the example of FIG. 23, an affirmative judgment is provided in Step S510, and the control goes to Step S511 to determine the middle point of a straight segment connecting the rear- and front-side adjacent vertices, and define the middle point as the proper second division base position for the vertex $P_n$, indicated at $D'_n$ in the figures. On the other hand, if a negative judgment is provided in Step S510, the control goes to Step S512 to judge whether or not the X coordinate value of the rear-side adjacent vertex is greater than that of the candidate (n−1) and simultaneously the X coordinate value of the front-side adjacent vertex is not smaller than that of the candidate (n+1). That is, it is identified whether or not the rear-side adjacent vertex is located between the candidates n and (n−1) and simultaneously the front-side adjacent vertex is not located between the candidates n and (n+1). Regarding the example of FIG. 24, an affirmative judgment is provided in Step S512, and the control goes to Step S513 to define the rear-side adjacent vertex as the proper second division base position. However, if a negative judgment is provided in Step S512, the control goes to Step S514 to judge whether or not the X coordinate value of the rear-side adjacent vertex is not greater than that of the candidate (n−1) and simultaneously the X coordinate value of the front-side adjacent vertex is smaller than that of the candidate (n+1). That is, it is identified whether or not the rear-side adjacent vertex is not located between the candidates n and (n−1) and simultaneously the front-side adjacent vertex is located between the candidates n and (n+1). Regarding the example of FIG. 25, an affirmative judgment is provided in Step S514, and the control goes to Step S515 to define the front-side adjacent vertex as the proper second division base position.

If the rear-side adjacent vertex is located between the candidates n and (n−1) and simultaneously the front-side adjacent vertex is located between the candidates n and (n+1), namely, if a negative judgment is provided in each of Steps S510, S512, and S514, the control goes to Step S516 to define two straight second aid lines which are parallel to the Y axis and pass the rear- and front-side adjacent vertices, respectively, and determine an intersection of each of the second aid lines and the above indicated other portion of the current polygon to which portion the vertex $P_n$ belongs. The two intersections are indicated at $D_m$, $D_{m+1}$ in the figures. Consequently, two blocks are produced on both sides of a first aid line n, respectively. These two blocks are equivalent to two blocks n, (n+1) which are produced on both sides of a straight third aid line n by defining, for each of the vertices of both the upper and lower portions of the current polygon, a third aid line which passes the each vertex and is parallel to the Y axis. Each of the blocks is enveloped by four side two of which are defined by corresponding two of the third aid lines and the other two of which are defined by corresponding two of the straight segments produced as a result of the division by the third aid lines of the outline or sides of the current polygon. The two third aid lines for the each block are opposed to each other in a direction parallel to the X axis or the longitudinal direction of the current polygon, while the two side segments for the each block are opposed to each other in a direction parallel to the Y axis. In addition, in Step S516, a reference vector n is determined for the block n, as follows: First, are determined a first vector which starts at one of opposite ends of one of the opposed two side segments of the block n and ends at the other end of the one side segment, and a second which starts at one of opposite ends of the other side segment which one end is opposed to the one end of the one side segment and ends at the other end of the other side segment which end is opposed to the other end of the one side segment. Then, a vector which starts at a position on a third aid line numbered (n−1), extends in the direction of a vector obtained by addition of the first and second vectors, and ends at a position on the third aid line n, is defined as the reference vector n, where the end position of the reference vector n on the third aid line n serves simultaneously as the start position of a reference vector (n+1). The minimum vertex serves as the start ends of the first and second vectors for the block to which the minimum vertex belongs and simultaneously as the start position of a reference vector numbered one, while the maximum vertex serves as the ending ends of the first and second vectors for the block to which the maximum vertex belongs and simultaneously as the end position of a reference vector numbered N. The two blocks to which the minimum and maximum vertices belong are triangles, and the other blocks are quadrangles. The start and end position on the third aid line n is referred to as the reference position n. The reference position n falls at the middle point of an inside segment of the straight third aid line n which segment is located inside the current polygon. Further, a composite reference vector n is obtained by addition of the reference vectors n and (n+1), and a straight line which is perpendicular to the composite reference vector n and passes the vertex $P_n$ is defined as a reference line n, indicated at $L_{REF}$ in the figures.

Step S516 is followed by Step S517 to determine an angle $\theta_R$ contained by the reference line n and a straight rear-side adjacent line passing the vertex $P_n$ and the rear-side adjacent vertex $P_R$, and an angle $\theta_F$ contained by the reference line n and a straight front-side adjacent line passing the vertex $P_n$ and the front-side adjacent vertex $P_F$. In addition, in Step S517, it is judged whether or not the angle $\theta_R$ is smaller than the angle $\theta_F$. That is, it is identified whether or not the rear-side adjacent line is nearer to the reference line n than the front-side adjacent line. Regarding the example, H, of FIG. 26, an affirmative judgment is provided in Step S517, and the control goes to Step S513 to determine the rear-side adjacent vertex as the proper second division base vertex. On the other hand, if a negative judgment is provided in Step S517, the control goes to Step S518 to judge whether or not the angle $\theta_R$ is greater than the angle $\theta_F$. That is, it is identified whether or not the front-side adjacent line is nearer to the reference line n than the rear-side adjacent line. Regarding the example of FIG. 27, an affirmative judgment is provided in Step S518, and the control goes to Step S515 to determine the front-side adjacent vertex as the proper second division base vertex. On the other hand, if a negative judgment is provided in Step S518, namely, if the angle $\theta_R$ is equal to the angle $\theta_F$, the control goes to Step S519 to determine an angle $\theta'_R$ contained by the first aid line n and the rear-side adjacent line, and an angle $\theta'_F$ contained by the first aid line and the front-side adjacent line. In addition, in Step S519, it is judged whether or not the angle $\theta'_R$ is smaller than the angle $\theta'_F$, that is, whether or not the rear-side adjacent line is nearer to the first aid line n than the front-side adjacent line. Regarding the example of FIG. 28, an affirmative judgment is provided in Step S519, and the control goes to Step S513 to determine the rear-side adjacent vertex as the proper second division base vertex. On the other hand, if the angle $\theta'_R$ is greater than the angle $\theta'_F$ as is the case with the example of FIG. 29, or if the angle $\theta'_R$ is greater than the angle $\theta'_F$, a negative judgment is provided in Step S519, the control goes to Step S515 to determine the front-side adjacent vertex as the proper second division base vertex.

After the proper second division base vertex $D'_n$ has been determined for the vertex $P_n$ in this way, the control goes to Step S520 to increment the count n of the first counter by one, and then goes back to Step S507. Steps S507 through S520 are repeated for each of the first aid lines, beginning with the line numbered one and ending with the line numbered (N−1). If the count n coincides with the number N, an affirmative judgment is provided in Step S507, and the control goes to Step S521 to determine vertices for which proper second division base positions have not been determined, and determine the proper second division base positions for those left vertices.

Figure 31:
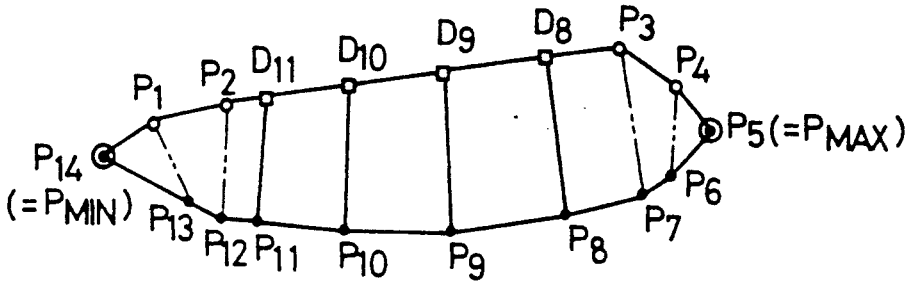

In the case where the number of vertices of the upper portion of the current polygon is not equal to that of the lower portion, for example where the former is smaller than the latter, there may be left some vertices of the lower portion for which proper second division base positions are not determined by the execution of Steps S507–S520. Step S521 is provided for determining proper second division base positions for those left vertices. Specifically, first, with respect to one of the upper and lower portions which is different from the other portion to which one or more left vertices belong, are determined a pair of vertices which have, as the second division base positions (vertices) therefor, the preceding and following vertices of the one left vertex or group of two or more vertices, respectively. Second, a side connecting the determined pair of vertices is divided internally by the same ratios as internal division ratios of the X axis by the feet on the X axis of the preceding vertex, one or more left vertices, and following vertex. The thus provided, internally dividing point or points are defined as the proper second division base position or positions for the left one or more vertices. Regarding an example shown in FIG. 31, the number of vertices of the lower portion of the polygon is greater than that of the upper portion thereof, and the lower portion has four left vertices, $P_{11}$, $P_{10}$, $P_9$, $P_8$, between the preceding vertex, $P_{12}$, and the following vertex, $P_7$. In this case, a side connecting the vertices, $P_2$ and $P_3$, which have as the second division base positions therefor the vertices $P_2$ and $P_3$, respectively, is divided internally by the same ratios as internal division ratios of the X axis by the feet on the X axis of the vertices $P_{12}$, $P_{11}$, $P_{10}$, $P_9$, $P_8$, $P_7$. The thus provided, four internally dividing points, $D_{11}$, $D_{10}$, $D_9$, $D_8$, are determined as the proper second division base positions for the four left vertices $P_{11}$, $P_{10}$, $P_9$, $P_8$, respectively.

Step S521 is followed by Step S522 to divide the current polygon into blocks by the second division lines each of which connects a corresponding one of the vertices $P_n$ and a second division base position $D'_n$ therefor. Sets of block data each representative of a corresponding one of the blocks are prepared. Each set of block data includes sets of position data for the vertices and second division base positions belonging to the corresponding block. The sets of block data are modified for eliminating the effect of the rotation of the current polygon before being divided, and then are stored in the block data area **76*e*. In addition, a set of block division data indicative of a correspondence between the current polygon (or divided area) and the blocks belonging thereto, is prepared and stored in the division data area 76*f*. Thus, one cycle of the routine of FIG. 9** is ended.

Figure 9A:
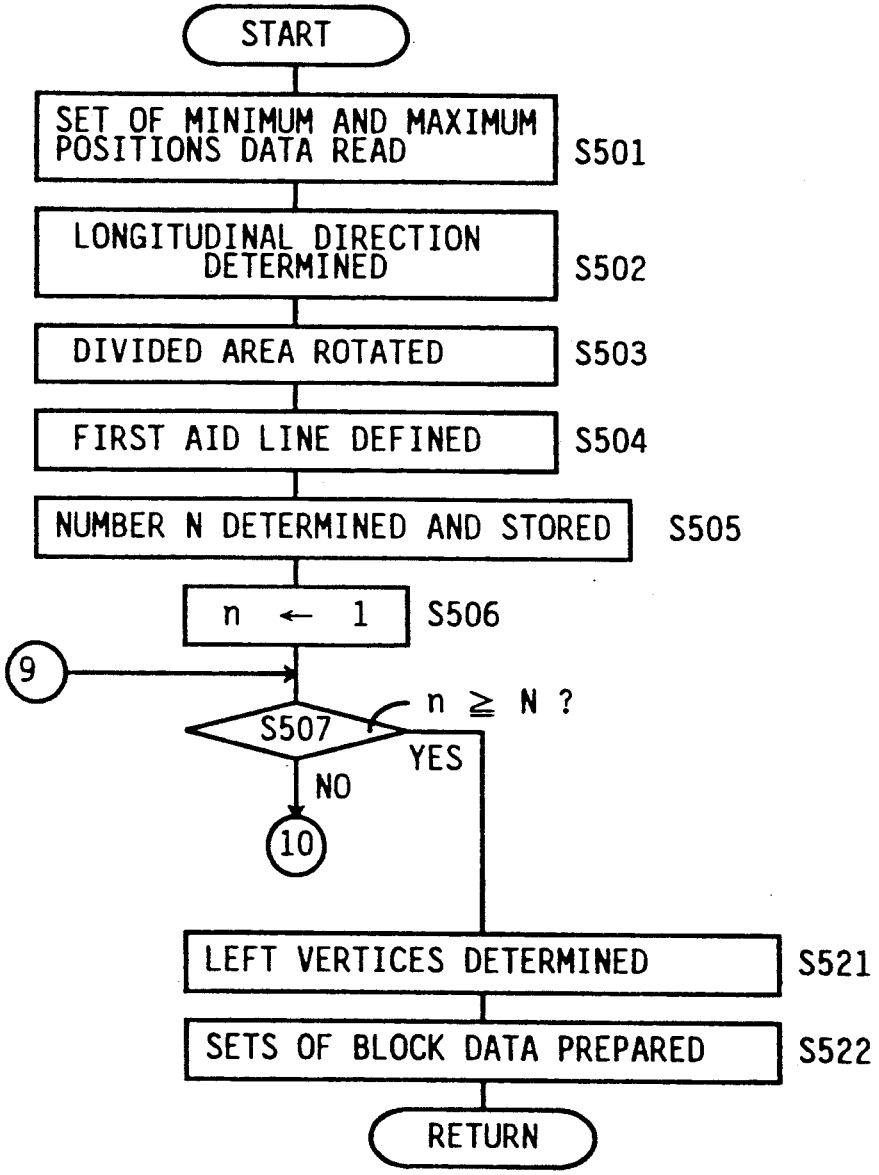
Figure 9B:
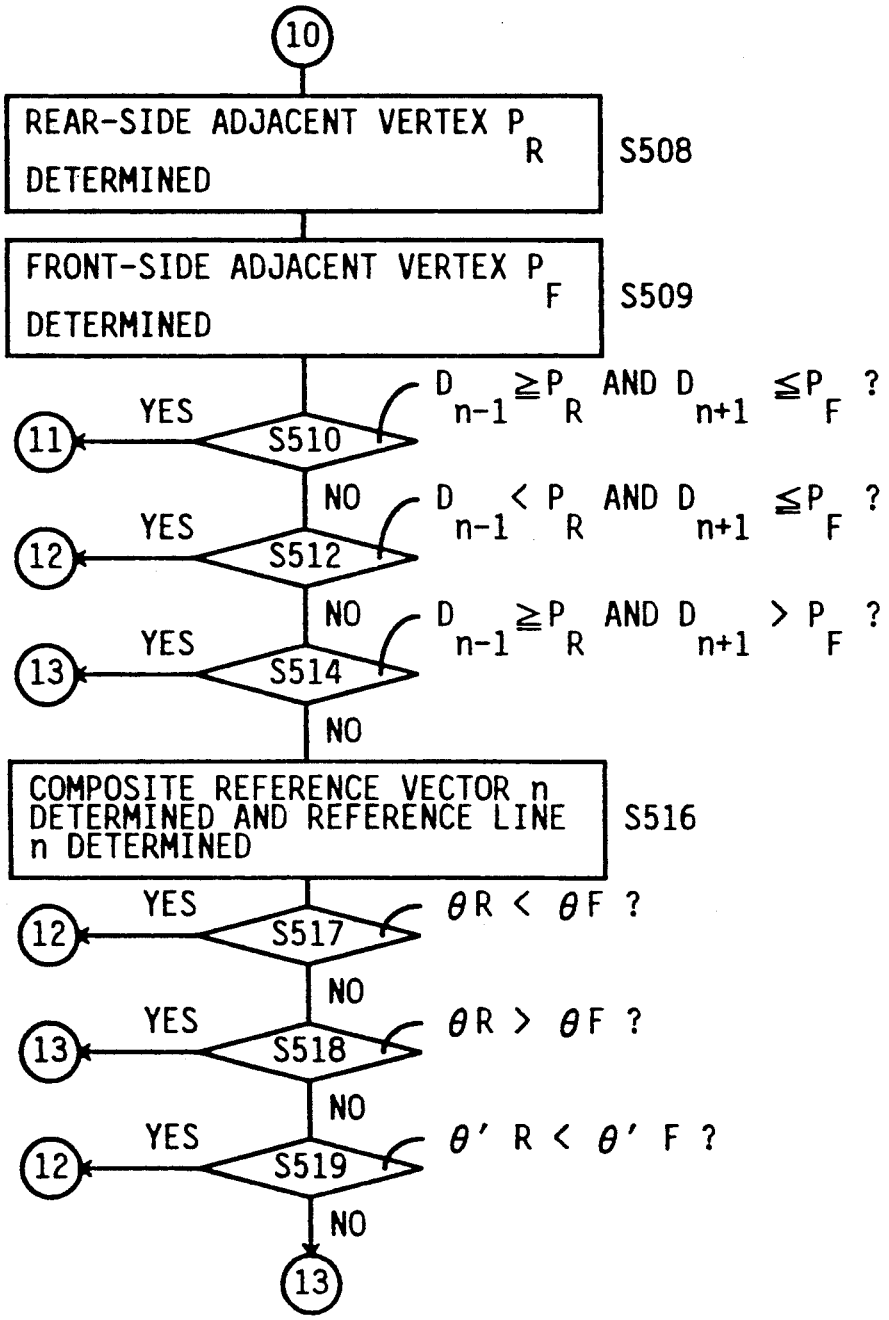
Figure 9C:
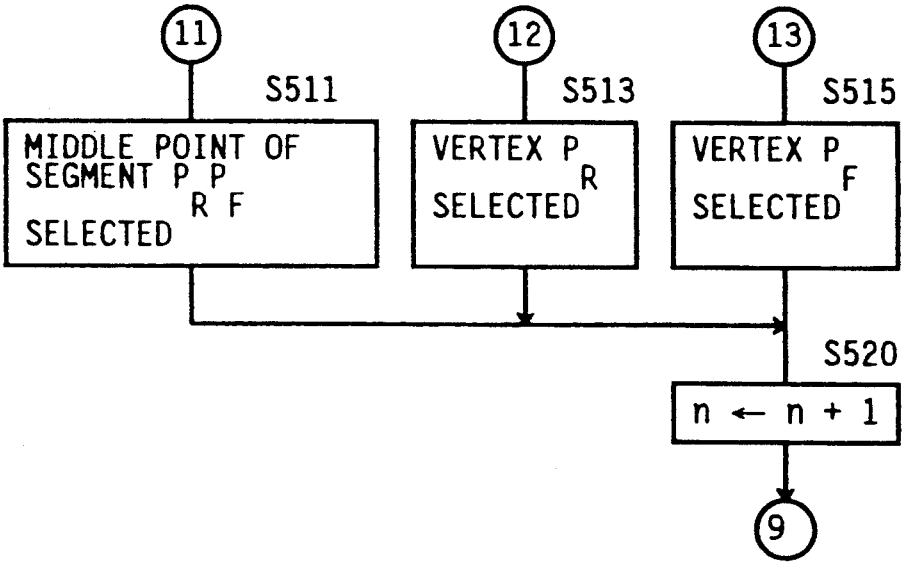
Figure 10A:
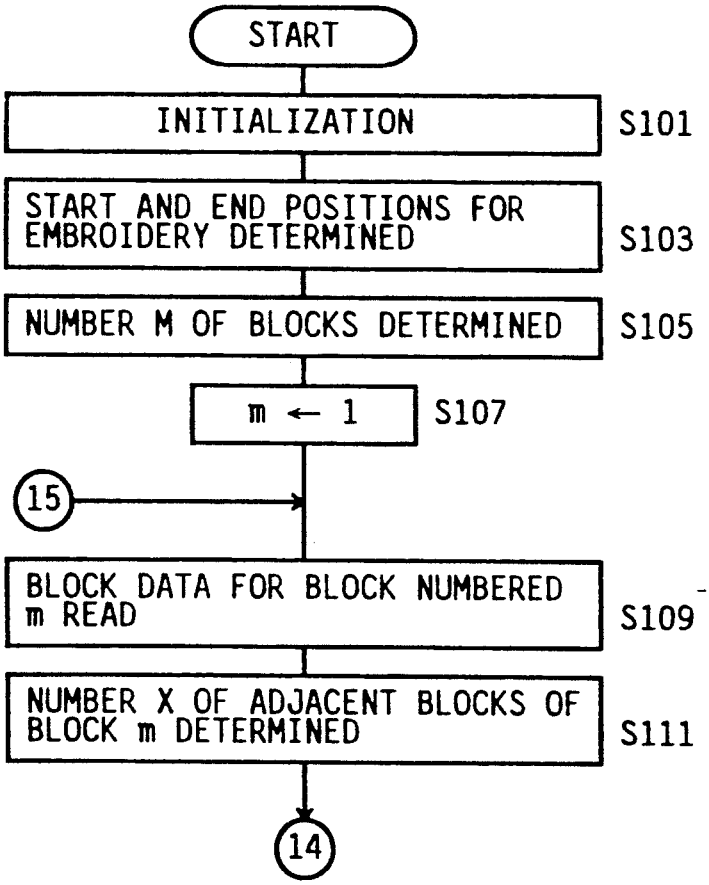
Figure 10B:
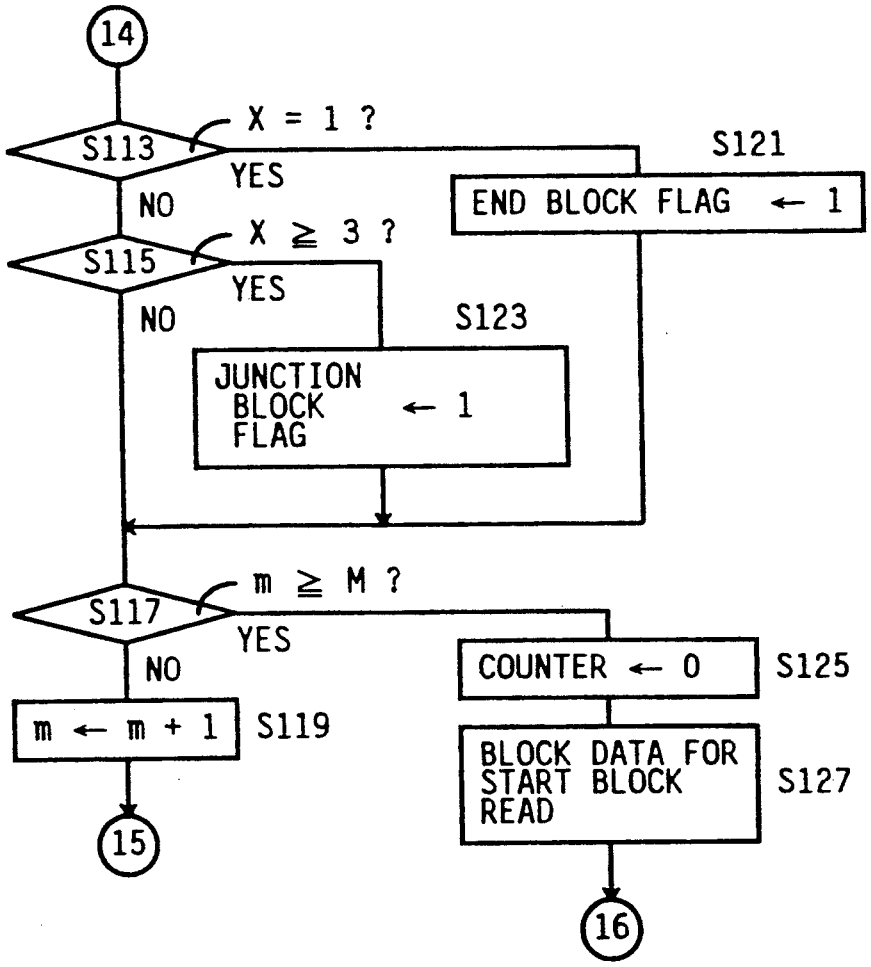
Figure 10C:
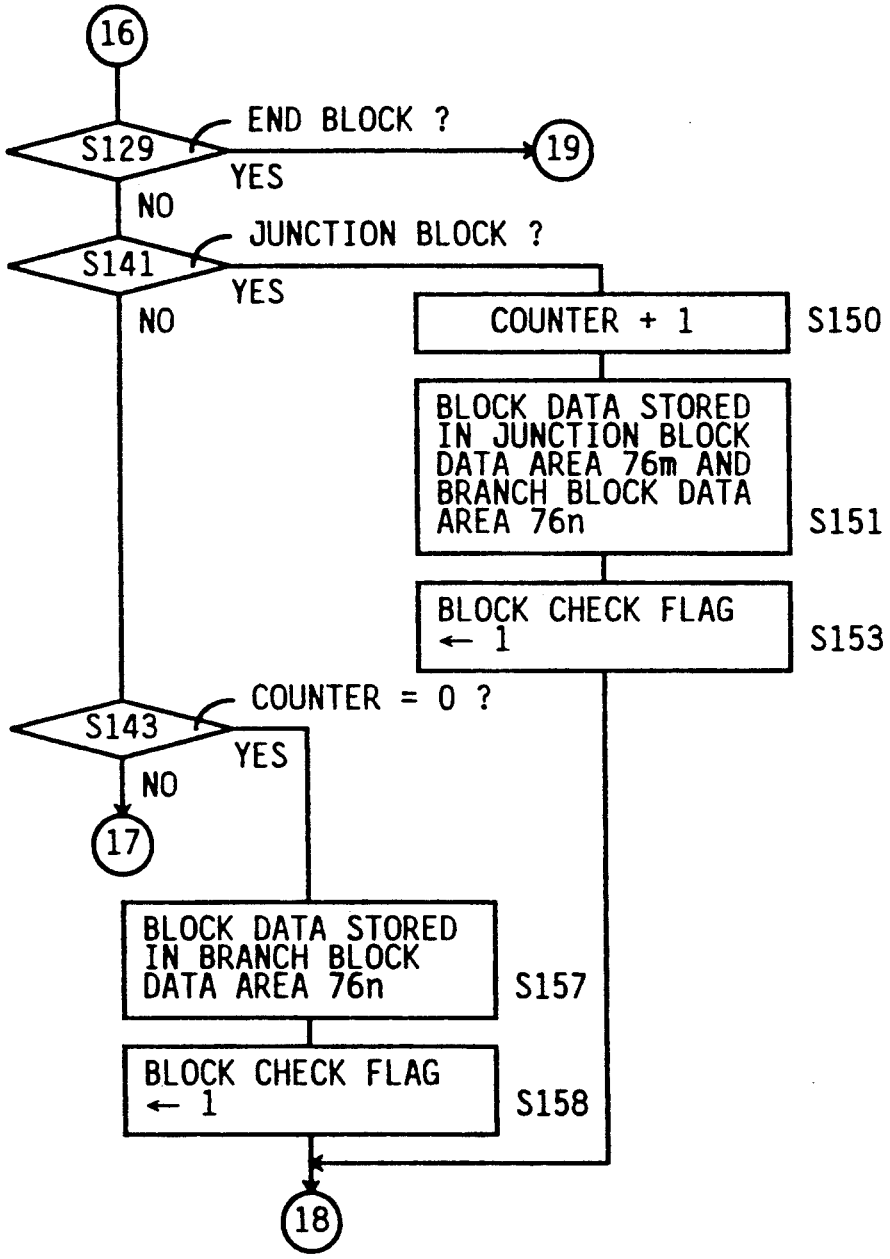
Figure 10D:
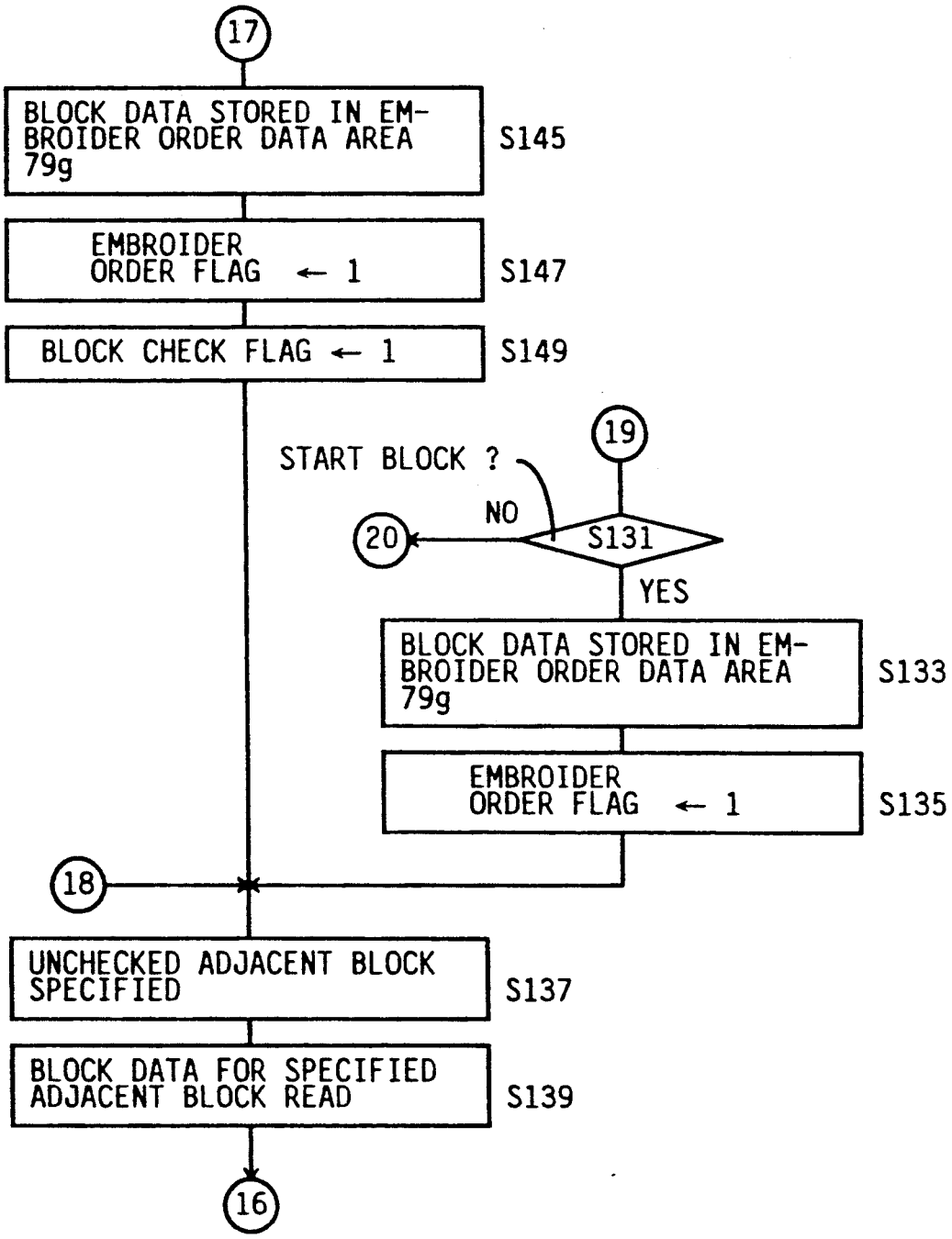
Figure 10E:
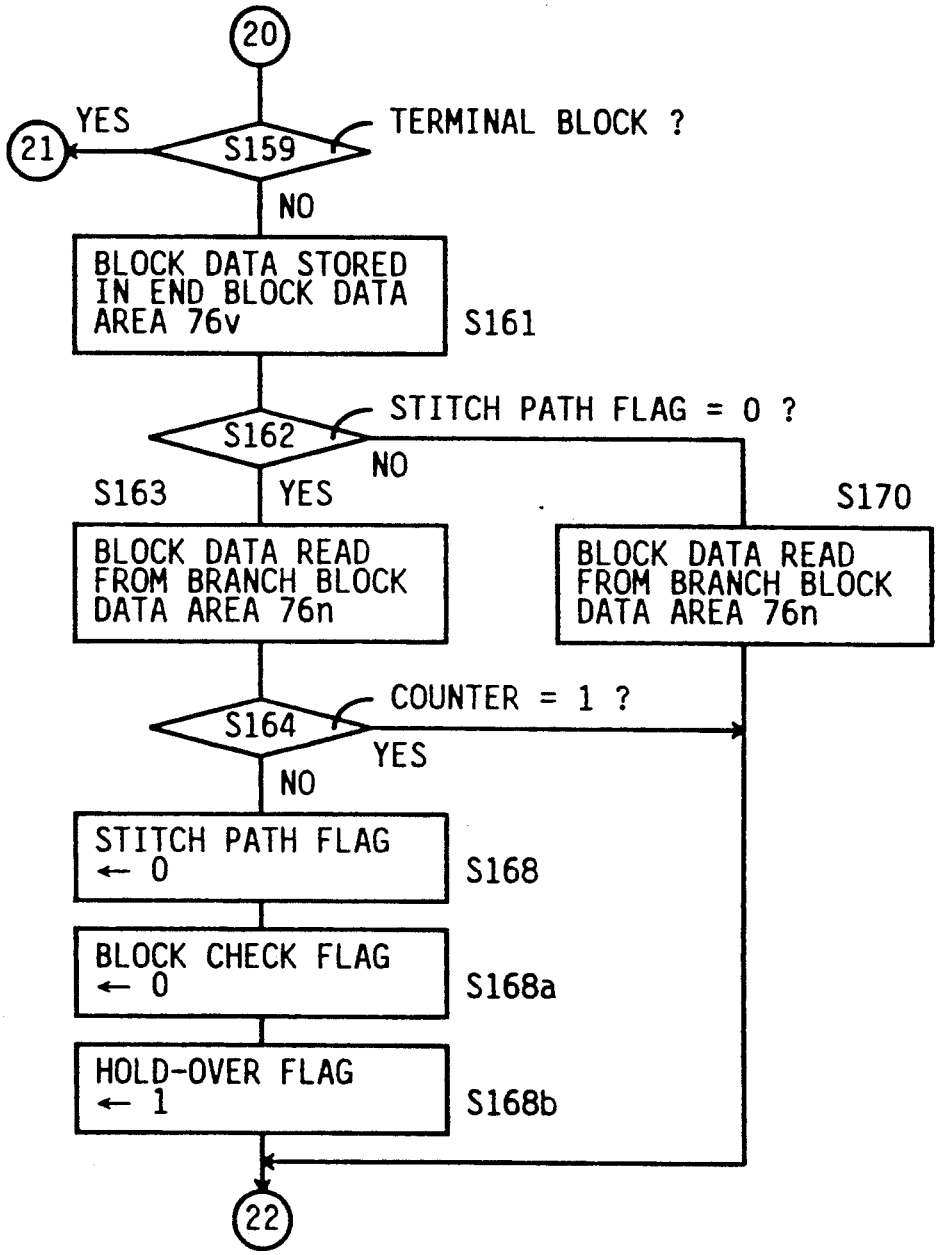
Figure 10F:
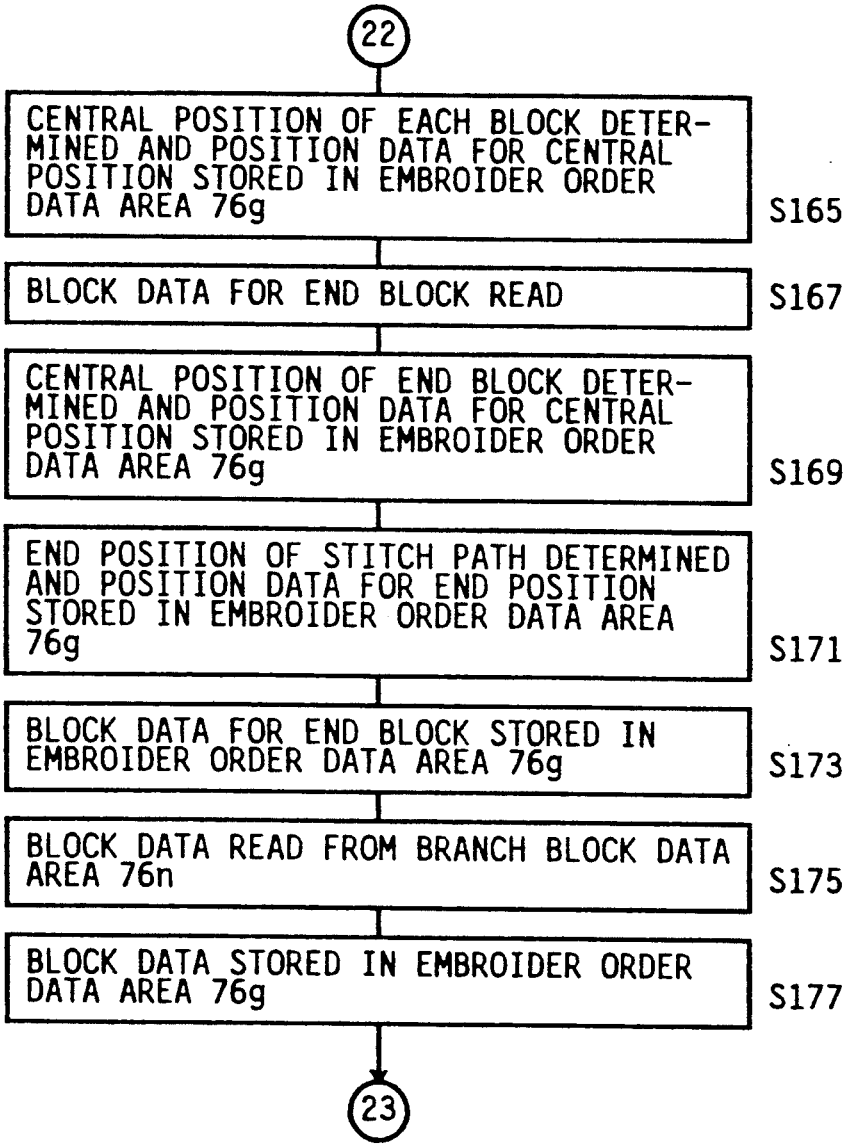
Figure 10G:
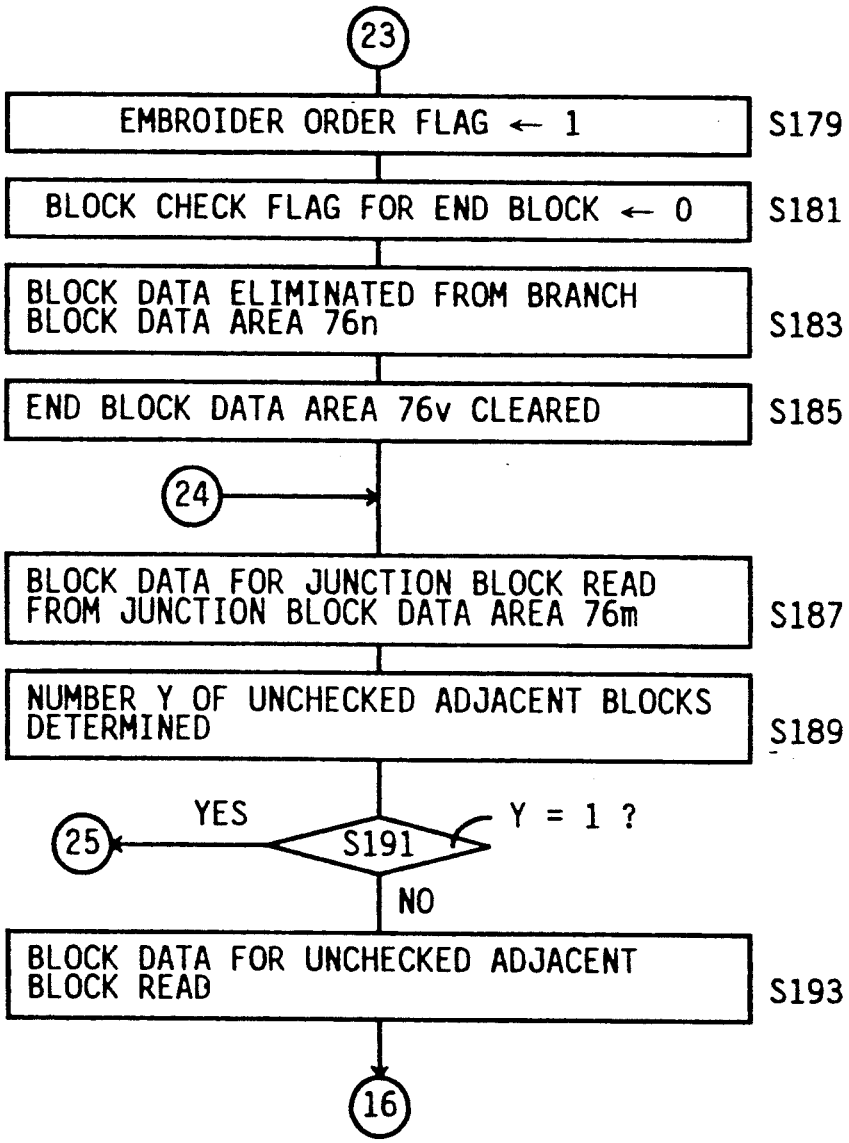
Figure 10H:
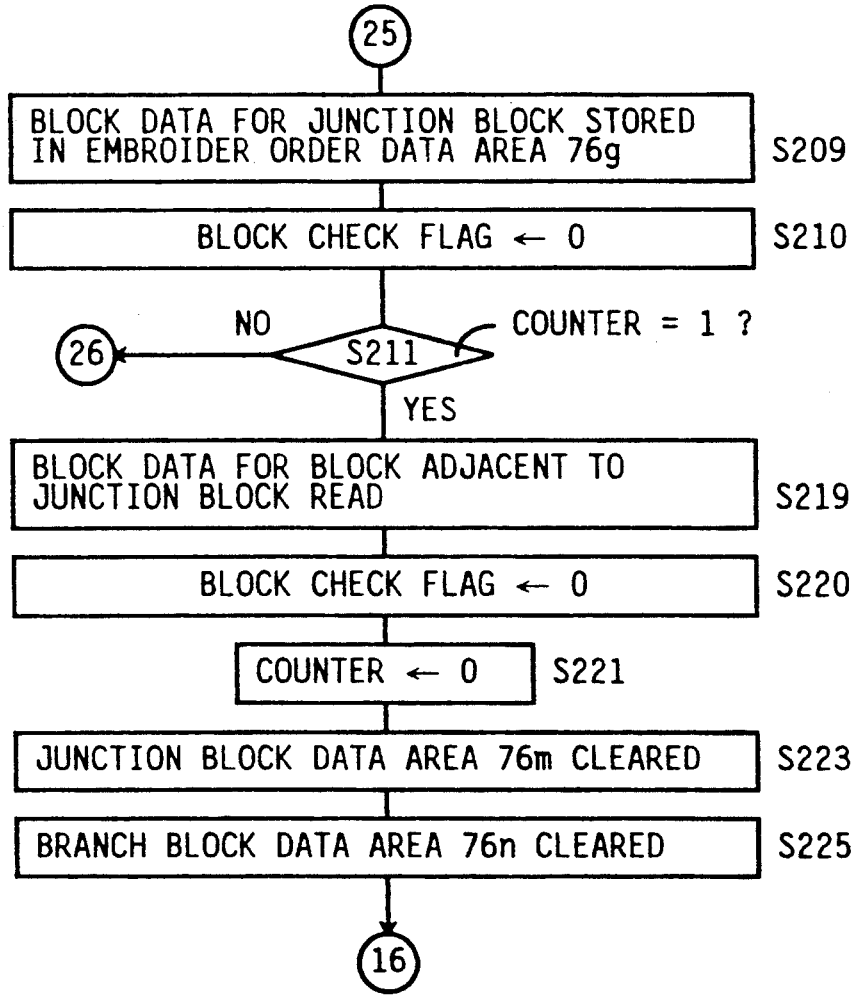
Figure 10I:
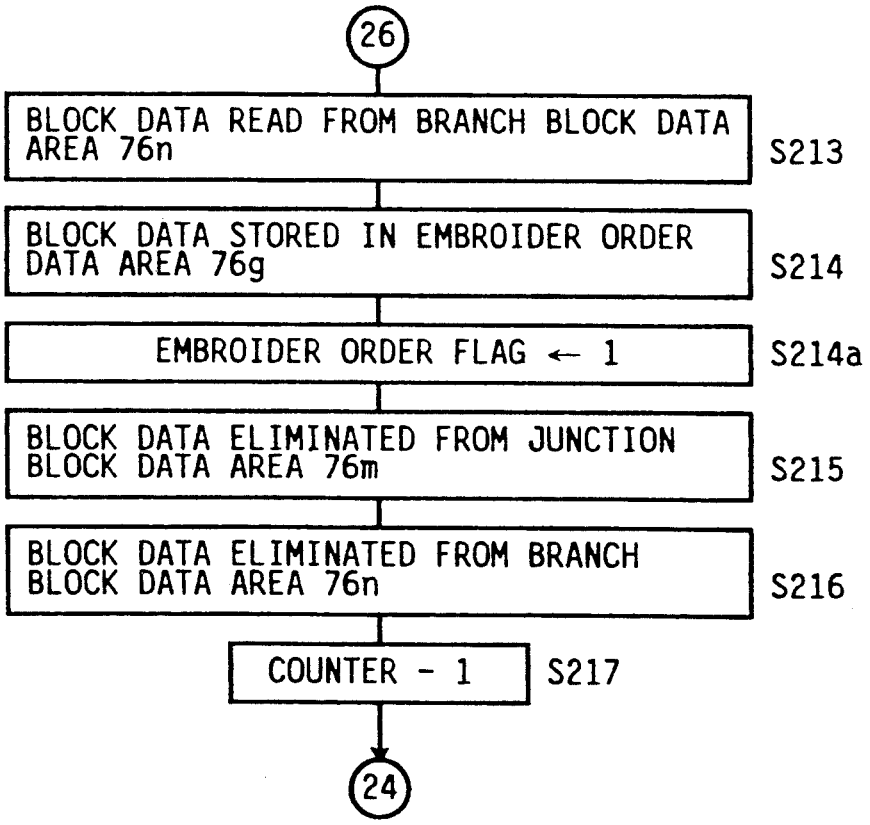
Figure 10J:
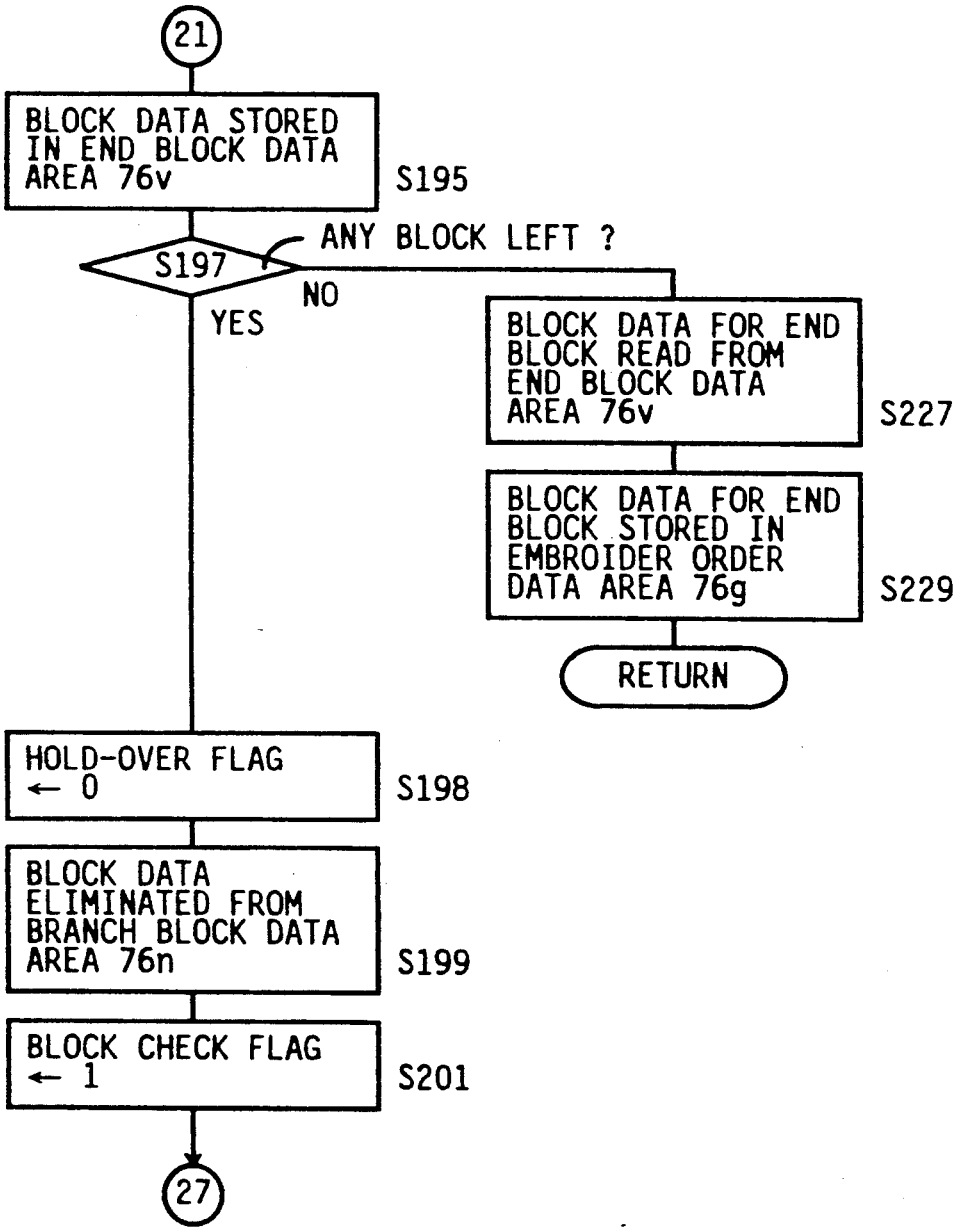
Figure 10K:
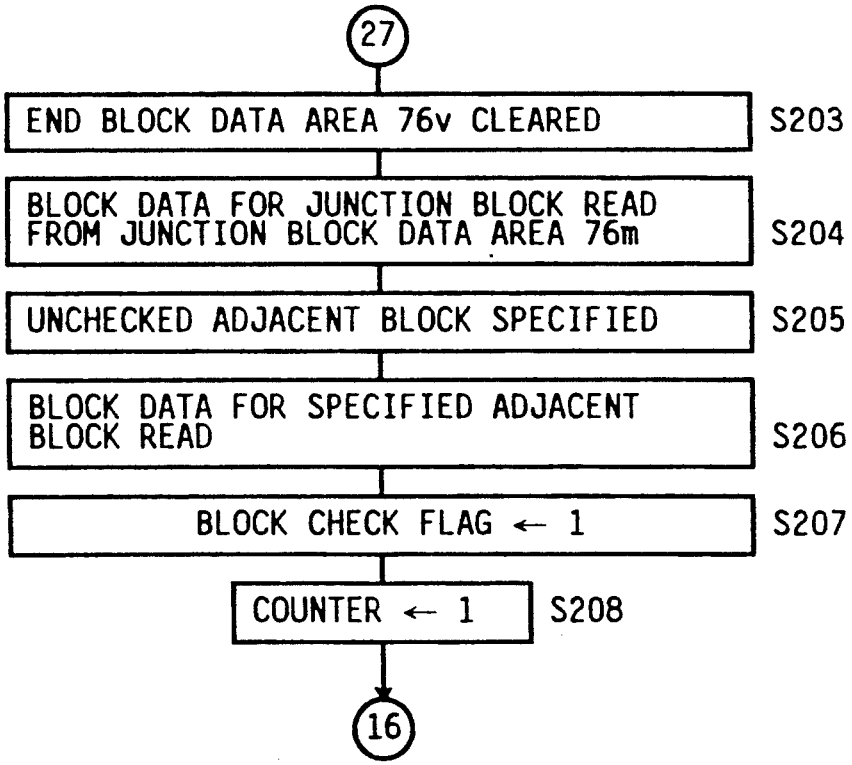
Figure 32:
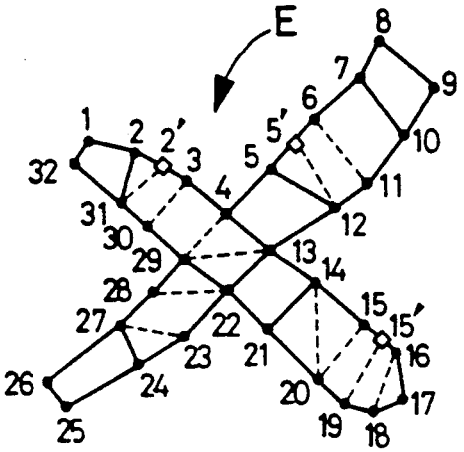

When the routine of FIG. 9 is executed for the divided areas of FIG. 19, those divided areas are divided into blocks as shown in FIG. 32. In FIG. 32, symbol "□" (small quadrangle) is indicative of a new vertex specified when the divided area divided into blocks. In other figures, too, the symbols of small quadrangles are indicative of such new vertices. Hereinafter, the vertices specified by the operator on the CRT 112 are referred to as the old vertices.

The routine of FIG. 9, i.e., Step S29 of FIG. 4 is followed by Step S31 to judge whether or not the count l of the second counter is not less than the number L. If a negative judgment is provided in Step S31, the control goes to Step S33 to increment the count l by one, and then returns to Step S29. On the other hand, if an affirmative judgment is provided in Step S31, the control goes to Step S35.

Figure 33:
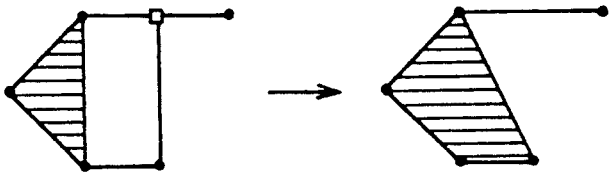
Figure 34:
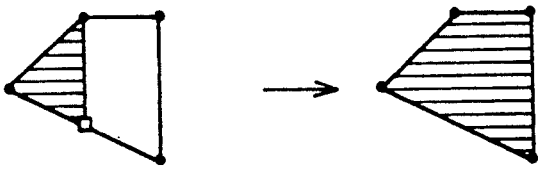
Figure 35:
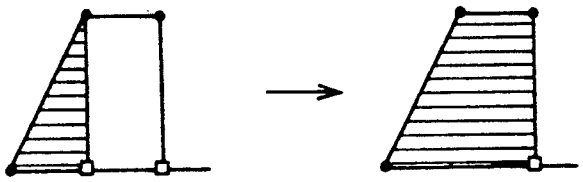

In Step S35, each of the blocks belonging to the divided area numbered n is checked for a triangular block, and each of the triangular blocks is modified to a quadrangle, as a triangle-like divided area is modified to a quadrangle-like area in Step S23. In the case, for example, where a triangular block is defined by three old vertices and simultaneously a block adjacent to the triangular block is a triangle defined by three old vertices, as shown in the left-hand portion of FIG. 21, the second division line separating the two triangular blocks is eliminated, so that the two triangular blocks are modified to a quadrangle, as shown in the right-hand portion of FIG. 21. In addition, in the case where a triangular block is defined by three old vertices and simultaneously an adjacent block of the triangular block is a quadrangle defined by four old vertices, as shown in the left-hand portion of FIG. 22, the second division line separating the triangular block and the quadrangle block is changed to a new second division line, so that the triangular block is modified to a quadrangle, as shown in the right-hand portion of FIG. 22. Regarding an example shown in the left-hand portion of FIG. 33 in which a triangular block is defined by three old vertices and an adjacent block of the triangular block is a quadrangle defined by three old vertices and one new vertex that does not belong to the second division line between the two blocks, the division line is replaced by one of the two diagonals of the quadrangle which one diagonal does not have the new vertex at one of opposite ends thereof, so as to modify the triangular block to a quadrangle, as shown in the right-hand portion of FIG. 33. Regarding an example shown in the left-hand portion of FIG. 34 in which an adjacent block of a triangular block is a quadrangle and only one of the two vertices located at opposite ends of the second division line between the two blocks is a new vertex, the division line is eliminated so as to modify the triangular block to a quadrangle, as shown in the right-hand portion of FIG. 34. Regarding an example shown in the left-hand portion of FIG. 35 in which an adjacent block of a triangular block is a quadrangle and only two vertices, one of which is one of the two vertices located at opposite ends of the second division line between the two blocks and the other of which is one of the two vertices located at opposite ends of a side of the quadrangle which side is opposed to the division line, are new vertices, the division line is eliminated so as to modify the triangular block to a quadrangle, as shown in the right-hand portion of FIG. 35. As a result of the execution of Step S35, the blocks of FIG. 32 are modified to blocks shown in FIG. 36 each of which consists of a quadrangle. FIG. 20 indicates a correspondence between each of the divided areas and the modified blocks belonging to the each divided area.

Step S35 is followed by Step S37. Step S37 is the routine illustrated in FIG. 10. In the routine of FIG. 10, an embroider order for forming stitches with a continuous thread and filling each of the blocks belonging to the area numbered n, is determined. In this process, one or more connect or stitch paths are determined, if necessary, for embroidering the area such that the continuous thread does not pass over the stitches filling the blocks or pass outside of the area. A stitch path is utilized for forming stitches therealong and thereby connecting with the continuous thread between one of the blocks and another block which follows the one block in the embroider order.

Figure 36:
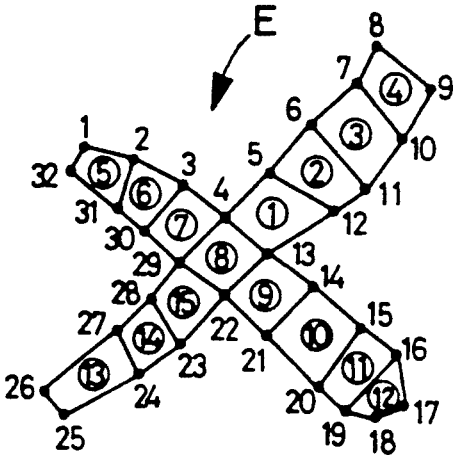
FIGS. 33 through 36 are views for explaining the routine of FIG. 4.

There will be described the case where the routine of FIG. 10 (10A, 10B, 10C, 10D, 10E, 10F, 10G, 10H, 10I, 10J, 10K) is executed for the area E of FIG. 36.

Before entering the description of individual steps of the routine of FIG. 10, a general explanation of the routine is provided. The block numbered eight of the area E of FIG. 36 is a junction block as previously described. First, the present system determines the block numbered thirteen, i.e., the start block to which the start position belongs, as the first block to be embroidered, and the blocks numbered fourteen and fifteen as the second and third blocks to be embroidered. The block numbered fifteen is one of the four adjacent blocks of the junction block. The junction block, however, is not determined as the fourth block to be embroidered. One of the three adjacent blocks of the junction block different from the block numbered fifteen, is selected, and a block which is the end block of the branch to which the selected block belongs, is determined as the fourth block to be embroidered. After the block numbered four is determined as the fourth block, the blocks numbered three, two, and one are determined as the fifth, sixth, and seventh blocks to be embroidered. In order to embroider the successive blocks numbered fifteen and four with a continuous thread without causing the thread to pass over the stitches formed in the blocks or pass outside the area E, a generally straight or polygonal stitch path is determined in the area E so that the needle 24 is moved along the stitch path from the block numbered fifteen to the block numbered four, while forming stitches which connect the two blocks but does not embroider or fill the blocks of the area E. A set of stitch position data prepared in Step S39 following Step S37, i.e., the routine of FIG. 10, may include one or more sets of stitch path data each of which includes sets of position data representative of the stitch positions belonging to a corresponding one of the stitch paths at which positions the needle 24 forms stitches.

Initially, in Step S101 of FIG. 10, initialization is effected. Specifically, the end block flags **76*i*, junction block flags 76*j*, embroider order flags 76*k*, block check flags 76*l*, stitch path flags 76*p*, and hold-over flags 76*q* each are set to zero, and the stitch position data area 76*h*, junction block data area 76*m*, branch block data area 76*n*, embroider order data area 76*g*, and end block data area 76*v* are cleared. Step S101 is followed by Step S103 in which are determined a start and an end position where the embroidering of the area E is to be started and ended, respectively. For example, the start and end positions are determined such that the start position is the nearest position to the preceding area D (FIG. 16) and the end position is the nearest to the following area F. For the area E, the positions numbered twenty five and one are determined as the start and end positions thereof, respectively, as shown in FIG. 40**.

Step S103 is followed by Step S105 to read from the division data area **76*f* the set of division data associated with the area E, and determine the number of the blocks belonging to the area E based on the set of division data. The determined number, M, is stored in an appropriate memory area of the RAM 76. Since the area E has fifteen blocks as shown in FIG. 40, the number M=15 is stored. Subsequently, in Step S107, the content or count, m, of a third counter indicative of the numbers assigned to the blocks of the area E, is set to one. In the present embodiment, numbers are assigned to the blocks of the area E in the order of storage of those blocks in the block data area 76*e*. The encircled numbers shown in FIG. 40** are indicative of the numbers assigned to the blocks of the area E.

Subsequently, in Step S109, the set of block data associated with the block numbered m is read from the block data area **76*e*. Step S109 is followed by Step S111 to determined the number of the blocks adjacent to the block m, namely, blocks each of which shares a side (i.e., second division line) with the block m (hereinafter, referred to as the adjacent blocks), based on the read set of block data associated with the block m and the remainder sets of block data stored in the block data area 76*e*. The determined number, X, is stored in an appropriate memory area of the RAM 76. Regarding the block numbered one, for example, the block numbered eight which shares the side connecting the positions numbered four and thirteen (hereinafter, abbreviated to as the side 4-13), and the block numbered two which has the side 5-12**, are determined as the adjacent blocks, and the number X=2 is stored.

Step S111 is followed by Step S113 to judge whether or not the number X is one. That the number X is one indicates that the block numbered m is located at an end of the area E, namely, is an end block of the area E. Since, regarding the block numbered one, the number X is two, and therefore a negative judgment is provided in Step S113. Consequently, the control goes to Step S115 to judge whether or not the number X is not less than three. If the number X is not less than three, the block numbered m is defined as a junction block of the area E. Since, regarding the block numbered one, the number X is two, and therefore a negative judgment is provided in Step S115. Then, the control goes to Step S117 to judge whether or not the count m of the third counter is not less than the number M. If a negative judgment is provided in Step S117, the control goes to Step S119 to increment the count m by one, and then returns to Step S109.

Steps S109-S119 are repeated for each of the fifteen blocks of the area E. The results show that the blocks numbered two, three, six, seven, nine, ten, eleven, fourteen, and fifteen are neither an end block nor a junction block like the block numbered one, that the blocks numbered four, five, twelve, and thirteen each have one adjacent block and therefore end blocks, and that the block numbered eight has four adjacent blocks and therefore a junction block. For each of the four end blocks, an affirmative judgment is provided in Step S113, and in Step S121 a corresponding end block flag **76*i* is set to one. In the meantime, for the junction block numbered eight, an negative judgment is made in Step S113 and an affirmative judgment is made in Step S115, so that in Step S123 a corresponding junction block flag 76*j*** is set to one.

In this way, for each of the blocks belonging to the area E, it is judged whether the each block is an end block, a junction block, or neither an end block nor a junction block.

Subsequently, the control goes to Step S125 to set the content or count of the counter **76*o* to zero, and then to Step S127 to read from the block data area 76*e* the set of block data associated with the block to which the start position of the area E belongs (hereinafter, referred to as the start block). Regarding the area E, the set of block data for the block numbered thirteen is read. Step S107 is followed by Step S129 to judge whether or not the start block is an end block. For the block numbered thirteen, an affirmative judgment is provided in Step S129, and the control goes to Step S131 to judge whether or not the block currently being checked is the start block. In this situation, an affirmative judgment is provided in Step S131, the control goes to Step S133 to store the set of block data for the current block in the embroider order data area 76*g*, and then to Step S135 to set an embroider order flag 76*k* for the block numbered thirteen, to one. Step S1375 is followed by Step S137 to specify the block numbered fourteen as being the sole adjacent block of the start block, and then by Step S139 to read from the block data area 76*e* the set of block data for the specified block. Then, the control returns to Step S129**.

Since the block numbered fourteen is not an end block, a negative judgment is provided in Step S129, and the control goes to Step S141 to judge whether or not the block currently being checked is a junction block. For the block numbered fourteen, a negative judgment is provided in Step S141, and the control goes to Step S143 judge whether or not the count of the counter **76*o* is zero. In this situation, an affirmative judgment is provided in Step S143, and the control goes to Step S145 to store the set of block data associated with the block numbered fourteen, in the stitching order data area 76*g*. Step S145 is followed by Step S147 to a stitching order flag 76*k* for the block numbered fourteen, to one, and then by Step S149 to set a block check flag 76*l* corresponding to the side 27-24** separating the blocks numbered thirteen and fourteen from each other, to one.

Subsequently, in Step S137, is specified one of the adjacent blocks of the block numbered fourteen which one block has not been checked. While the blocks numbered thirteen and fifteen are the adjacent blocks of the block numbered fourteen, the block numbered thirteen has been checked since the block check flag **76*l* for the side 27-24 commonly contained by the blocks numbered thirteen and fourteen, and therefore the block numbered fifteen is specified as an adjacent block which has not been checked (hereinafter, referred to as the unchecked adjacent block). Step S137 is followed by Step S139 to read the set of block data for the block numbered fifteen from the block data area 76*e***.

For the block numbered fifteen, Steps S129, S141, S143, S145, S147 and S149 are executed like for the block numbered fourteen. Consequently, the sets of block data for the blocks numbered thirteen, fourteen, and fifteen are stored in the embroider order data area **76*g*** in the order of description.

Subsequently, in Step S137, the block numbered eight is specified as the unchecked adjacent block of the block numbered fifteen. Step S137 is followed by Step S139 to read the set of data for the block numbered eight from the block data area **76*e***.

Since the block numbered eight is a junction block, a negative judgment is provided in Step S129 and an affirmative judgment is provided in Step S141. Therefore, the control goes to Step S150 to increment the count of the counter **76*o* by one. Step S150 is followed by Step S151 to store the set of block data for the block numbered eight in the junction block data area 76*m* such that the set of block data is in association with the current count, one, of the counter 76*o*. In addition, the set of block data in question is stored in the branch block data area 76*n*. Subsequently, in Step S153, a side check flag 76*l* for the side 29-22 separating the blocks numbered fifteen and eight, is set to one. Step S153 is followed by Step S137 to specify one of the unchecked adjacent blocks of the junction block. It is assumed that, for example, the block numbered one, namely, unchecked adjacent block which is opposed to the checked adjacent block is specified. Step S137 is followed by Step S139 to read the set of block data for the block numbered one from the specified block data area 76*e***.

Since the block numbered one is neither an end block nor a junction block, a negative judgment is provided in each of Steps S129 and S141, and the control goes to Step S143 to judge whether or not the current count of the counter **76*o* is zero. In this situation, a negative judgment is provided in Step S143, and the control goes to Step S157 to store the set of block data for the block numbered one in the branch block data area 76*n*. Step S157 is followed by Step S158 to set a block check flag 76*l* for the side 4-13** separating the blocks numbered eight and one, to one.

Subsequently, for each of the blocks numbered two and three, Steps S137, S139, S129, S141, S143, S157 and S158 are executed. Consequently, the sets of block data for the blocks numbered two and three are stored in the branch block data area 76n in the order of description.

Subsequently, in Steps S137 and S139, the block numbered four is specified as the unchecked adjacent block of the block numbered three, and the set of block data for the block is read from the block data area **76*e*. Since the block numbered four is an end block, an affirmative judgment is provided in Step S129, and the control goes to Step S131 to judge whether or not the block currently being checked is the start block. For the block numbered four, a negative judgment is provided in Step S131, and the control goes to Step S159**.

In Step S159, it is judged whether or not the block currently being checked is a block to which the end position of the area E belongs (hereinafter, referred to as the terminal block). Since the block numbered four is not the terminal block, a negative judgment is provided in Step S159, and the control goes to Step S161 to store the set of block data for the block numbered four in the end block data area **76*v***.

Step S161 is followed by Step S162 to judge whether or not the stitch path flag **76*p* is in the state of zero. In this situation, an affirmative judgment is provided in Step S162, and the control goes to Step S163 to read all sets of block data stored in the branch block data area 76*n* in the order of storage thereof therein, specifically beginning with the initially stored set of data for the junction block the same data as which is stored in association with the count, one, of the counter 76*o* in the junction block data area 76*m* (hereinafter referred to as the initial branch block data), and ending with the last stored set of block data for the block numbered three (hereinafter, referred to as the last branch block data). Step S163 is followed by Step S164 to judge whether or not the current count of the counter 76*o* is zero. In this situation, an affirmative judgment is provided in Step S164, and the control goes to Step S165 to determine an appropriate position inside, or on the outline of, each of the blocks numbered eight, one, two, and three (hereinafter, referred to as the central position), based on the read sets of block data therefor. For example, the central position is determined so as to be located at the middle point of a straight segment connecting between the middle points of the opposed sides of the each block (quadrangle) which sides are opposed to each other generally in the longitudinal direction of the divided area to which the each block belongs. In addition, in Step S165, sets of position data each representative of a corresponding one of the central positions are stored in the embroider order data area 76*g*. More specifically, the sets of position data associated with the central positions for the blocks numbered eight, one, two, and three, are stored in the embroider order data area 76*g* in the order of description. In the stitching order data area 76*g***, the sets of position data and the sets of block data are distinguished from each other by using flags.

Subsequently, in Step S167, the set of block data for the block numbered four is read from the end block data area **76*v*. Step S167 is followed by Step S169 to determine the central position of the block numbered four based on the read set of block data therefor, and store a set of position data representative of the determined central position in the embroider order data area 76*g*. This set of position data is distinguished from the sets of block data, by a flag, in the embroider order data area 76*g*. Step S169 is followed by Step S171 to specify one of the two positions numbered eight and nine of the block numbered four which positions cooperate with each other to define the end side of the branch to which the block numbered four belongs. One of the two positions which is more distant from the central position of the end block than the other position, is selected. The selected position, numbered eight, is determined as the end position of a connect or stitch path for this branch. In addition, in Step S171, the set of position data representative of the end position of the stitch path is stored in the embroider order data area 76*g*. This set of position data is distinguished from the sets of block data, like the other sets of position data, in the embroider order data area 76*g*. The sets of position data representative of the central position of the end block, numbered four, and the end position, numbered eight, of the stitch path are stored in the embroider order data area 76*g*** in the order of description. In short, the sets of position data for the central positions of the blocks numbered eight, one, two, three and four and the end position of the stitch path, cooperate with each other to constitute a set of stitch path data for the branch to which the end block, numbered four, belongs.

Subsequently, in Step S173, the set of block data for the end block, i.e., block numbered four, is stored in the embroider order data area **76*g*. Step S173 is followed by Step S175 to read all sets of block data stored in the branch block data area 76*n*, except for the initial branch block data for the junction block, specifically beginning with the set of block data for the block numbered one which follows the junction block, and ending with the last branch block data for the block numbered three. Subsequently, in Step S177, the read sets of block data are stored in the embroider order data area 76*g* by the manner of being last read and first stored. For this branch, the sets of block data for the blocks numbered three, two, and one are stored in the order of description in the embroider order data area 76*g***.

Step S177 is followed by Step S179 to set an embroider order flag **76*k* for each of the blocks whose block data have been stored in the embroider order data area 76*g* in Step S177, to one. Step S179 is followed by Step S181 to set a block check flag 76*l* for the side 7-10 separating the end block, numbered four, from the adjacent block, numbered three, to one. Subsequently, in Step S183, the sets of block data read out in Step S175 are erased from the branch block data area 76*n* and then, in Step S185, the end block data area 76*v*** is cleared.

Subsequently, in Step S187, the set of block data for the junction block, numbered eight, is read from the junction block data area **76*m* in which the set of block data is in association with the count, one, of the counter 76*o*. Step S187 is followed by Step S189 to determine the number, Y, of unchecked adjacent block or blocks of the junction block and store the determined number Y in an appropriate memory area of the RAM 76. Step S189 is followed by Step S191 to judge whether or not the number Y is one. While the junction block, numbered eight, has four adjacent blocks, i.e., blocks numbered fifteen, one, nine and seven, the blocks numbered fifteen and one have been checked since the block check flags 76*l* for the sides 29-22 and 4-13 separating the junction block from the blocks numbered fifteen and one, respectively, each are in the state of one. Therefore, the number Y is two and a negative judgment is provided in Step S191. Then, the control goes to Step S193 to read from the block data area 76*e* one of the sets of block data for the unchecked adjacent blocks. For an unchecked adjacent block, a corresponding hold-over flag 76q may be set to one, as described later. The checking of the unchecked adjacent block whose corresponding hold-over flag 76q is in the state of one, is held over to the last of the unchecked adjacent blocks. At the current cycle of Step S193**, it is assumed that the set of block data for the block numbered seven is read.

Step S193 is followed by Step S129. Since the block numbered seven is neither an end block nor a junction block, a negative judgment is provided in each of Steps S129 and S141, and the control goes to Step S143 to judge whether or not the current count of the counter 76o is zero. Since, in this situation, the count is one, a negative judgment is provided in Step S143, and the control goes to Step S157 to store the set of block data for the block numbered seven in the branch block data 76n, and then to Step S158 to set a block check flag 76l for the side 4-29 separating the junction block, numbered eight, from the block numbered seven, to one.

For the block numbered six which is the unchecked adjacent block of the block numbered seven, Steps S137, S139, S129, S141, S143, S157 and S158 are executed, so that the block data for the block numbered six is stored in the branch block data area 76n.

Subsequently, Steps S137 and S139 are executed to specify the block numbered five as the unchecked adjacent block of the block numbered six and read the set of block data for the block numbered five from the block data area 76e. Since the block numbered five is an end block and simultaneously the terminal block, an affirmative judgment is provided in Step S129, a negative judgment is provided in Step S131, and an affirmative judgment is provided in Step S159. Consequently, the control goes to Step S195.

In Step S195, the set of block data for the block numbered five, is stored in the end block data area 76v. Step S195 is followed by Step S197 to judge whether or not there remains any block of the area E which block has not been positioned in the embroider order of the area E, by judging whether or not there remains any block for which a corresponding embroider order flag 76k has not been set to one, except for the blocks whose block data are stored in the branch block data area 76n or end block data area 76v. Since, for the blocks numbered nine, ten, eleven, and twelve, corresponding embroider order flags 76k have not been set to one, an affirmative judgment is provided in Step S197, and the control goes to Step S198 to set the hold-over flag 76q for the block numbered five, to one. Step S198 is followed by Step S199 to erase the sets of block data stored in the branch block data area 76n in the order of storage thereof therein, specifically beginning with the set of data for the block, numbered seven, which follows the junction block, numbered eight, which is associated with the count, one, of the counter 76o, and ending with the last branch block data for the block numbered five. Step S199 is followed by Step S201 to reset to zero the block check flags 76l for all the sides 4-29, 3-30, and 2-31 contained by the branch to which the terminal block belongs. Subsequently, in Step S203, the end block data area 76v is cleared and, in Step S204, the set of block data, numbered eight, which is associated with the count, one, of the counter 76o, is read from the branch block data area 76n.

Step S204 is followed by Steps S205 and S206 to specify one of the unchecked adjacent blocks of the junction block, numbered eight, and read from the block data area 76e the set of block data for the specified block. In Step S205, the unchecked adjacent block for which the corresponding hold-over flag 76q is in the state of one, is held over to the last of the unchecked adjacent blocks. While the adjacent blocks of the block numbered eight are the blocks numbered fifteen, one, seven, and nine, the block check flags 76l for the sides 29-22 and 4-13 each are in the state of one and the hold-over flag 76q is in the state of one for the block numbered seven, and therefore the block numbered nine is specified. The set of block data for the block numbered nine is read from the block data area 76e. Step S206 is followed by Step S207 to set a block check flag 76l for the side 13-2 separating the junction block from the block numbered nine. Step S207 is followed by Step S208 to set the count of the counter 76o to one.

Subsequently, for each of the blocks numbered ten and eleven, Steps S129, S141, S143, S157, S158, S137, and S139 are executed, so that the sets of block data for those blocks are stored in the branch block data area 76n. Then, in Step S137, the set of block data for the block numbered twelve is specified as the unchecked adjacent block of the block numbered eleven. Since the block numbered twelve is an end block but not neither the start nor terminal block, an affirmative judgment is provided in Step S129, a negative judgment is provided in Step S131, and a negative judgment is provided in Step S159. Consequently, the control goes to Step S161 to store the set of block data for the block numbered twelve in the end block data area 76v. Since, in this situation, the stitch path flag 76p is in the state of zero and the current count of the counter 76o is one, Step S161 is followed by Steps S162, S163, S164, S165–S185, so that the set of position data representative of the central position of the block numbered eight, sets of position data representative of the central positions of the blocks numbered nine, ten, eleven, and twelve, a set of position data representative of the position numbered seventeen as the end position of a stitch path for the branch to which the end block, numbered twelve, belongs, and the sets of block data for the blocks numbered twelve, eleven, ten, and nine, are stored in the embroider order data area 76g in the order of description.

Subsequently, in Step S187, the set of block data for the junction block, numbered eight, is read from the junction block data area 76m in which the set of block data is in association with the count, one, of the counter 76o. Step S187 is followed by Step S189 to determine the number, Y, of unchecked adjacent block or blocks of the junction block and store the determined number Y. Step S189 is followed by Step S191 to judge whether or not the number Y is one. While the junction block, numbered eight, has the four adjacent blocks, i.e., blocks numbered fifteen, one, nine and seven, the blocks numbered fifteen, one and nine have been checked since the block check flags 76l for the sides 29-22, 4-13 and 13-22 separating the junction block from the blocks numbered fifteen, one, and nine, respectively, each are in the state of one. That is, the block numbered seven for which the corresponding hold-over flag 76q is in the state of one, is the only unchecked adjacent block of the junction block, numbered eight, and therefore the number Y is one. Accordingly, an affirmative judgment is provided in Step S191, and the control goes to Step S209.

In Step S209, the set of block data for the block numbered eight is stored in the embroider order data area 76g. Step S209 is followed by Step S210 to set an embroider order flag 76k for the block numbered eight, to one. Subsequently, in Step S211, it is judged whether or not the current count of the counter 76o is one. In this situation, an affirmative judgment is provided in Step S211, and the control goes to Step S219 to read the set of block data for the unchecked adjacent block, numbered seven, of the junction block, numbered eight, from the block data area 76e. Step S219 is followed by Step S220 to set a block check flag 76l for the side 4-29 separating the junction block from the block numbered seven, to one. Subsequently, in Step S221, the count of the counter 76o is reset to zero and the stitch path flag 76p is set to zero. Step S222 is followed by Step S223 to clear the junction block data area 76m, and then by Step S225 to clear the branch block data area 76n.

Subsequently, Step S129 and the following steps are executed. Since the current count of the counter 76o is zero, the sets of block data for the blocks numbered seven and six are stored in the embroider order data area 76n in the order of description, in Step S145. Subsequently, in Step S137 the block numbered five is specified as the unchecked adjacent block of the block numbered six. Since the block numbered five is an end block and the terminal block, an affirmative judgment is provided in Step S159, and the control goes to Step S195 to store the set of block data for the block numbered five in the end block data area 76v. Step S195 is followed by Step S197 to judge whether or not there remains any block for which a corresponding embroider order flag 76k has not been set to one, that is, whether or not there remains any block which has not been positioned in the embroider order of the area E. Since, in this situation, a negative judgment is provided in Step S197, and the control goes to Step S227 to read the set of block data for the block numbered five from the end block data area 76v, and then Step S228 to store the read set of block data in the embroider order data area 76g. Thus, the embroider order of the area E is determined. The embroider order of the area E consists of the order of embroidering of the blocks and the two connect or stitch paths interposed in the order of embroidering of the blocks.

Subsequently, in Step S39 of FIG. 4, a set of stitch position data is prepared based on the sets of block data and sets of stitch path data stored in the embroider order data area 76g. The set of stitch position data prepared are representative of the stitch positions at which the embroidery sewing machine 8 forms stitches for filling each of the blocks with the formed stitches, and stitches along the connect or stitch paths for connecting with a continuous thread between one of the blocks and another block which follows the one block in the order of embroidering of the blocks. The set of stitch position data is stored in the stitch position data area 76h.

Subsequently, in Step S41 of FIG. 4, it is judged whether or not the count n of the first counter is not less than the number N. If a negative judgment is provided in Step S41, the control goes to Step S43 to increment the count n by one, and then returns to Step S23. On the other hand, if an affirmative judgment is provided in Step S41, one cycle of the routine of FIG. 4 is ended.

If the operator keys in an embroidery start command through the keyboard 82, for embroidering the Chinese character "⊠" on the work fabric, the embroidery sewing machine embroiders the character by forming stitches at respective stitch positions according to the set of stitch position data stored in the stitch position data area 76h.

Figure 38:
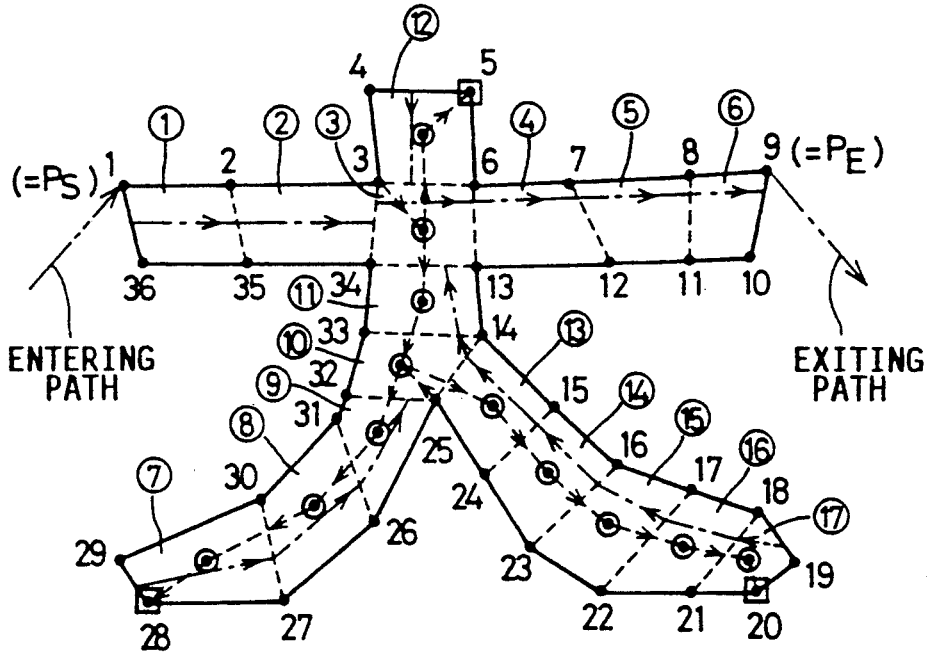

While the operation of the present system for producing the stitch position data for the area E that is a portion of the Chinese character "⊠", has been described, there will next be described the data production for the Chinese character "大" by reference to FIGS. 10 and 38. As shown in FIG. 38, the character is represented by thirty six positions, and consists of seventeen blocks. The positions numbered one and nine are specified as the start and end positions for embroidering the character, respectively.

Initially, the sets of block data for a block numbered one (i.e., start block) and a block numbered two, are read from the block data area 76e, and stored in the embroider order data area 76g in the order of description. Subsequently, a block numbered three is specified as the unchecked adjacent block of the block numbered two. The block numbered three is a junction block, and the content or count of the counter 76o is incremented by one, to one. That is, the block numbered three is associated with the count, one, of the counter 76o. The block numbered three has four adjacent blocks, and blocks numbered four, eleven and twelve are unchecked adjacent blocks. It is assumed that, initially, the block numbered four opposed to the block numbered three is selected for being checked. In this case, the set of block data for the blocks numbered four and five are stored in the branch block data area 76n. Then, a block numbered six is specified as the unchecked adjacent block of the block numbered five. The block numbered six is not only an end block but also the terminal block, but in this situation there remain blocks for which corresponding embroider order flags 76k have not been set to one, namely, which have not been positioned in the embroider order of the character. Hence, from the branch block data area 76n, all the sets of block data from the initial branch block data to the last branch block data are eliminated. In other words, the set of block data for the block numbered four which follows the junction block associated with the count, one, of the counter 76o, and the set of block data for the block numbered five which precedes the terminal block, are eliminated. In addition, the end block data area 76v is cleared, and a hold-over flag 76q is set to one for the block numbered four.

It is assumed that, next, a block numbered twelve is specified as an unchecked adjacent block of the junction block, numbered three. Since the block numbered is an end block but not the terminal block, sets of position data representative of the central positions of the blocks numbered three and twelve, a set of position data representative of a position numbered five as the end position of a stitch path for the branch to which the end block, numbered twelve, belongs, and the set of block data for the block numbered twelve, are stored in the embroider order data area 76g in the order of description. In addition, a block check flag 76l for the side 3-6 separating the block numbered three from the block numbered twelve, is set to one.

Subsequently, a block numbered eleven is specified as an unchecked adjacent block of the junction block, numbered three, and the set of block data for the block numbered eleven is stored in the branch block data area 76n. Then, a block numbered ten is specified as the unchecked adjacent block of the block numbered eleven. Since the block numbered ten is a junction block, the count of the counter 76o is incremented by one, to two, and the set of block data for the block numbered ten is stored in the junction block data area 76m such that the stored set of block data is in association with the count, two, of the counter 76o. In addition, a block check flag 76l for the side 34-13 separating the block numbered three from the block numbered eleven, is set to one.

The block numbered ten has two unchecked adjacent blocks, numbered nine and thirteen. It is assumed that, first, the block numbered nine is selected. In this case, the sets of block data for the block numbered nine and a block numbered eight, are stored in the branch block data area 76n. Subsequently, a block numbered seven is specified as the unchecked adjacent block of the block numbered eight. Further, block check flags 76l for the sides 33-14, 32-25, 31-26, and 30-27 separating the blocks numbered eleven, ten, nine, eight, and seven from each other, each are set to one. Since the block numbered seven is an end block but not the terminal block, a negative judgment is provided in Step S159 and, in Step S161, the block data for the block numbered seven is stored in the end block data area 76v. Then, in Step S162, the stitch path flag 76p is in the state of zero. In this situation, an affirmative judgment is provided in Step S162, and the control goes to Step S163 to read from the branch block data area 76n the sets of block data for the blocks numbered three, eleven, ten, nine, eight, and seven. Subsequently, in Step S164, it is judged whether or not the current count of the counter 76o is one. Since the current count is two, a negative judgment is provided in Step S164, and the control goes to Step S168 to set the stitch path flag 76p to one, and then to Step S168a to reset to zero the block check flag or flags 76l for the side or sides separating a series of blocks having at both ends thereof the junction block associated with the current count, two, of the counter 76o and the junction block associated with the count smaller by one than the current count. In this particular case, the block check flags 76l for the sides 34-13 and 33-14 separating the blocks numbered three, eleven and ten from each other, each are reset to zero.

Subsequently, in Step S168b, a hold-over flag 76q for the block which is situated between the block associated with the current count of the counter 76o and the block associated with the count smaller by one than the current count, and which is an adjacent block of the block associated with the current count, is set to one. In this particular case, the hold-over flag 76q for the block numbered eleven is set to one. Step S168b is followed by Step S165 to store in the embroider order data area 76g sets of position data representative of the central positions of the block numbered three, eleven, ten, nine, eight, and seven, a set of position data representative of a position numbered twenty eight as the end position of a stitch path for the branch to which the end block, numbered seven, belongs, and the set of block data for the blocks numbered seven, eight, and nine, in the order of description. In addition, the sets of block data for the blocks numbered nine and eight are eliminated from the branch block data area 76n, and the set of block data for the block numbered seven is eliminated from the end block data area 76v.

The block numbered ten has two unchecked adjacent blocks, numbered thirteen and eleven, but the hold-over flag 76q for the block numbered eleven is in the state of one. Therefore, in Step S93, the set of block data for the block numbered thirteen is read from the block data area 76e, and stored in the branch block data area 76n. Subsequently, the set of block data for blocks numbered fourteen, fifteen, and sixteen are stored in the branch block data area 76n in the order of description, and a block numbered seventeen is specified as the unchecked adjacent block of the block numbered sixteen. Since the block numbered seventeen is an end block but not the terminal block, the set of block data for the block numbered seventeen is stored in the end block data area 76v. Then, in Step S162, it is judged whether or not the stitch path flag 76p is in the state of zero. Since in this situation, the stitch path flag 76q is in the state of one, a negative judgment is provided in Step S162, and the control goes to Step S170 to read from the branch block data area 76n all sets of block data between the initial branch block data and the last branch block data, inclusive. In this particular case, the sets of block data for the block numbered ten which is associated with the current count, two, of the counter 76o, and the blocks numbered thirteen through seventeen, are read. Subsequently, Steps S165–S177 are executed, so that sets of position data representative of the central positions of the block numbered ten, thirteen, fourteen, fifteen, sixteen, and seventeen, a set of position data representative of a position numbered twenty as the end position of a stitch path for the branch to which the end block, numbered seventeen, belongs, and the set of block data for the blocks numbered seventeen, sixteen, fifteen, fourteen, and thirteen, are stored in the embroider order data area 76g in the order of description. In addition, the sets of block data for the blocks numbered thirteen through sixteen are eliminated from the branch block data area 76n, and the set of block data for the block numbered seventeen is eliminated from the end block data area 76v.

Subsequently, in Step S191, it is judged whether or not the number Y of unchecked adjacent blocks of the junction block, numbered ten, which is associated with the current count, two, of the counter 76o, is one. Since the block numbered ten has the sole unchecked adjacent block thereof, numbered eleven, an affirmative judgment is provided in Step S191, and the control goes to Step S209 to store the set of block data for the block numbered ten in the embroider order data area 76g, and then to Step S210 to set an embroider order flag 76k for the block numbered ten, to one.

Subsequently, in Step S211, it is judged whether or not the current count of the counter 76o is one. Since in this situation the current count is two, a negative judgment is provided in Step S211, and the control goes to Step S213 to read from the branch block data area 76n the set or sets of block data for the block or blocks between the block associated with the current count, two, of the counter 76o and the block associated with the count smaller by one than the current count, exclusive, in an order reverse to the order of storage thereof in the branch block data area 76n, namely, in the manner of being last stored and first read. Step S213 is followed by Step S214 to store those sets of block data in the embroider order data area 76g in the order of reading thereof from the branch block data area 76n. In this particular case, the set of block data for the block numbered eleven is stored in the embroider order data area 76g. In addition, in Step S214, the block check flags 76l for the sides separating the series of blocks having at the two ends thereof the block associated with the current count, two, of the counter 76o and the block associated with the count smaller by one than the current count, each are set to one. In this particular case, the block check flags 76*f*or the sides 34-13 and 33-14 separating the blocks numbered three, eleven, and ten from each other each are set to one. Step S214 is followed by Step S214*a* to set an embroider order flag 76*k* for the block, numbered eleven, whose block data has been stored in the embroider order data area 76*g* in Step S214, to one. Subsequently, in Step S215, the set of block data for the junction block that has been stored in the junction block data area 76*m* after the set of block data for the junction block associated with the count smaller by one than the current count of the counter 76*o*, is eliminated from the junction block data area 76*m*. In this particular case, the set of block data for the block numbered eleven is eliminated. Step S216 is followed by Step S217 to decrement the count of the counter 76*o* by one, to one.

Subsequently, in Step S187, the set of block data for the block, numbered three, which is associated with the current count, one, of the counter 76*o*, is read from the junction block data area 76*m*. Step S187 is followed by Step S189 to judge whether or not the number Y of unchecked adjacent block or blocks of the current junction block is one. Since the block check flags 76*l* for the sides 3-34, 3-6, and 34-13 each are set to one, the block numbered three has the sole unchecked adjacent block, numbered four. Therefore, an affirmative judgment is provided in Step S191, and the control goes to Step S209 to store the set of block data for the block numbered three in the embroider order data area 76*g*.

Then, in Step S211, it is judged whether or not the current count of the counter 76*o* is one. Since the current count is one, an affirmative judgment is provided in Step S211, and the control goes to Step S219 to read from the junction block data area 76*m* the set of block data for the block numbered three which is associated with the current count, one of the counter 76*o*, and then Step S220 to set a block check flag 76*l* for the side 3-6 separating the block numbered three from the block numbered four, to one. Step S220 is followed by Step S221 to reset the count of the counter 76*o* to zero, and then by Steps S223 and S225 to clear the junction block data area 76*m* and the branch block data area 76*n*, respectively.

Subsequently, in Step S137 the block numbered four is specified as the unchecked adjacent block of the block numbered three. Step S137 is followed by Step S139 to read the set of block data for the block numbered four from the block data area 76*e*. Then, Steps S129, S141, and S143 are executed. Since the current count of the counter 76*o* is zero, an affirmative judgment is provided in Step S143, and the control goes to Step S145 to store the set of block data for the block numbered four in the embroider order data area 76*g*.

In Step S137 at the subsequent cycle, the block numbered five is specified as the unchecked adjacent block of the block numbered four, and the set of block data for the block numbered five is stored in the embroider order data area 76*g* like the set of block data for the block numbered four. In Step S137 at the next cycle, the block numbered six is specified as the unchecked adjacent block of the block numbered five. Since the block numbered six is both an end block and the terminal block, an affirmative judgment is provided in Step S129, a negative judgment is provided in Step S131, and an affirmative judgment is provided in Step S159. Therefore, the control goes to Step S195 to store the set of block data for the block numbered six in the end block data area 76*v*. Step S195 is followed by Step S197 to judge whether or not there remains any block which has not been positioned in the order of embroidering of the character of FIG. 38. In this situation, all of the blocks have been positioned in the embroider order, a negative judgment is provided in Step S197. Accordingly, the control goes to Steps S227 and S229 to store the set of block data for the block numbered six in the embroider order data area 76*n*. Thus, the preparation of a set of stitch position data for embroidering the character "大", is ended.

As is apparent from the foregoing description, in the present embroidery sewing machine system, Steps S15, S17, S23, S29, S35 and the computer executing them serve as means for dividing an area to be embroidered into a plurality of sub-areas based on a set of outline data representative of an outline of the area, and Steps S82, S58, S522, S37, S39 and the computer executing them serve as means for producing a set of stitch position-related data utilized by the embroider sewing machine 8 for forming stitches and filling the area with the formed stitches.

While in Steps S71, S51, S501 of the illustrated embodiment the most distant two specific positions in an area to be divided are defined as the minimum and maximum positions of the area, it is possible to define substantially the most distant, or sufficiently distant, two specific positions as the minimum and maximum positions.

Further, while the outline data preparing means of the illustrated system is of a semi-automatic type which requires the operator to specify specific positions on the outline of an area to be embroidered, by using the light pen 86 on the CRT display 112, the preparing means can be adapted to be of a full-automatic type, by, for example, specifying positions at regular distances on the outline of an image obtained in Step S5 of FIG. 4, as candidates for the specific positions, connecting with a straight segment between each pair of adjacent two of the candidates, judging whether or not a smaller one of the two angles defined by each pair of adjacent two of the straight segments, is smaller than a reference value, and adopting, if an affirmative judgment is provided, the candidate at which the each pair of adjacent two segments are connected to each other, as one of the specific positions. The reference value is selected at a value near 180 degrees. If the angle in question is near 180 degrees, it means that the pair of adjacent two segments defines a substantially straight segment, and therefore that the candidate is not needed as a specific position. This full automatic means does not require any aid of the operator for producing the outline data.

While the present invention has been described in its presently preferred embodiment, it is to be understood that the present invention by no means is limited to the details of the illustrated embodiment but may be embodied with various changes, improvements, and modifications that may occur to those skilled in the art without departing from the scope and spirit of the invention defined in the appended claims.

What is claimed is:

1. An apparatus for preparing stitch position-related data and utilizing the data for controlling an embroidery sewing machine for embroidering a predetermined area by forming stitches at respective stitch positions and thereby filling the area with the formed stitches, comprising:

dividing means for dividing said area into a plurality of sub-areas based on outline data representative of an outline of said area, said outline data including sets of position data each of which is representative of a corresponding one of a plurality of specific positions specified on said outline;

data producing means for producing sets of sub-area data each of which is representative of an outline of a corresponding one of said sub-areas and determining, based on said sets of sub-area data, an order of embroidering of said sub-areas such that, when said embroidery sewing machine forms stitches with a continuous thread and fills each of said sub-areas by the formed stitches, by utilizing said sets of sub-area data and said order of embroidering of said sub-areas, said continuous thread does not pass over the stitches filling said each sub-area, said data producing means using said sets of sub-area data and said order of embroidering of said sub-areas for producing said stitch position-related data; and data utilization means for using said stitch position-related data to form said stitches.

2. The apparatus as set forth in claim 1, wherein said data producing means determines a connect path for connecting with said continuous thread between a first position belonging to a first one of said sub-areas and a second position belonging to a second one of said sub-areas, at least a portion of said connect path being covered by the stitches filling at least one of said second sub-area and at least one sub-areas subsequent to said second sub-area in said order of embroidering of said sub-areas.

3. The apparatus as set forth in claim 2, wherein said data producing means determines said connect path such that said connect path is covered in entirety by the stitches filling said each sub-area, and produces connect path data representative of said connect path as a portion of said stitch position-related data.

4. The apparatus as set forth in claim 3, wherein said data producing means comprises means for judging, based on said sets of sub-area data, whether or not it is necessary for said data producing means to determine said connect path such that said connect path is covered in entirety by the stitches filling said each sub-area.

5. The apparatus as set forth in claim 1, further comprising means for specifying in said area a start and an end position where the embroidering of said area starts and ends, said data producing means determining said order of embroidering of said sub-areas based on said start and end positions.

6. The apparatus as set forth in claim 1, wherein said dividing means specifies a plurality of base positions on said outline of said area based on said outline data, and defines a plurality of straight division lines each of which passes corresponding two of said base positions and which do not intersect each other inside said outline, said division lines dividing said area into said sub-areas, said base positions including said specific positions.

7. The apparatus as set forth in claim 6, wherein said dividing means divides a polygon as said area into a plurality of sub-polygons as said sub-areas, said specific positions consisting of vertices of said polygon, said base positions including said vertices.

8. The apparatus as set forth in claim 6, wherein said dividing means comprises determining means for determining the most distant, or approximately the most distant, two positions of the specific positions of said outline of said area, as a minimum and a maximum position of said area, and determining a direction of a straight line passing said minimum and maximum positions as a longitudinal direction of said area;

deflection position finding means for rotating said outline in an X-Y coordinate system so that said longitudinal direction becomes parallel to one of an X and a Y axis of said X-Y coordinate system, and successively checking said specific positions in an order of location thereof on said outline, for a deflection position, by judging whether or not a sign of a value obtained by subtracting a value with respect to said one axis of a currently checked specific position from that of a following specific position which is checked next, is same as that of a value obtained by subtracting a value with respect to said one axis of a preceding specific position which has just been checked from that of said currently checked specific position, said deflection position finding means determining, if a negative judgment is provided, said currently checked position as said deflection position; and deflection direction judging means for judging whether or not said deflection position is an outward deflection position, said deflection direction judging means judging, in the case where said deflection position finding means checks said specific positions on said outline in a clockwise direction, said deflection position as being said outward deflection position if said following specific position of said deflection position is located on a left-hand side thereof as viewed in a direction of a vector starting at said preceding specific position of said deflection position and ending at said deflection position, and, in the case where said deflection position finding means checks said specific positions on said outline in a counterclockwise direction, said deflection position as being said outward deflection position if said following specific position of said deflection position is located on a right-hand side thereof as viewed in said direction of said vector, said dividing means dividing said area into divided areas as said sub-areas by said division lines so that each of said divided areas has no outward deflection position.

9. The apparatus as set forth in claim 6, wherein said dividing means comprises:

determining means for determining substantially the most distant two positions of the specific positions of said outline of said area, as a minimum and a maximum position of said area; and judging means for judging whether or not all straight segments obtained by connecting between each of said distant two positions and each of the other specific positions of said outline are contained inside said outline, said dividing means dividing said area into divided areas as said sub-areas by said division lines so that said judging means provides an affirmative judgment for each of said divided areas.

10. The apparatus as set forth in claim 6, wherein said dividing means comprises:

determining means for determining substantially the most distant two positions of the specific positions of said outline of said area, as a minimum and a maximum position of said area, and determining a direction of a straight line passing said minimum and maximum positions as a longitudinal direction of said area, said outline consisting of a pair of portions which are opposed to each other with respect to said minimum and maximum positions;

defining means for comparing a number of the specific positions of one of the opposed portions of said outline, with that of the other of said opposed portions, determining as a first portion of said outline one of said opposed portions which has a smaller number of the specific positions belong, respectively, each of said triangle-like blocks being approximated by a triangle defined by three of said specific positions.

11. The apparatus as set forth in claim 10, wherein said dividing means comprises second modifying means for modifying said each triangle-like block to a quadrangle-like block which is approximated by a quadrangle defined by four of said specific positions.

12. The apparatus as set forth in claim 10, wherein said dividing means comprises:

means for defining a plurality of straight second aid lines which are perpendicular to said longitudinal direction and each of which passes a corresponding one of the specific positions of said second portion of said outline, said second aid line cooperating with said first aid lines to divide said area and said outline into a plurality of second blocks and a plurality of second segments, respectively, each of said second blocks being enveloped by corresponding two to of said first and second aid lines which are opposed to each other and corresponding two of said second segments which are opposed to each other;

means for determining a first vector starting at one of opposite ends of one of the opposed two second segments of each of said second blocks and ending at the other end of said one second segment, a second vector starting at one of opposite ends of the other of said opposed two second segments which end is opposed to said one end of said one second segment and ending at the other end of said other second segment which end is opposed to said other end of said one second segment, and a third vector which starts at a position on one of the opposed two aid lines of said each second block, extends in a direction of a vector produced by addition of said first and second vectors, and ends at a position on the other of said opposed two aid lines, the end position on each of said first and second aid lines at which the third vector for one of the two second blocks on both sides of said each aid line ends serving simultaneously as the start position on said each aid line at which the third vector for the other second block starts, said minimum position serving as one of the start and end ends for both the first and second vectors for the second block to which said minimum position belongs and simultaneously as one of the start and end position for the second block to which said minimum position belongs and, while said maximum position serving as one of the end and start ends for both the first and second vectors for the second block to which said minimum position belongs and simultaneously as one of the end and start position for the second block to which said maximum position belongs;

means for determining for each of said first aid lines a fourth vector by addition of the third vectors for the two blocks on both sides of said each first aid line; and means for defining a straight reference line which passes the specific position associated with said each first aid line and is perpendicular to said fourth vector.

13. The apparatus as set forth in claim 12, wherein said dividing means comprises:

means for determining an intersection of said each first aid line and said second portion of said outline, and determining two of the specific positions of said second portion which two positions are adjacent to said intersection on both sides thereof, respectively, as a preceding and a following specific position for the specific position associated with said each first aid line; and means for comparing a first angle containing by said reference line and a first straight line passing said preceding specific position and said associated specific position, with a second angle contained by said reference line and a second straight line passing said following specific position and said associated specific position, said dividing means determining as said division base position one of said preceding and following specific positions which provides a smaller one of said first and second angles, said modified first blocks being defined by said outline and the division lines determined in place of said first aid lines of said each first block.

14. The apparatus as set forth in claim 13, wherein said dividing means comprises:

first judging means for judging whether or not said preceding specific position is located between said intersection, and an intersection of said second portion of said outline and the first aid line associated with one of the two specific positions of said first portion which two positions are adjacent to the specific position associated with said each first aid line, on both sides of said associated specific position, respectively;

second judging means for judging whether or not said following specific position is located between said intersection, and an intersection of said second portion and the first aid line associated with the other of said two specific positions, said dividing means determining as said division base position a middle point of a straight segment connecting between said preceding and following specific positions if both said first and second judging means provide negative judgments, said dividing means determining as said division base position said preceding specific position if both said first and second judging means provide an affirmative judgment and said negative judgment, respectively, said dividing means determining as said division base position said following specific position if both said first and second judging means provide said negative judgment and an affirmative judgment, respectively, said dividing means determining said division base position by utilizing the comparison result of said means for comparing said first and second angles, if both said first and second judging means provide said affirmative judgments.

15. The apparatus as set forth in claim 14, wherein said dividing means comprises means for specifying at least one specific position on said second portion of said outline which at least one position has not been determined as the division base position, and determining for said at least one specific position the division base position or portions on said first portion of said outline, said dividing means dividing said area into quadrangle-like blocks as said modified first blocks except for said two triangle-like blocks to which said minimum and maximum positions belong, respectively, said modified first blocks constituting an array in said area.

16. The apparatus as set forth in claim 15, wherein said data producing means comprises:

first memory means for storing, as said sets of sub-area data, sets of block data representative of an outline of a corresponding one of said modified first blocks;

second memory means for storing said sets of block data in said order of embroidering of said modified first blocks;

means for specifying on said outline of said area a start and an end position where the embroidering of said area starts and ends;

checking means for checking said sets of block data stored in said first memory means, for a start and a terminal block which are two of said modified first blocks to which said start and end positions belong, respectively, an end block which shares only one of said division lines with only one of said modified first blocks which one block is adjacent thereto, and a junction block which shares at least three of said division lines with at least three of said modified first blocks which blocks are adjacent thereto; and order determining means for, if said modified first blocks include said junction block, storing in said second memory means the set or sets of block data for said start block and, if any, the block or blocks between said start block and said junction block, exclusive, in a first order of location of the block or blocks from said start block toward said junction block, said order determining means checking the sets of block data for said junction block, any one of the adjacent blocks of said junction block other than the adjacent block whose block data has been stored in the second memory means, and, if any, the block or blocks belonging to a branch extending from said one adjacent block, for finding the end block located at an end portion of said branch, in a second order of location of the block or blocks from said junction block toward the end block, determining, if the end block is not said terminal block, said connect path such that said connect path passes in said second order a position belonging to each of said junction block and the block or blocks belonging to said branch, and storing a set of connect path data representative of said connect path in said second memory means, said order determining means storing, subsequent to said set of connect path data in said second memory means, the set or sets of block data for the end block and, if any, the block or blocks between the end block and said junction block, exclusive, in a third order of location of the block or blocks from the end block toward said junction block, said order determining means determining, if the end block is said terminal block, storing in said second memory means the sets of block data for said junction block, said terminal block, and, if any, the block or blocks between said junction block and said terminal block, exclusive, in a fourth order of location of the blocks from said junction block to said terminal block.

17. The apparatus as set forth in claim 16, wherein said data produces means producing, based on said sets of block data and set of connect path data stored in said second memory means, stitch position data representative of stitch positions which said embroidery sewing machine connects with said continuous thread to form said stitches for filling said each of said sub-areas with the formed stitches and forms at least one stitches along said connect path for connecting two of said modified first blocks, said stitch position data serving as said stitch position-related data.

18. The apparatus as set forth in claim 1, further comprising:

image read means for reading an image of said area; and outline data producing means for producing said outline data from the read image of said area.

19. The apparatus as set forth in claim 18, further comprising:

display means for displaying an outline of the image read by said image read means; and manually operable specifying means for specifying as said specific positions a plurality of positions on said outline of the read image, said outline data producing means producing said outline data such that said outline data consists of the specified positions.

20. The apparatus as set forth in claim 18, further comprising:

specifying means for specifying as candidates for said specific positions a plurality of positions at regular distances on said outline of the read image, and connecting with a straight segment between each pair of adjacent two of said candidates; and judging means for judging whether or not a smaller one of the two angles defined by each pair of adjacent two of the straight segments, is smaller than a reference value, said outline data producing means adopting, if an affirmative judgment is provided by said judging means, the candidate at which said each pair of adjacent two segments are connected to each other, as one of said specific positions.

* * * * *